US007845316B2

(12) United States Patent
Hochmayr et al.

(10) Patent No.: US 7,845,316 B2
(45) Date of Patent: Dec. 7, 2010

(54) INTERNAL COMBUSTION ENGINE COOLING SYSTEM

(75) Inventors: Markus Hochmayr, Krenglbach (AT); Jean-Charles Pouillard, Krenglbach (AT); Stefan Leiber, Marchtrenk (AT); Anton Pichler, Steyr (AT); Rudolf Kusel, Thalheim (AT); Johann Neuboeck, Gunskirchen (AT)

(73) Assignee: BRP-Powertrain GmbH & Co KG, Gunskirchen (AT)

( * ) Notice: Subject to any disclaimer, the term of this patent is extended or adjusted under 35 U.S.C. 154(b) by 411 days.

(21) Appl. No.: 11/960,557

(22) Filed: Dec. 19, 2007

(65) Prior Publication Data

US 2009/0007858 A1 Jan. 8, 2009

Related U.S. Application Data

(60) Provisional application No. 60/948,283, filed on Jul. 6, 2007.

(51) Int. Cl.
*F01P 11/08* (2006.01)

(52) U.S. Cl. ..... 123/41.33; 123/41.74

(58) Field of Classification Search ..... 123/41.33, 123/41.72, 41.74, 41.79, 41.81, 41.83, 41.84, 123/196 AB
See application file for complete search history.

(56) References Cited

U.S. PATENT DOCUMENTS 2,494,742 A * 1/1950 Buske ..... 123/41.44
4,569,313 A * 2/1986 Nobu ..... 123/41.74
5,052,348 A 10/1991 Takakura et al.
6,202,603 B1 3/2001 Etemad
6,481,392 B1 * 11/2002 Etemad ..... 123/41.74
6,536,398 B2 3/2003 Neal
7,086,356 B2 * 8/2006 Matsuda ..... 123/41.72
7,089,890 B2 8/2006 Obidi (Continued)

FOREIGN PATENT DOCUMENTS

DE 102006006121 A1 8/2007

(Continued)

OTHER PUBLICATIONS

International Search report of Application No. PCT/EP2008/051074; Aug. 8, 2008; Luta, Dragos.

(Continued)

*Primary Examiner*—Noah Kamen
(74) *Attorney, Agent, or Firm*—Osler, Hoskin & Harcourt LLP

(57) ABSTRACT

An internal combustion engine has a crankcase, a crankshaft, a cylinder block, at least one piston, a cylinder head assembly, and a cooling system for cooling at least a portion of the engine. The cooling system has a first cooling jacket for cooling a first side of the cylinder block, a second cooling jacket for cooling a second side of the cylinder block, and a cylinder head cooling jacket for cooling the cylinder head assembly. A coolant inlet and a coolant outlet fluidly communicate with the first and second cooling jackets respectively. Coolant flowing in the cooling system flows from the coolant inlet to the first cooling jacket, then to the cylinder head cooling jacket, then to the second cooling jacket, and finally to the coolant outlet. A cylinder block, an engine cooling system, and a method of cooling an engine are also disclosed.

13 Claims, 44 Drawing Sheets

U.S. PATENT DOCUMENTS

2003/0037754 A1 2/2003 Neal

FOREIGN PATENT DOCUMENTS

| | | | |
|---|---|---|---|
| EP | 0671552 | A1 | 9/1995 |
| EP | 1052394 | A2 | 11/2000 |
| EP | 1074723 | A2 | 2/2001 |
| EP | 1477645 | A1 | 11/2004 |
| JP | 55096341 | | 7/1980 |
| JP | 58093926 | | 6/1983 |
| JP | 61155616 | | 7/1986 |
| JP | 04214951 | | 8/1992 |
| JP | 06173675 | | 6/1994 |
| JP | 06200758 | | 7/1994 |
| JP | 07127520 | | 5/1995 |
| JP | 8093926 | | 4/1996 |
| JP | 08270496 | | 10/1996 |
| JP | 09068041 | | 3/1997 |
| JP | 2002115600 | | 4/2002 |
| JP | 2002339746 | | 11/2002 |
| JP | 2003003905 | | 1/2003 |
| JP | 2005256661 | | 9/2005 |
| JP | 2006090193 | | 4/2006 |

OTHER PUBLICATIONS

English Abstract of Application No. EP1052394.
English Abstract of Application No. EP0671552.
English abstract of JP81093926.
English abstract of JP61155616.
English abstract of JP2002339746.
English abstract of JP09068041.
English abstract of JP58093926.
English abstract of JP04214951.
English abstract of JP06200758.
English abstract of JP08270496.
English abstract of JP2006090193.
English abstract of JP07127520.
English abstract of JP2003003905.
English abstract of JP55096341.
English abstract of JP2005256661.
English abstract of JP2002115600.
English abstract of JP06173675.
English Abstract of German Patent No. DE102006006121, Published on Aug. 16, 2007.

* cited by examiner

A-A

B - B

INTERNAL COMBUSTION ENGINE COOLING SYSTEM

CROSS-REFERENCE

The present application claims priority to U.S. Provisional Patent Application No. 60/948,283 filed on Jul. 6, 2007, the entirety of which is incorporated herein by reference.

FIELD OF THE INVENTION

The present invention relates to an internal combustion engine cooling system.

BACKGROUND OF THE INVENTION

During operation, an internal combustion engines generates heat due to the combustion process taking place inside each cylinder of the engine. As would be known to those skilled in the art of engines, if the engine overheats, it could become damaged. For this reason, many engines are provided with a cooling system.

Some engines are air cooled, but engines that are designed to operate at high speeds or to generate a lot power are preferably liquid cooled. Liquid cooled engine are generally provided with passage inside the engine block, known as cooling jackets, through which liquid can be circulated. As the liquid circulates in the cooling jackets, it absorbs the heat from the engine.

In marine applications, the engines are often provided with what is known as an open-loop cooling system. In such systems, the liquid used is the water from the body of water in which the vehicle operates. Water is taken from the body of water, is made to pass through the cooling jackets, and is then returned to the body of water. For obvious reasons, such a system is impractical for most other applications. In other applications, engines are provided with what is known as a closed-loop cooling system. In such systems, coolant is stored in a reservoir and is made to circulate through the system. In order to maintain the system's efficiency, the coolant itself needs to be cooled as it would otherwise get increasingly hotter. Therefore, these systems are provided with heat exchangers, such as radiators, through which the coolant is circulated to reduce the coolant temperature.

To operate properly, a liquid cooling system must circulate coolant in the vicinity of every source of heat in the engine and/or the components of the engine which get heated by the heat sources. Some portions of the engine also require more cooling than other parts, either because they are more heat sensitive or get hotter. This can often lead to complicated flow paths within the engine. Also, the cooling jackets must also be designed such that coolant continuously flows therethrough. If coolant stagnates inside a cooling jacket, the portion where the coolant stagnates gets hot, which can results in damages to the engine.

Therefore, there is a need for an engine cooling system that addresses at least some of the concerns mentioned above.

SUMMARY OF THE INVENTION

It is an object of the present invention to provide an internal combustion engine having a cooling system where coolant flows from one side of the cylinder block, up to the cylinder head assembly, and down the other side of the cylinder block.

It is another object of the present invention to provide a cooling system for an internal combustion engine where coolant flows from one side of the cylinder block, up to the cylinder head assembly, and down the other side of the cylinder block.

It is also an object of the present invention to provide a method for cooling an internal combustion engine where coolant is first delivered to one side of the cylinder block, is then delivered from the first cylinder block to the cylinder head assembly, and is finally delivered from the cylinder head assembly to the other side of the cylinder block.

It is yet another object of the present invention to provide a cylinder block for an internal combustion engine having two adjacent, but fluidly separate, cooling jackets integrally formed therein.

In one aspect, the invention provides an internal combustion engine having a crankcase, a crankshaft disposed in the crankcase, a cylinder block connected to the crankcase, at least one piston, a cylinder head assembly connected to the cylinder block, and a cooling system for cooling at least a portion of the engine. The at least one piston is disposed in the at least one cylinder and is operatively connected to the crankshaft. The cooling system has a first cooling jacket for cooling the first side of the cylinder block, a second cooling jacket for cooling the second side of the cylinder block, a cylinder head cooling jacket for cooling the cylinder head assembly, a coolant inlet fluidly communicating with the first cooling jacket; and a coolant outlet fluidly communicating with the second cooling jacket. The first cooling jacket fluidly communicates with the cylinder head cooling jacket. The cylinder head cooling jacket fluidly communicates with the second cooling jacket. Coolant flowing in the cooling system flows from the coolant inlet to the first cooling jacket, from the first cooling jacket to the cylinder head cooling jacket, from the cylinder head cooling jacket to the second cooling jacket, and from the second cooling jacket to the coolant outlet.

In an additional aspect, the coolant inlet is on the first side of the engine and the coolant outlet is on the second side of the engine.

In a further aspect, the cooling system also has a coolant pump fluidly communicating with the coolant inlet for pumping coolant through the cooling system.

In an additional aspect, the cooling system also has a heat exchanger for cooling coolant flowing in the cooling system. Coolant flowing in the cooling system flows from the coolant outlet to the heat exchanger, from the heat exchanger to the coolant pump, and from the coolant pump to the coolant inlet.

In a further aspect, the cooling system also has a thermostat. The thermostat has a thermostat inlet fluidly communicating with the coolant outlet, a first thermostat outlet fluidly communicating with the heat exchanger, and a second thermostat outlet fluidly communicating with the coolant pump. Coolant flowing in the cooling system flows from the coolant outlet to the thermostat inlet, from the thermostat inlet to the first thermostat outlet when the coolant is above a predetermined temperature, and from the thermostat inlet to the second thermostat outlet when the coolant is below the predetermined temperature.

In an additional aspect, the cooling system also has an oil cooler. The oil cooler fluidly communicates with the first cooling jacket and the coolant pump. A portion of the coolant flowing in the first cooling jacket flows to the oil cooler, and from the oil cooler to the coolant pump.

In a further aspect, the first and second cooling jackets are integrally formed in the cylinder block, and the cylinder head cooling jacket is integrally formed in the cylinder head assembly.

In an additional aspect, at least one intake valve is disposed in the cylinder head assembly above the at least one cylinder on an intake side of the engine, and at least one exhaust valve is disposed in the cylinder head assembly above the at least one cylinder on an exhaust side of the engine.

In a further aspect, the first side of the cylinder block is on the exhaust side of the engine and the second side of the cylinder block is on the intake side of the engine.

In another aspect, the invention provides a cooling system for an internal combustion engine having a first cooling jacket for cooling a first side of an engine cylinder block, a second cooling jacket for cooling a second side of the engine cylinder block, a cylinder head cooling jacket for cooling a cylinder head assembly of the engine, a coolant inlet fluidly communicating with the first cooling jacket, a coolant outlet fluidly communicating with the second cooling jacket, and a coolant pump fluidly communicating with the coolant inlet for pumping coolant through the cooling system. The first cooling jacket fluidly communicates with the cylinder head cooling jacket. The cylinder head cooling jacket fluidly communicates with the second cooling jacket. Coolant flowing in the cooling system flows from the coolant pump to the coolant inlet, from the coolant inlet to the first cooling jacket, from the first cooling jacket to the cylinder head cooling jacket, from the cylinder head cooling jacket to the second cooling jacket, and from the second cooling jacket to the coolant outlet.

In an additional aspect, the cooling system also has a heat exchanger for cooling coolant flowing in the cooling system. Coolant flowing in the cooling system flows from the coolant outlet to the heat exchanger, and from the heat exchanger to the coolant pump.

In a further aspect, the cooling system also has a thermostat. The thermostat has a thermostat inlet fluidly communicating with the coolant outlet, a first thermostat outlet fluidly communicating with the heat exchanger, and a second thermostat outlet fluidly communicating with the coolant pump. Coolant flowing in the cooling system flows from the coolant outlet to the thermostat inlet, from the thermostat inlet to the first thermostat outlet when the coolant is above a predetermined temperature, and from the thermostat inlet to the second thermostat outlet when the coolant is below the predetermined temperature.

In an additional aspect, the cooling system also has an oil cooler. The oil cooler fluidly communicates with the first cooling jacket and the coolant pump. A portion of the coolant flowing in the first cooling jacket flows to the oil cooler, and from the oil cooler to the coolant pump.

In yet another aspect, the invention provides a method of cooling an internal combustion engine. The engine has a crankcase, a crankshaft disposed in the crankcase, a cylinder block connected to the crankcase, at least one piston, and a cylinder head assembly connected to the cylinder block. The cylinder block has a first side, a second side, and at least one cylinder. The at least one piston is disposed in the at least one cylinder and is operatively connected to the crankshaft. The method comprises delivering coolant to a first cooling jacket for cooling the first side of the cylinder block, delivering coolant from the first cooling jacket to a cylinder head cooling jacket for cooling the cylinder head assembly, and delivering coolant from the cylinder head cooling jacket to a second cooling jacket for cooling the second side of the cylinder block.

In a further aspect, the method further comprises providing a coolant pump, and delivering coolant to the first cooling jacket consists of using the coolant pump for pumping coolant to the first cooling jacket.

In an additional aspect, the method further comprises providing a heat exchanger for cooling the coolant, delivering coolant from the second cooling jacket to the heat exchanger, and delivering coolant from the heat exchanger to the coolant pump.

In a further aspect, the method further comprises providing a thermostat, delivering coolant from the second cooling jacket to the thermostat, delivering coolant from the thermostat to the heat exchanger when the coolant is above a predetermined temperature, and delivering coolant from the thermostat to the coolant pump when the coolant is below the predetermined temperature.

In an additional aspect, the method further comprises providing an oil cooler, delivering coolant from the first cooling jacket to the oil cooler, and delivering coolant from the oil cooler to the coolant pump.

In another aspect, the invention provides a cylinder block for an internal combustion engine having a cylinder block body, and at least one cylinder formed by the cylinder block body. A first cooling jacket is integrally formed in the cylinder block body. The first cooling jacket is disposed adjacent a first portion of the at least one cylinder. A second cooling jacket is integrally formed in the cylinder block body. The second cooling jacket is disposed adjacent a second portion of the at least one cylinder. The second cooling jacket is fluidly separate from the first cooling jacket in the cylinder block body.

In a further aspect, the cylinder block also has a longitudinal axis passing through a center of the cylinder block body. The first cooling jacket is disposed completely on a first side of the longitudinal axis and the second cooling jacket is disposed completely on a second side of the longitudinal axis. The second side is opposite to the first side.

In an additional aspect, the at least one cylinder is three cylinders disposed in line. The first cooling jacket is disposed adjacent a first portion of each of the three cylinder. The second cooling jacket is disposed adjacent a second portion of each of the three cylinder.

In a further aspect, the first cooling jacket forms a first arc about the first portion of the at least one cylinder, and the second cooling jacket forms a second arc about the second portion of the at least one cylinder.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE INVENTION

Figure 1:
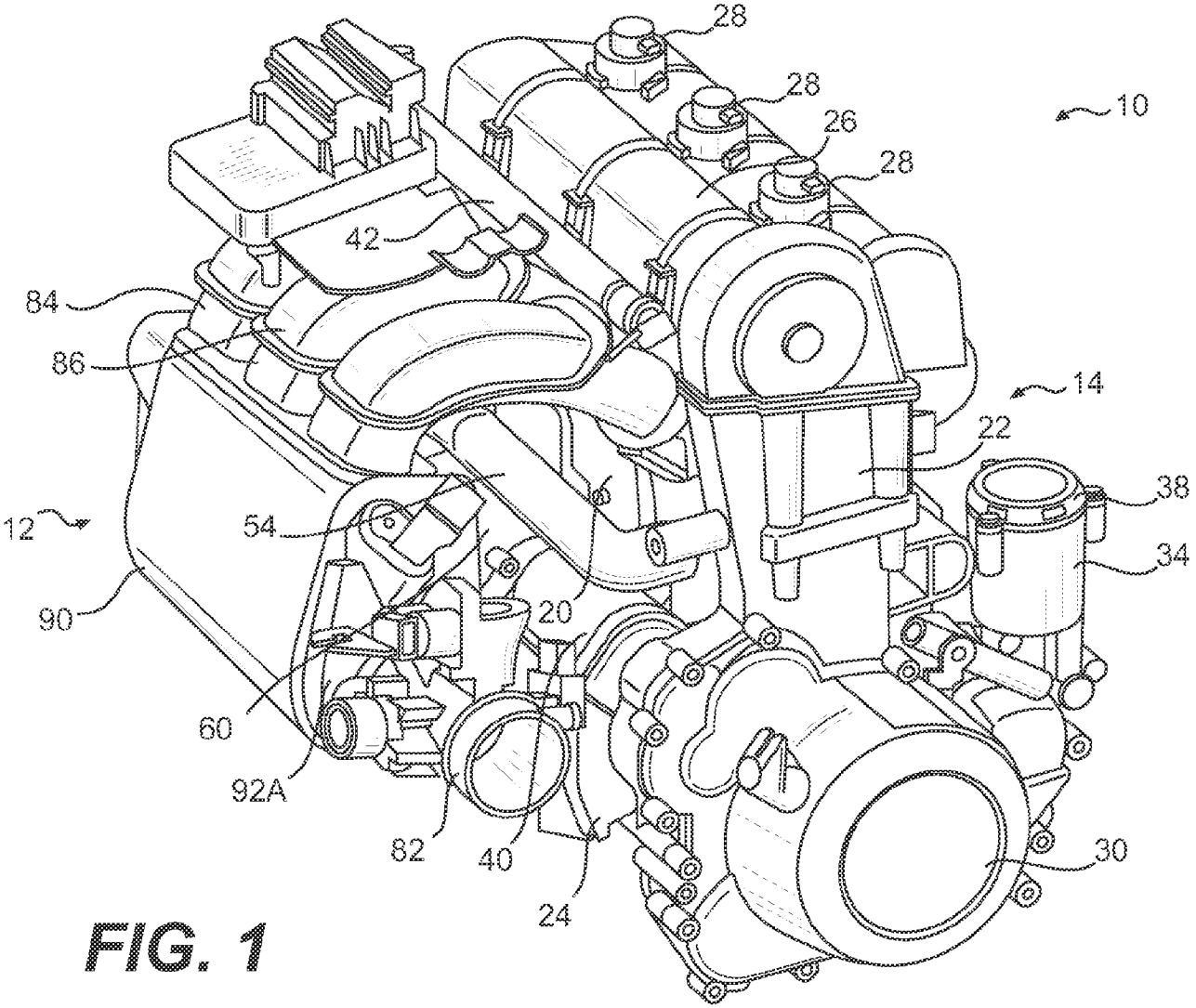
FIG. 1 is a perspective view, from a first end, air intake side, of a first embodiment of the internal combustion engine.

Although the engine of the present invention is being described herein as being usable in a personal watercraft or a snowmobile, it should be understood that it would also be possible to use this engine in other applications, such as, for example, all-terrain vehicles and motorcycles.

Throughout the detailed description and drawings, similar components will be labelled with a reference numeral followed by a letter (for example 106A, 106B). For simplicity, these similar components will be referred to by their reference numeral only when referring to the components in general and the reference numeral and the letter will be used when reference to a specific one of the similar components is being made.

Turning now to the drawings and referring first to FIGS. 1 to 8, external features of the engine 10 will be described. As can be seen by comparing the embodiment of the engine 10 illustrated in FIGS. 1 to 4 to the embodiment of the engine 10 illustrated in FIGS. 5 to 8, it is possible for the manufacturer, by changing a few external components of the engine 10, to adapt the same engine 10 for use in different applications. More specifically, by changing the air intake components 12 and the exhaust components 14, the engine 10, as illustrated in FIGS. 1 to 4, can be used in a personal watercraft 16 (see FIG. 4) where the crankshaft 50 (FIG. 13) of the engine 10 is oriented parallel to the longitudinal axis of the personal watercraft 16, and the engine 10, as illustrated in FIGS. 5 to 8, can also be used in a snowmobile 18 (see FIG. 8) where the crankshaft 50 of the engine 10 is oriented transverse to the longitudinal axis of the snowmobile 18. Therefore, although two embodiments of the engine 10 are illustrated herein, the description of the engine 10 given below, applies to both embodiments, other than for the air intake and exhaust components 12, 14, which will be specifically described below for each embodiment.

Figure 13:
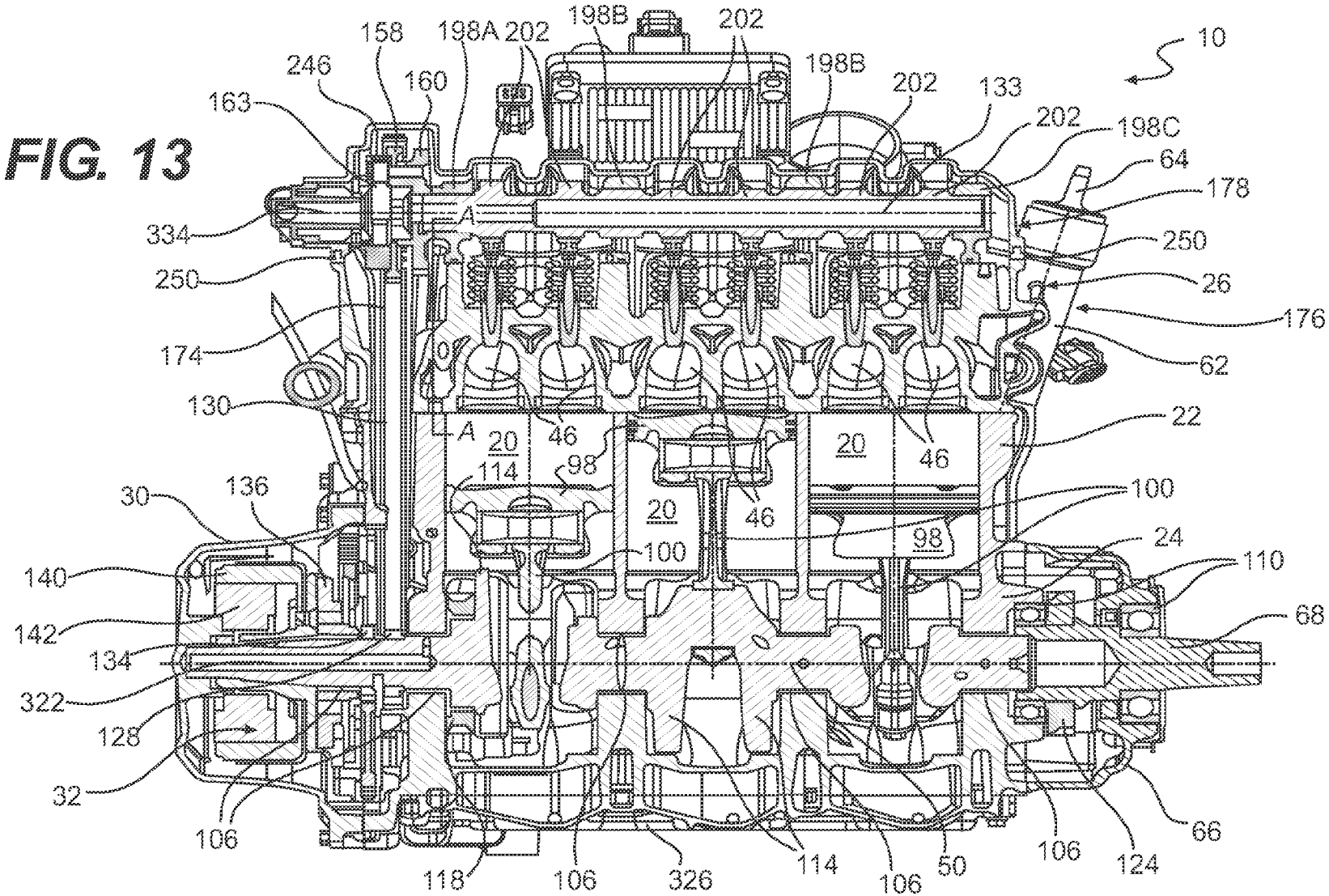
FIG. 13 is a vertical cross-section, taken through the center of and parallel to the crankshaft and the first camshaft, of the engine of FIG. 5.

As can be seen in FIGS. 1 to 8, the engine 10 is what is known as a three-cylinder in-line engine, which means that it has three cylinders 20 disposed in a straight line next to each other (see FIG. 13). It is contemplated that a greater or fewer number of cylinders 20 could be used. It is also contemplated that aspects of the engine 10 could also be used in other types of engines, such as V-type engines, as will become apparent further below. All of the cylinders 20 are formed in a cylinder block 22, which sits atop the crankcase 24. A cylinder head assembly 26 sits atop the cylinder block 22. A spark plug 28 is provided in the cylinder head assembly 26 for each cylinder 20.

Figure 18:
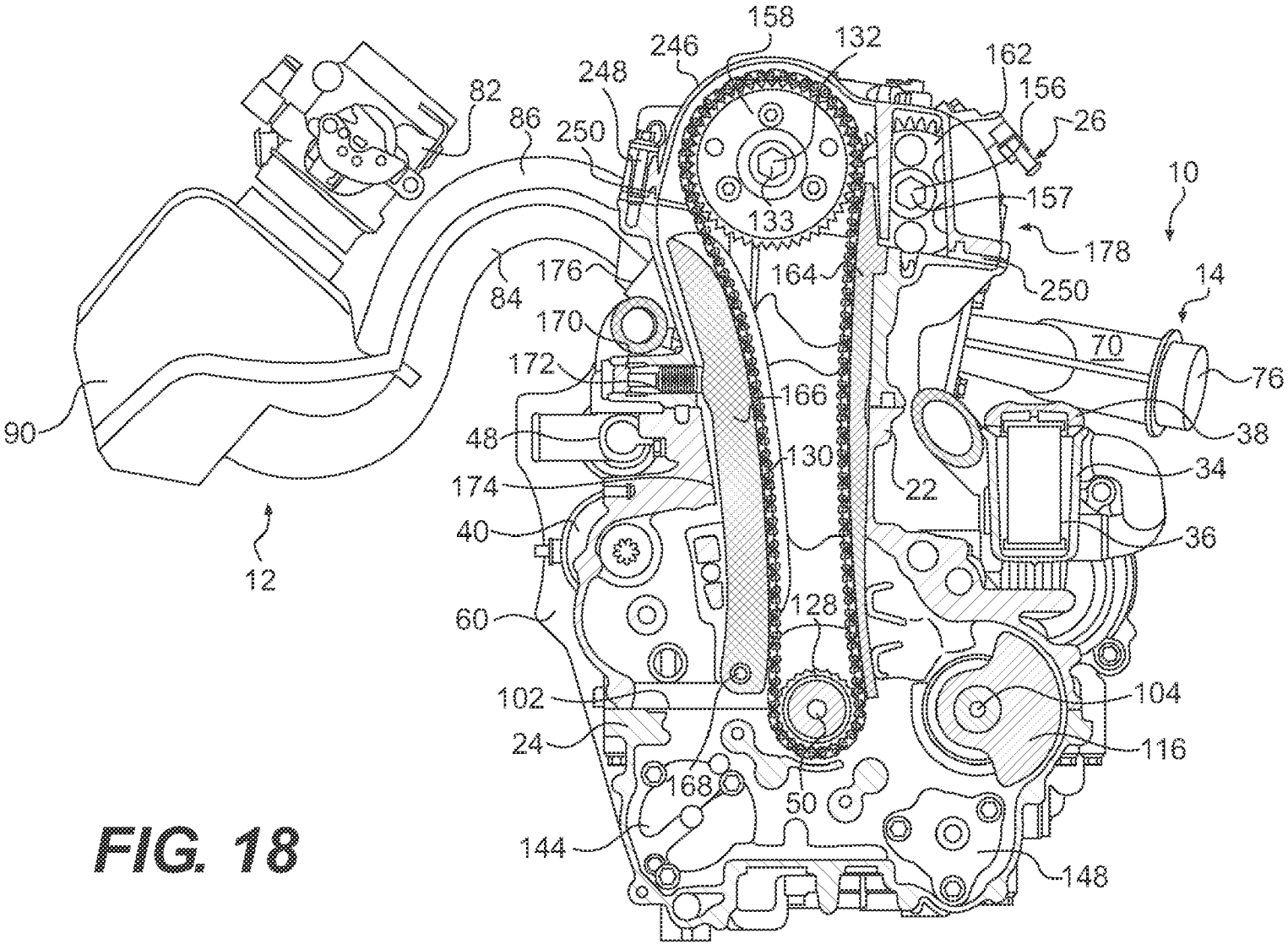
FIG. 18 is a vertical cross-section, taken through the timing chain case perpendicularly to the crankshaft, of the engine of FIG. 5.

As best seen in FIGS. 1, 3, 5, and 7, a magneto cover 30 is bolted to the crankcase 24 on the first end of the engine 10 to cover the magneto 32 (FIG. 13) and other components of the engine 10 described below. An oil filter housing 34 is also provided at the first end of the engine 10 on the same a side as the exhaust components 14 to, as the name suggests, house the oil filter 36 (FIG. 18). The oil filter housing 34 has a removable cap 38 provided at the top thereof to allow for easy access to the oil filter 36, thereby facilitating maintenance of the engine 10. A starter motor 40 is also provided at the first end of the engine 10 alongside the cylinder block 22 on the same side as the intake components 14. The starter motor 40 is an electrical motor which, as is known by those skilled in the art, is operatively connected to the crankshaft 50 in order to initiate the rotation of the crankshaft 50 to allow for the initial ignition(s) to occur, which then allows the engine 10 to run.

Figure 10:
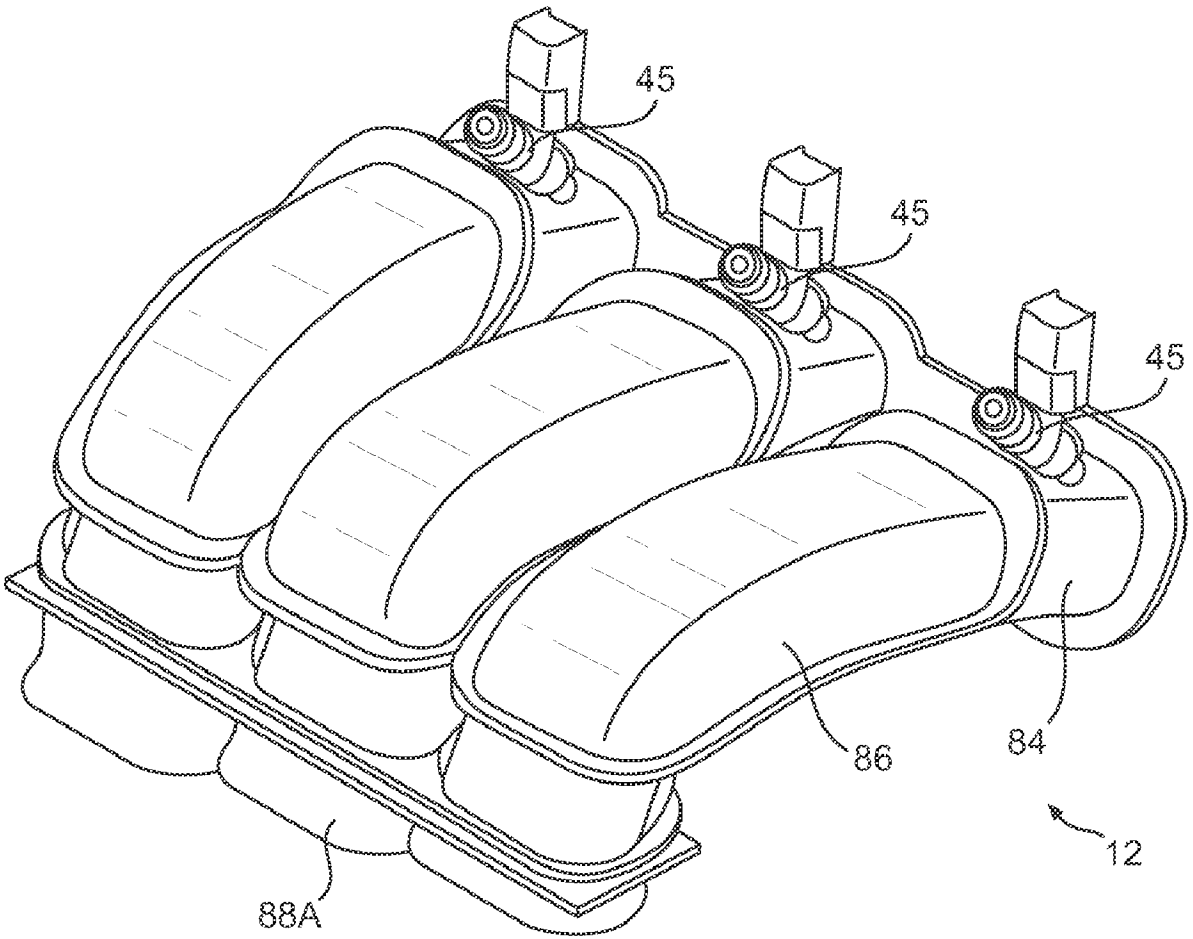
FIG. 10 is a perspective view of air intake components of the first embodiment of the engine.

A fuel rail 42 disposed on the air intake components 12 receives fuel from a fuel tank 44 (FIG. 4) and delivers it to three fuel injectors 45 (FIG. 10). Each fuel injector 45 is in fluid communication with the intake passages 46 (FIG. 19) of each cylinder 20.

Figure 26:
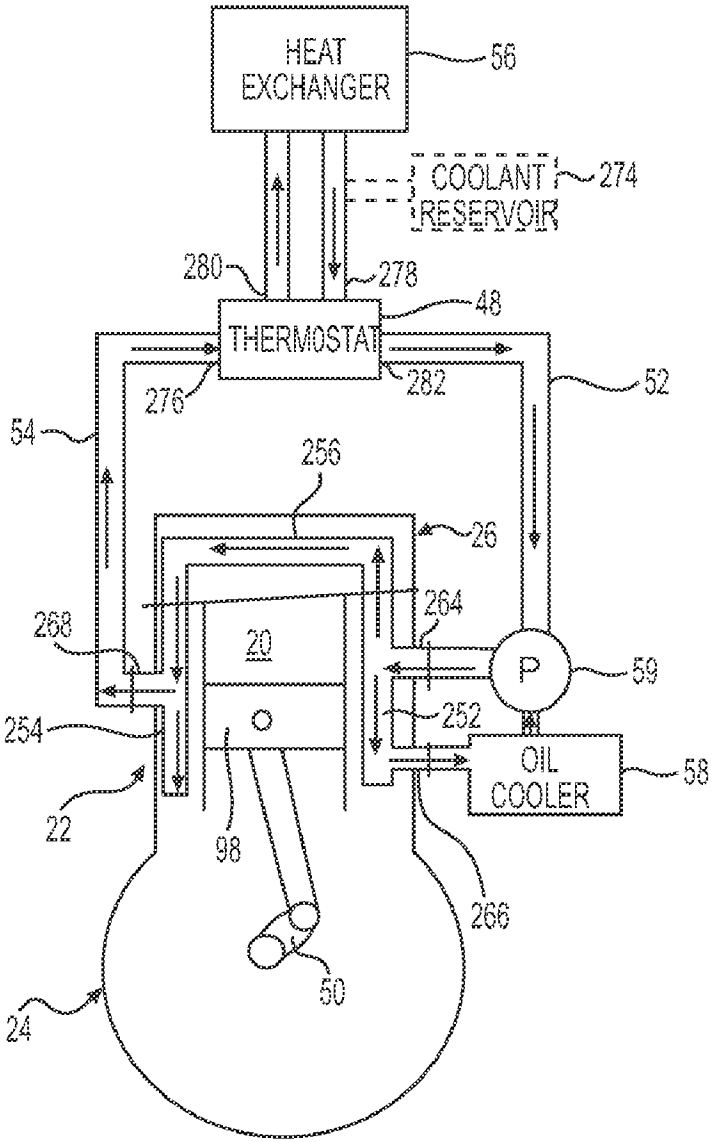
FIG. 26 is a schematic illustration of a cooling system of the engine of FIG. 5.

Portions of the cooling system, described in greater detail below, can also be seen in FIGS. 1 to 8. A coolant intake pipe 52 is generally disposed on an exhaust side of the engine 10. A coolant exhaust pipe 54 is generally disposed on the intake side of the engine 10. A thermostat 48 fluidly connects the coolant intake and exhaust pipes 52, 54 to each other and also fluidly communicates with a coolant heat exchanger 56 (FIG. 26).

Figure 2:
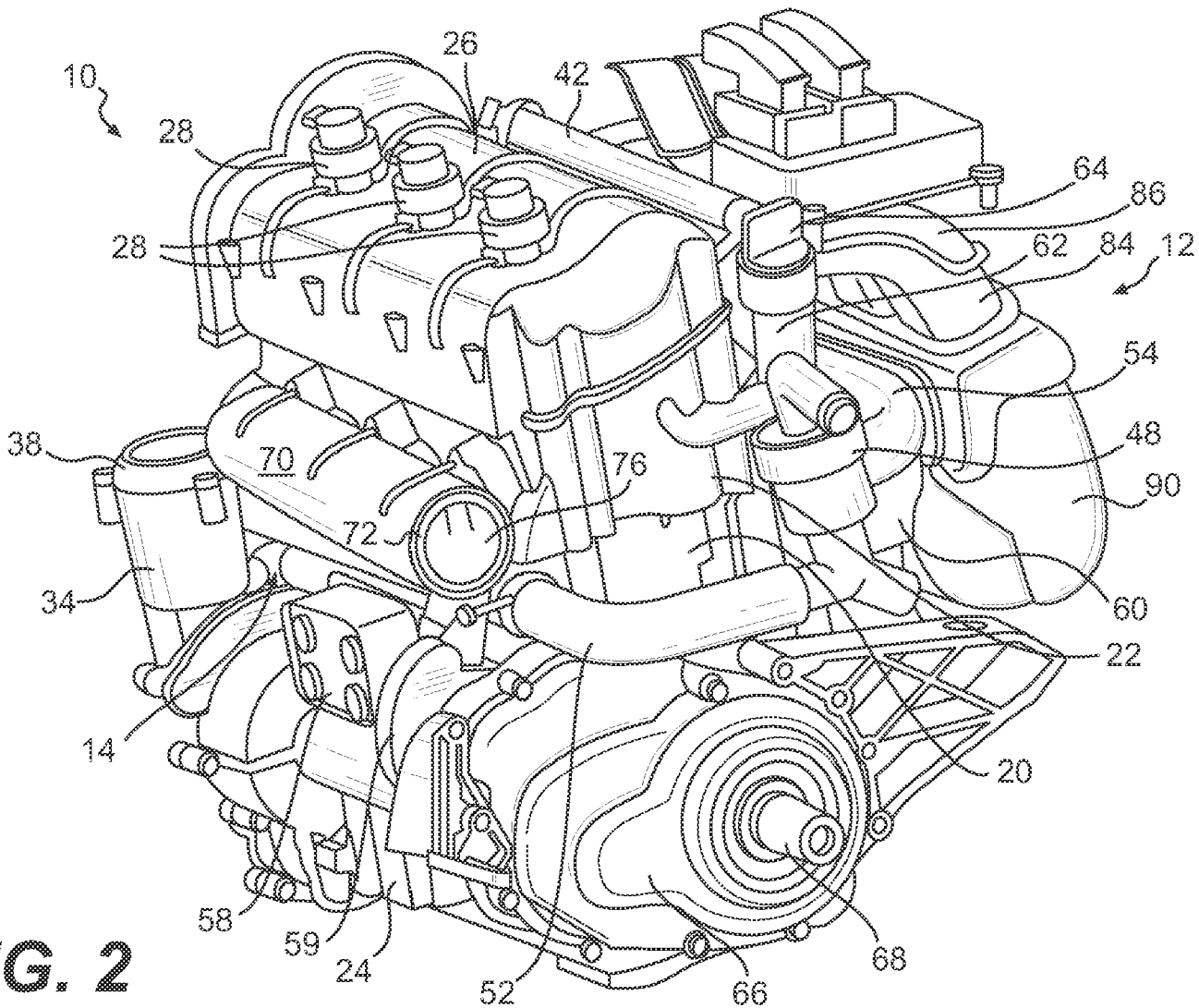
FIG. 2 is a perspective view, from a second end, exhaust side, of the engine of FIG. 1.
Figure 3:
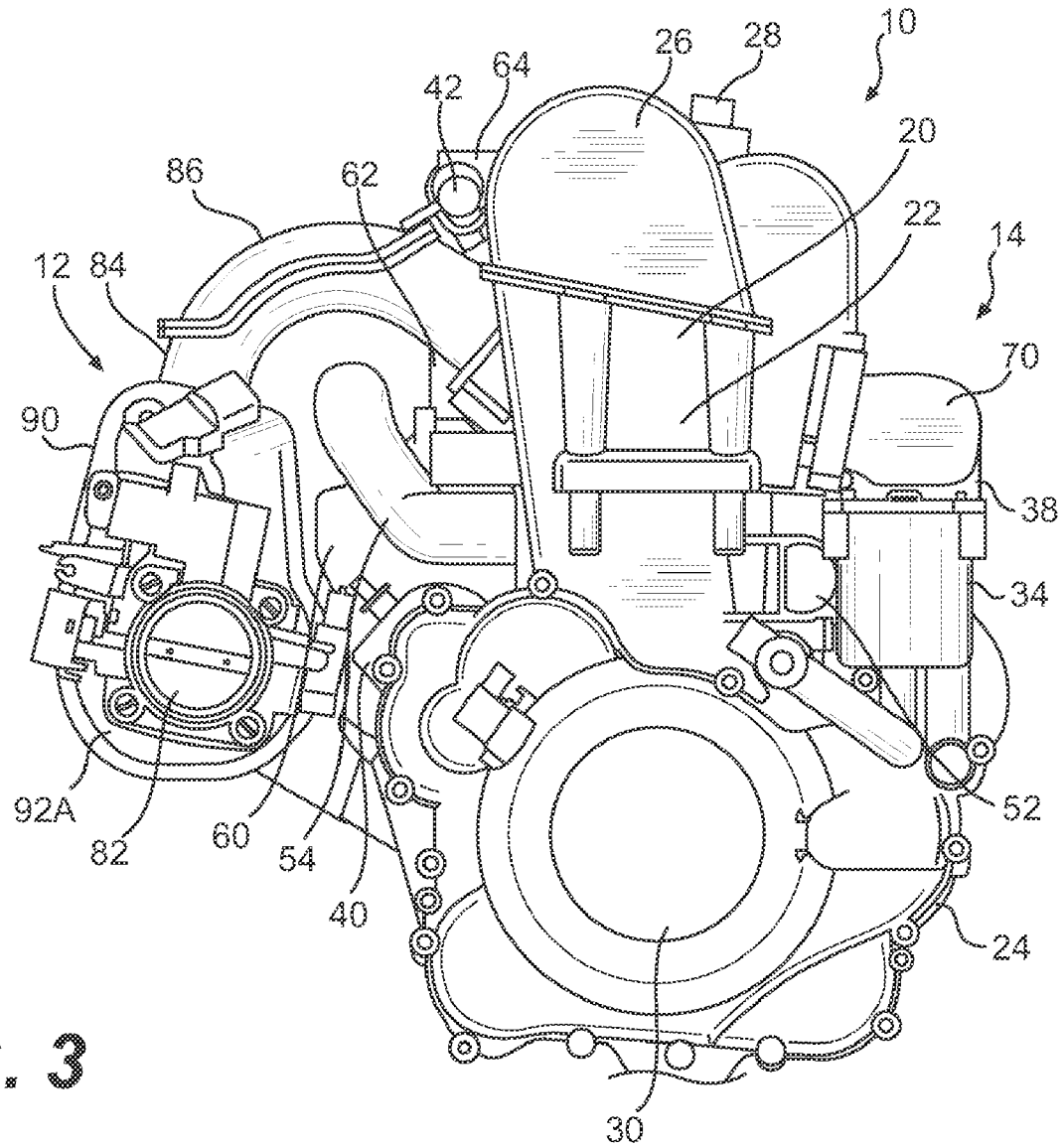
FIG. 3 is an elevation view of the first end of the engine of FIG. 1.
Figure 4:
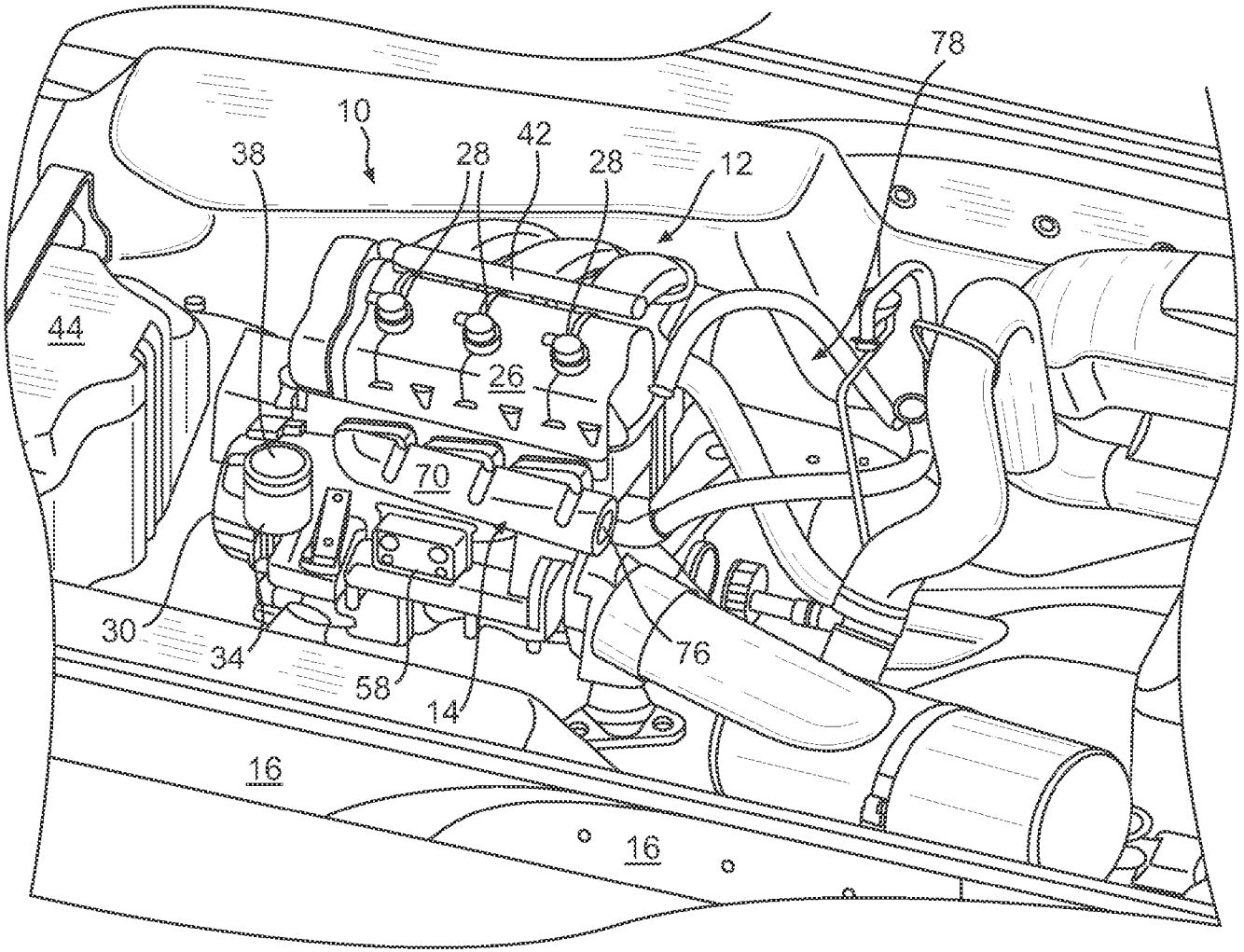
FIG. 4 illustrates the engine of FIG. 1 operatively disposed in the hull of a personal watercraft.
Figure 5:
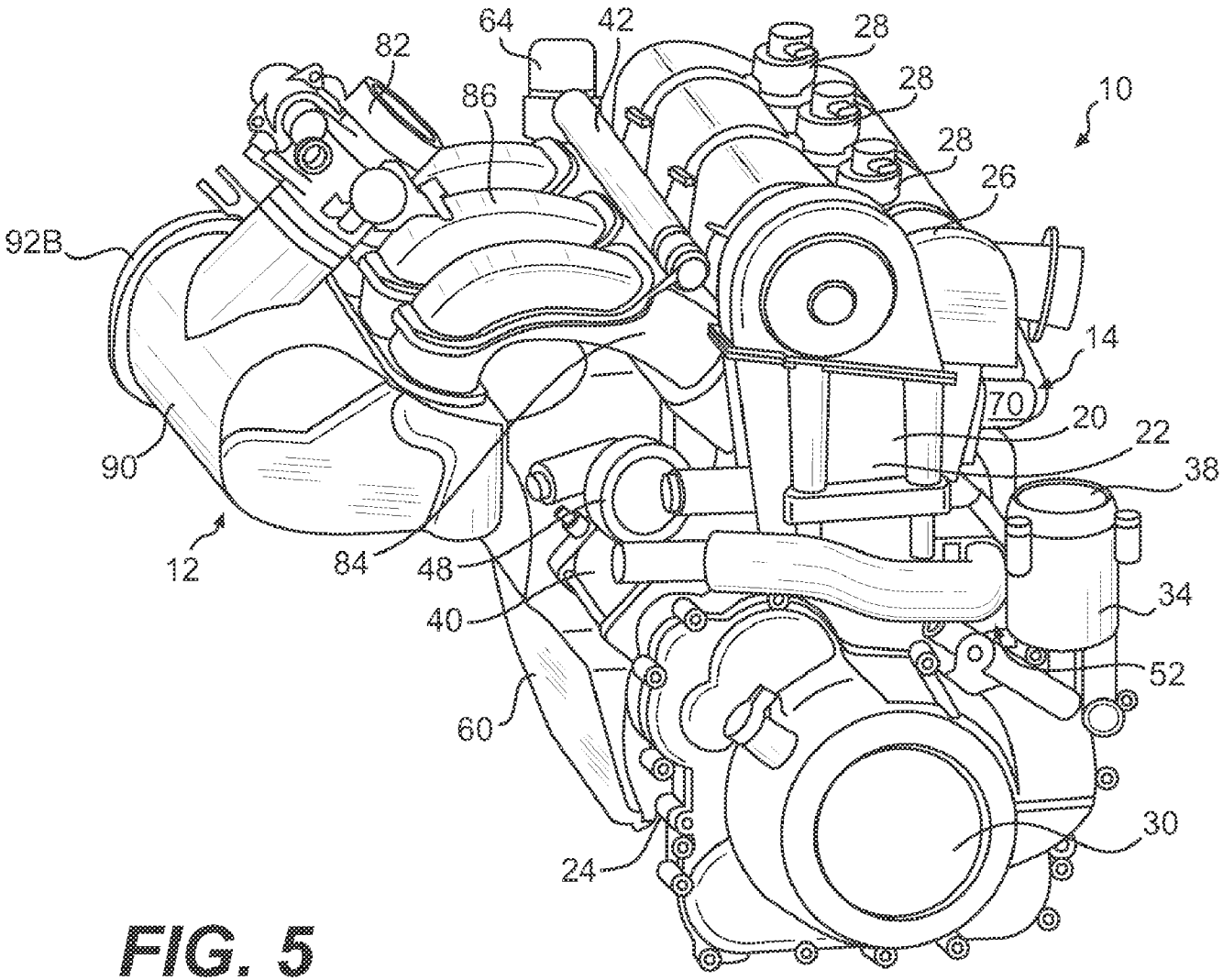
FIG. 5 is a perspective view, from a first end, air intake side, of a second embodiment of the internal combustion engine.
Figure 6:
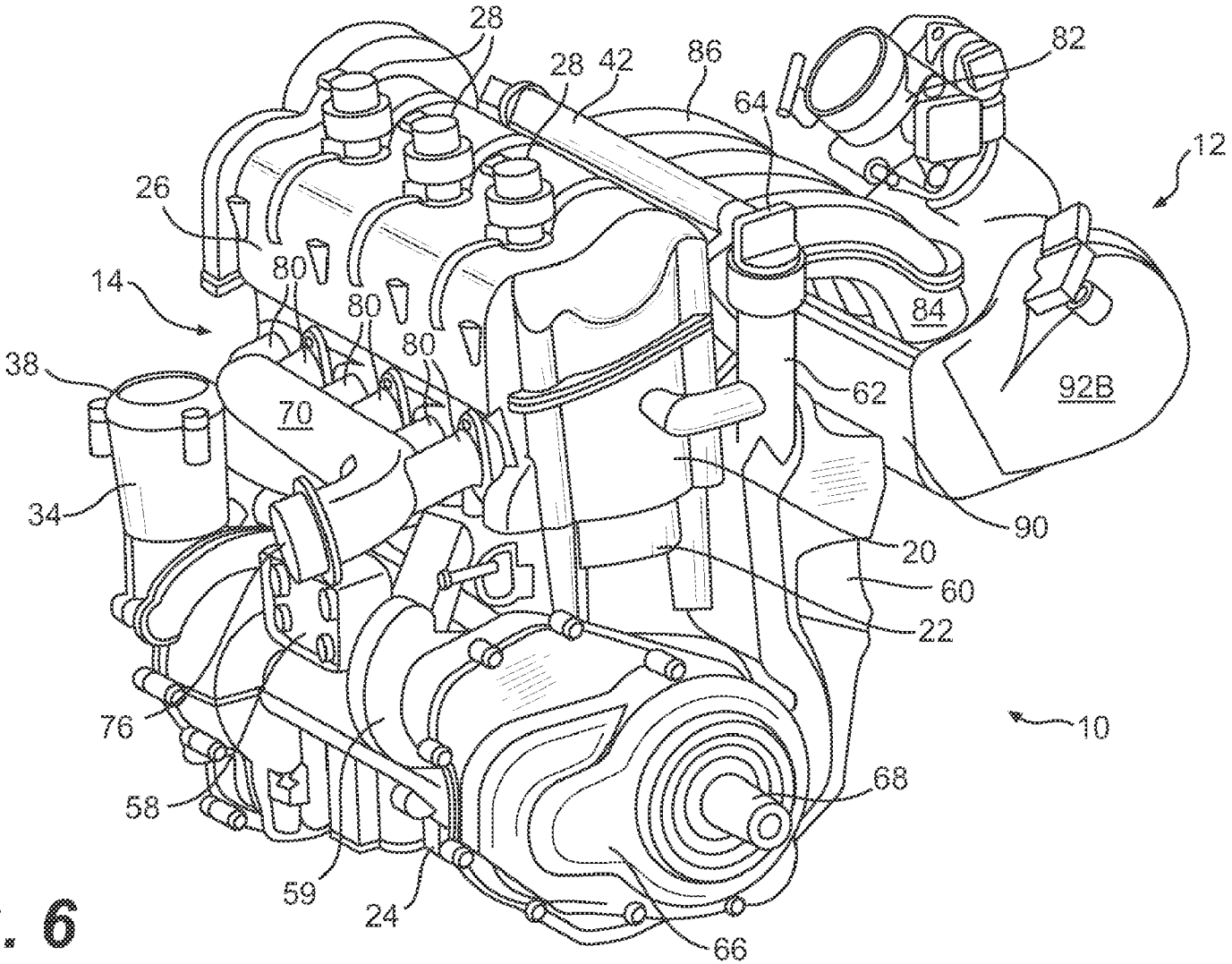
FIG. 6 is a perspective view, from a second end, exhaust side, of the engine of FIG. 5.
Figure 7:
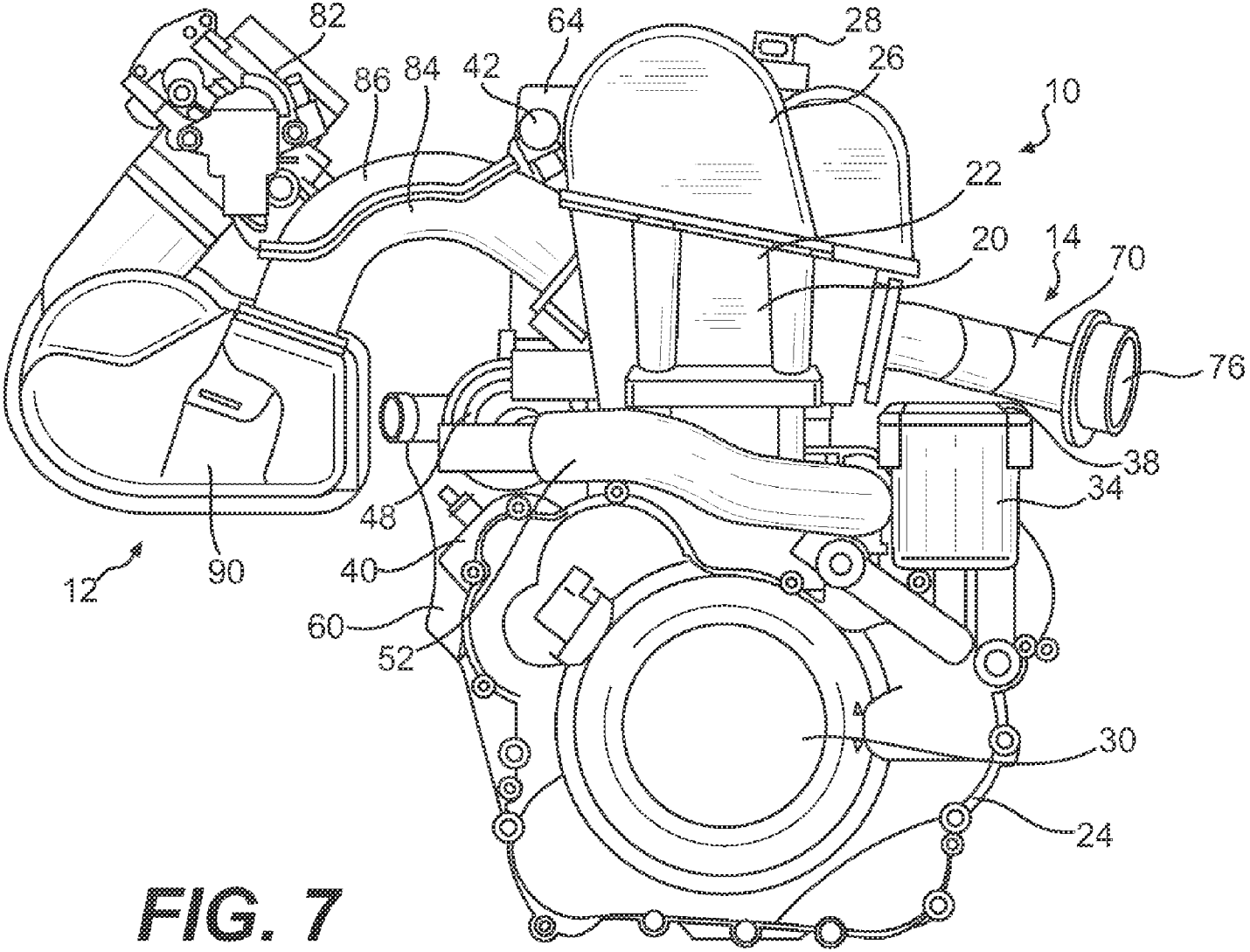
FIG. 7 is an elevation view of the first end of the engine of FIG. 5.
Figure 8:
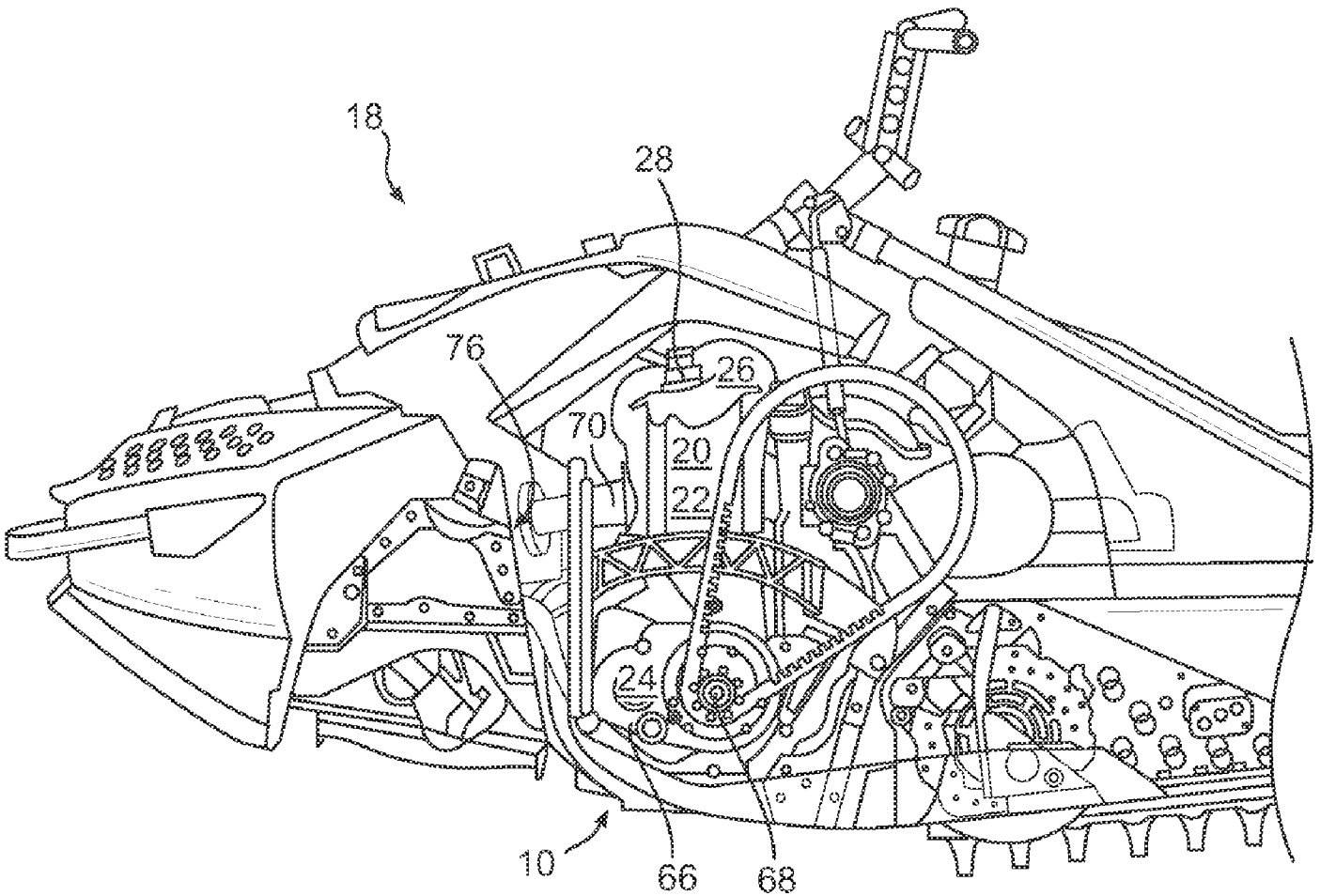
FIG. 8 illustrates the engine of FIG. 5 operatively disposed in the chassis of a snowmobile.

As best seen in FIGS. 2 and 6, an oil cooler 58 is connected to an exhaust side of the engine 10 below the exhaust components 14. A coolant pump 59 is disposed beside the oil cooler 58. An oil tank 60 is connected to the engine 10 on an intake side of the engine 10 below the air intake components 12. The oil tank 60 is shaped such that it follows the contour of the cylinder block 22 and the crankcase 24. An oil filler neck 62, through which oil is poured to fill the oil tank 60, extends upwardly from the oil tank 60 in order to be easily accessible from above the engine 10. An oil cap 64 is used to selectively close the upper opening of the oil filler neck 62. A dipstick (not shown) extends from the oil cap 64 and can be used to determine the level of oil in the oil tank 60. A power take-off (PTO) cover 66 is connected to the end of the crankcase 24 and cover various components of the engine 10 as described in greater detail below. An output shaft 68 of the engine 10 extends from the crankcase 24 and through the PTO cover 66. The output shaft 68 is used to transmit the power generated by the engine 10 to the propulsion unit of the vehicle in which the engine 10 is used.

As previously mentioned, different exhaust components 14 can be used to accommodate the particular application of the engine 10. As seen if FIGS. 1 to 4, for a personal watercraft 16, the exhaust components 14 consist of an exhaust manifold 70, having a cooling jacket 72, which collects the exhaust gases from the exhaust passages 74 (FIG. 19) of the engine 10. The exhaust manifold 70 is generally parallel to the crankshaft 50. The outlet 76 of the exhaust manifold 70 is oriented such that, when the engine 10 is installed in the watercraft 16, it point towards the back of the personal watercraft 16 where the remainder of the exhaust system 78 is located. As seen if FIGS. 5 to 8, for a snowmobile 18, the exhaust components 14 consist of an exhaust manifold 70 having a plurality of pipes 80 which collects the exhaust gases from the exhaust passages 74 of the engine 10. The exhaust manifold 70 is generally parallel to the crankshaft 50, but is bent prior to it outlet 76 such that the outlet 76 points in a direction generally perpendicular to the crankshaft 50. The outlet 76 of the exhaust manifold 70 is oriented such that, when the engine 10 is installed in the snowmobile 18, it point towards the front of the snowmobile 18 where the remainder of the exhaust system (not shown) is located.

Figure 9:
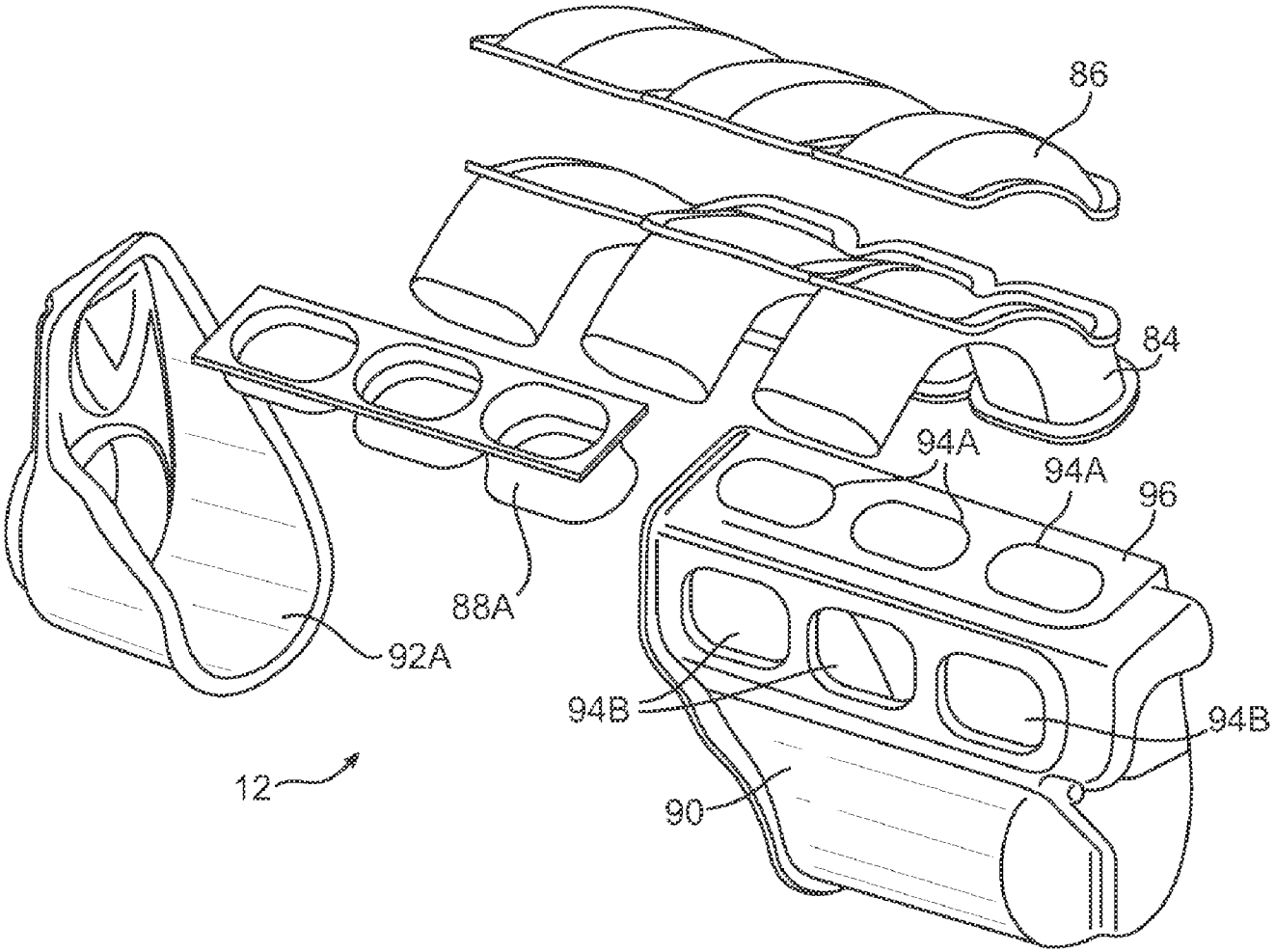
FIG. 9 is an exploded view of air intake components of the first embodiment of the engine.

As previously mentioned, different air intake components 12 can be used to accommodate the particular application of the engine 10. As seen in FIGS. 1 to 4, and particularly FIGS. 9 and 10, for a personal watercraft 16, the air intake components 12 consist of a throttle body 82, swing pipes 84, a swing pipe cover 86, a swing pipe extension 88A, an air intake manifold 90, and an air intake manifold cover 92A. As seen in FIG. 10, the swing pipes 84, swing pipe cover 86, and the swing pipe extension 88A are assembled together so as to form individual air conduits fluidly communicating with each intake passage 46 of the engine 10. The length of the swing pipe extensions 88A is selected based on the operational characteristics of the engine 10 so as to provide optimal performance and acoustic properties to the engine 10. The air intake manifold 90 has two sets 94A, 94B of three openings each and a cover 96 for covering one of the sets 94A, 94B. For a personal watercraft 16, set 94B is covered by the cover 96 (not as shown in FIG. 9). Once the air intake components 12 assembled, the swing pipe extensions 88A extend inside the air intake manifold 90 through the set 94A of openings. An air filter and a flame arrester (not shown) are disposed in the air intake manifold 90. The air intake manifold cover 92A closes the end of the air intake manifold 90 and provides the opening to which the throttle body 82, which regulates the flow of air to the engine 10, is connected. The throttle body 82 is generally parallel to the crankshaft 50 such that, when the engine 10 is installed in the watercraft 16, it point towards the front of the personal watercraft 16 where the remainder of the air intake system (not shown) is located.

Figure 11:
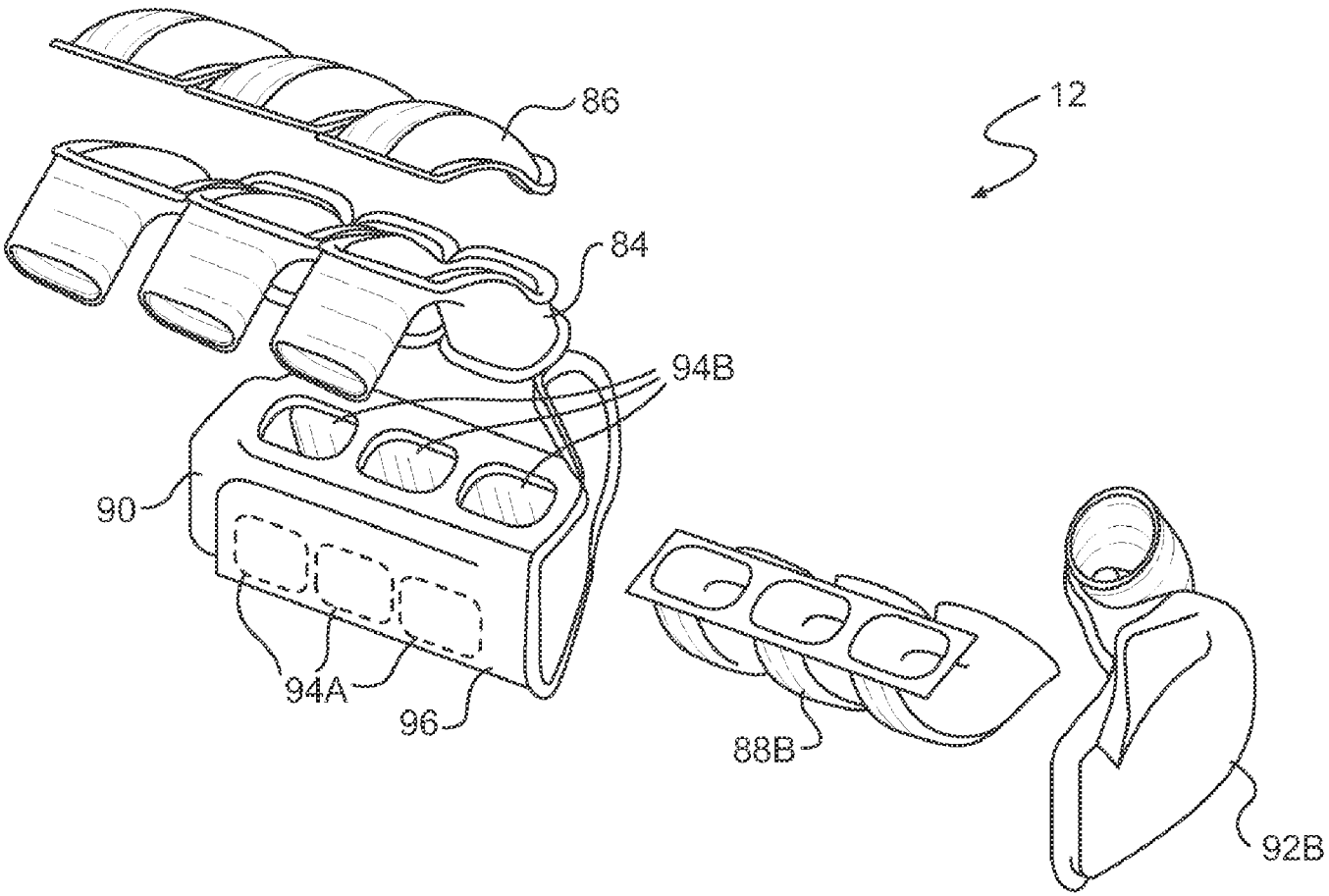
FIG. 11 is an exploded view of air intake components of the second embodiment of the engine.
Figure 12:
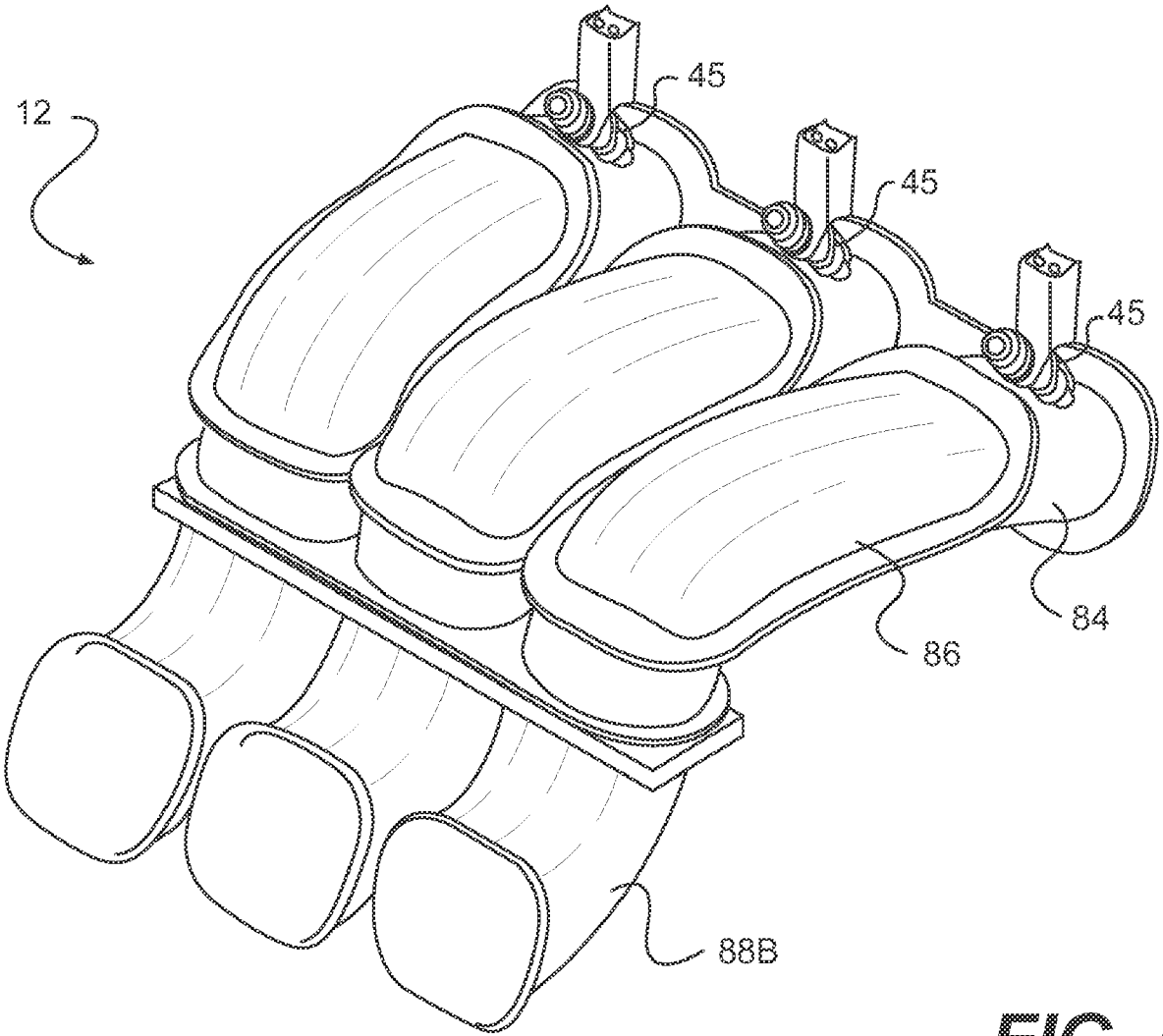
FIG. 12 is a perspective view of air intake components of the second embodiment of the engine.

As seen in FIGS. 5 to 8, and particularly FIGS. 11 and 12, for a snowmobile 18, the air intake components 12 consist of a throttle body 82, similar to the one described above, swing pipes 84, a swing pipe cover 86, a swing pipe extension 88B, an air intake manifold 90, and an air intake manifold cover 92B. The swing pipes 84, the swing pipe cover 86, and the air intake manifold 90 used for a snowmobile 18 are the same as those used for the personal watercraft 16. As seen in FIG. 12, the swing pipes 84, swing pipe cover 86, and the swing pipe extension 88B are assembled together so as to form individual air conduits fluidly communicating with each intake passage 46 of the engine 10. For the reasons described above, the swing pipe extension 88B is longer for a snowmobile 18 then the swing pipe extension 88A used for a watercraft 16. For a snowmobile 18, the set 94A of openings is covered by the cover 96 (as shown in FIG. 11). An air filter and a flame arrester (not shown) are disposed in the air intake manifold 90. The air intake manifold cover 92B closes the end of the air intake manifold 90 and provides the opening to which the throttle body 82 is connected. The air intake manifold cover 92B positions the throttle body 82 such that it is generally perpendicular to the crankshaft 50 and points upwardly. When the engine 10 is installed in the snowmobile 18, it point towards the front of the snowmobile 18 where the remainder of the air intake system (not shown) is located.

Turning now to FIGS. 13 to 25, internal components of the engine 10 will be described. A piston 98 is housed inside each cylinder 20 and reciprocates therein. For each cylinder 20, the walls of the cylinder 20, the cylinder head assembly 26 and the top of the piston 98 form a combustion chamber. The pistons 98 are linked to the crankshaft 50, which is housed in the crankcase 24, by connecting rods 100. Explosions caused by the combustion of an air/fuel mixture inside the combustion chambers make the pistons 98 reciprocate inside the cylinders 20 which causes the crankshaft 50 to rotate inside the crankcase 24.

Figure 14:
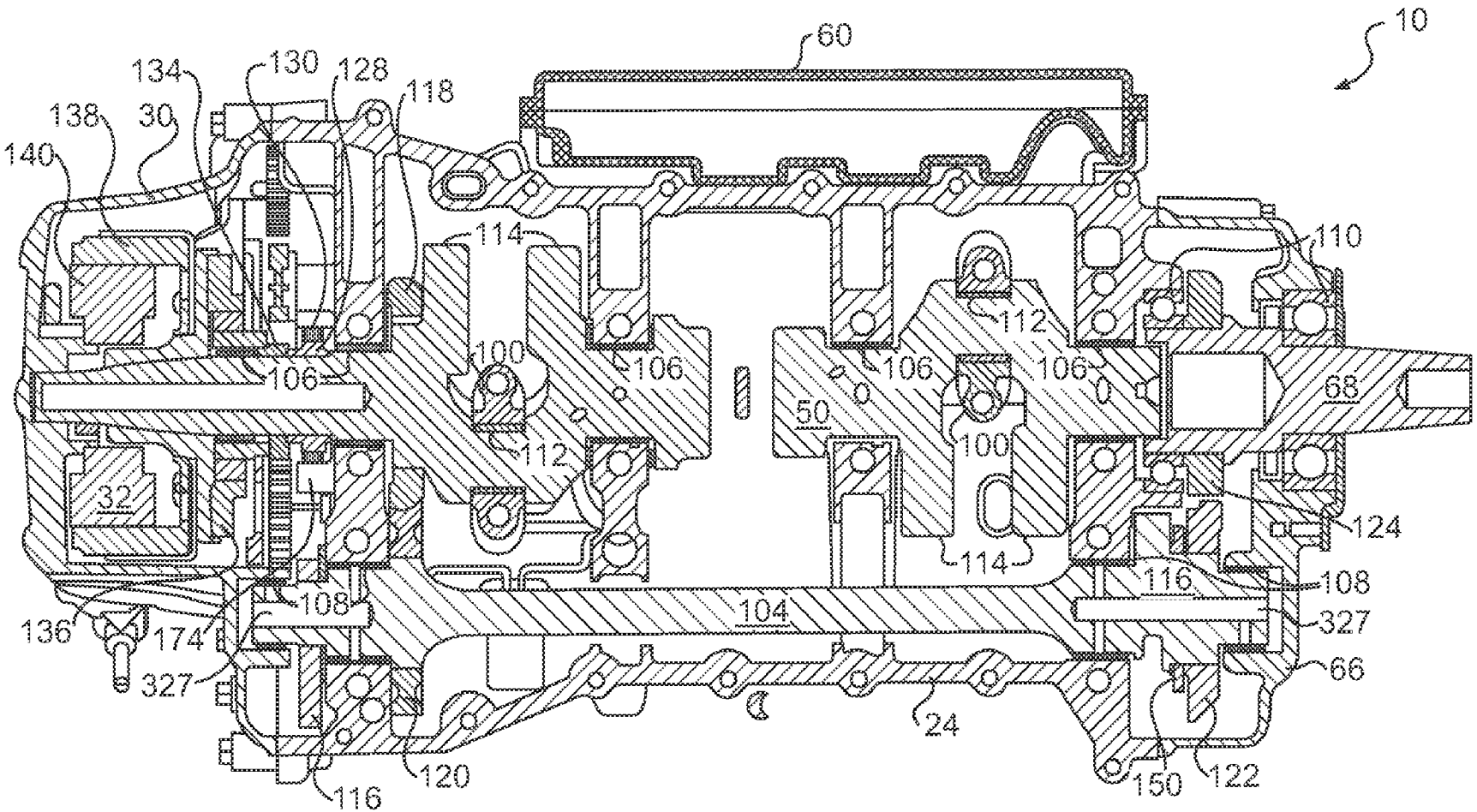
FIG. 14 is a horizontal cross-section, taken through the center of and parallel to the crankshaft, of the engine of FIG. 5.

As best seen in FIG. 18, the crankcase 24 is separated about a horizontal separating plane 102. The crankshaft 50, the counterbalance shafts 104, described in more detail below, and the output shaft 68 are all located along this plane 102. As shown in FIGS. 13 and 14, the crankshaft 50 is supported for rotation in the crankcase 24 by five plain bearings 106. Similarly, the counterbalance shaft 104, which is disposed next to and parallel with the crankshaft 50, is supported for rotation in the crankcase 24 by four plain bearings 108. The output shaft 68, which is disposed coaxially with the crankshaft 50, is supported for rotation in the crankcase 24 by two ball bearings 110. Ball bearings 110 are used for the output shaft 68 because they can handle the radial and thrust loads to which the output shaft 68 is subjected.

Figure 15A:
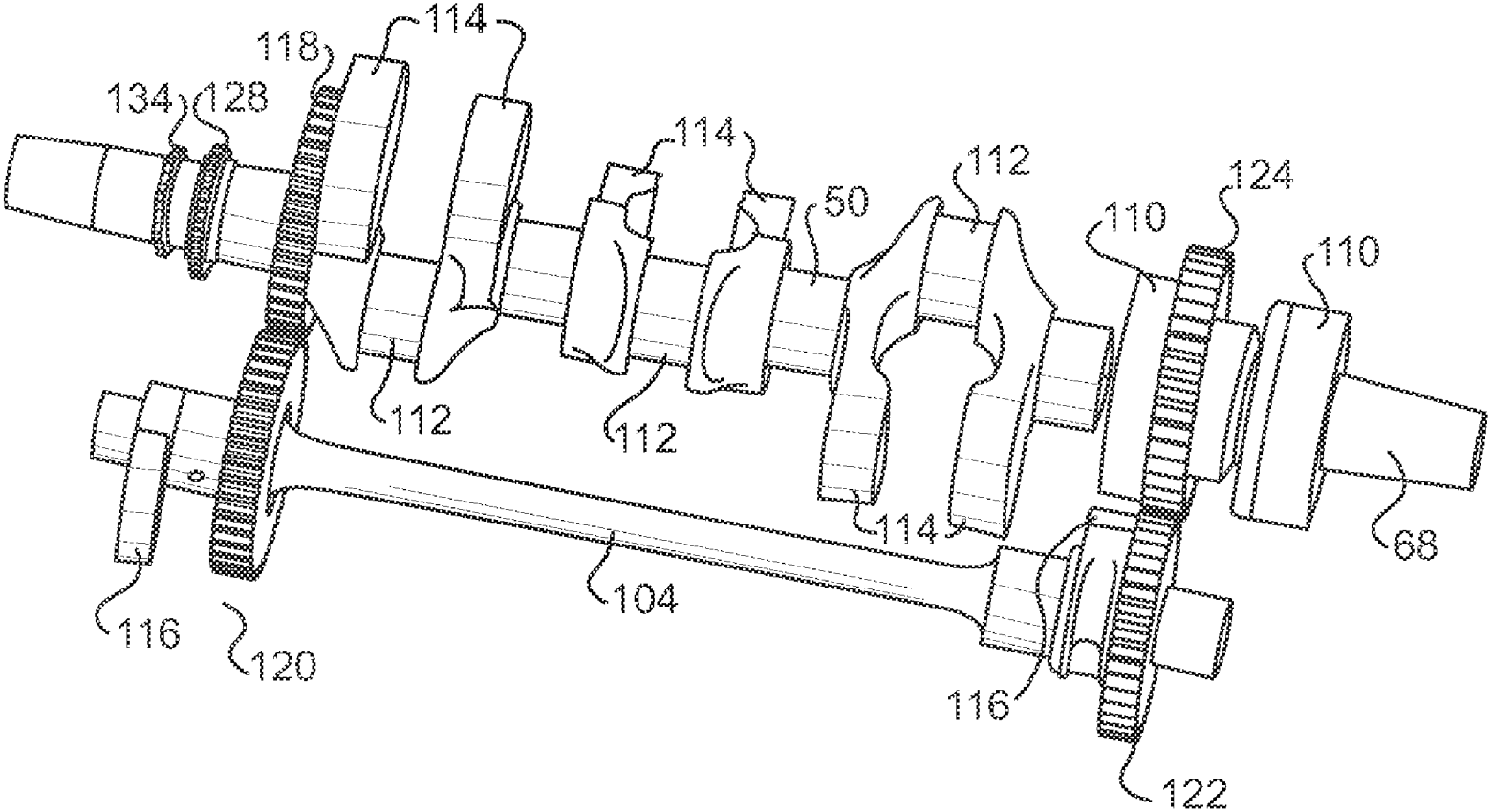
FIG. 15A is a perspective view of the drive assembly shown in FIG. 14.
Figure 15B:
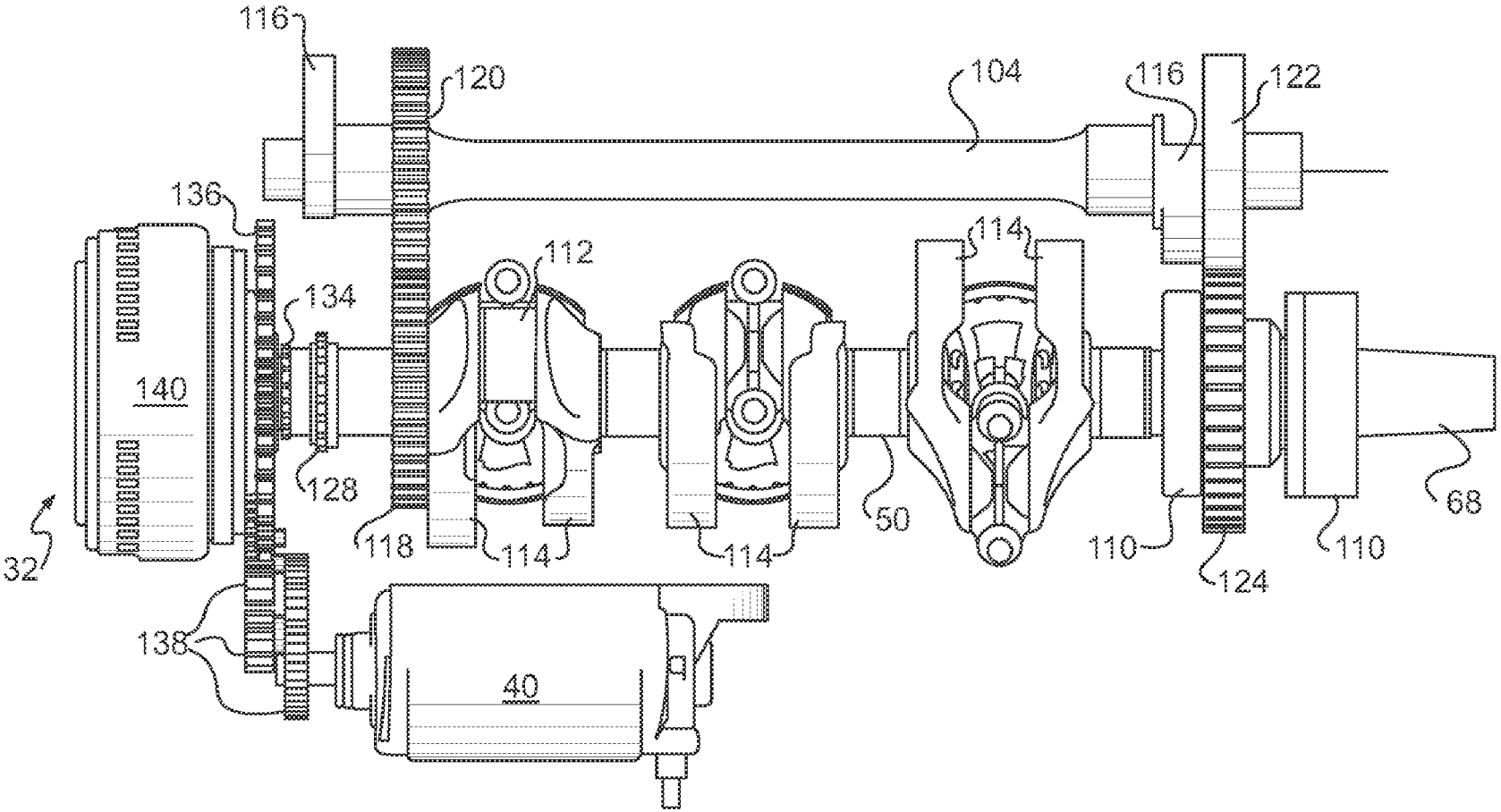
FIG. 15B is a bottom view of the drive assembly of FIG. 15A with the magneto and starter motor added.

As best seen in FIGS. 15A and 15B, the crankshaft 50 has three crankpins 112 onto which the connecting rods 100 are connected. Each crankpin 112 has a pair of corresponding counterbalance weights 114 opposite thereto to counteract the forces generated by the reciprocating pistons 98. The space between the counterbalance weights 114 of a pair of counterbalance weights 114 is selected such that the connecting rod 100 which is connected to the corresponding crankpin 112 can pass therebetween. The counterbalance shaft 104 has two counterbalance weights 116, one at each end thereof, to counteract the forces generated by the rotating crankshaft 50.

A crankshaft driving gear 118 is disposed adjacent the counterbalance weight 114 which is the furthest away from the output shaft 68. The crankshaft driving gear 118 engages a counterbalance shaft driven gear 120 disposed at a corresponding end of the counterbalance shaft 104. A counterbalance shaft driving gear 122 disposed at the opposite end of the counterbalance shaft 104 engages an output shaft gear 124 disposed on the output shaft 68. Therefore, the crankshaft 50 drives the counterbalance shaft 104 which drives the output shaft 68. The central portion of the counterbalance shaft 104 is designed such that it provides some torsional damping between the crankshaft 50 and the output shaft 68.

Figure 16:
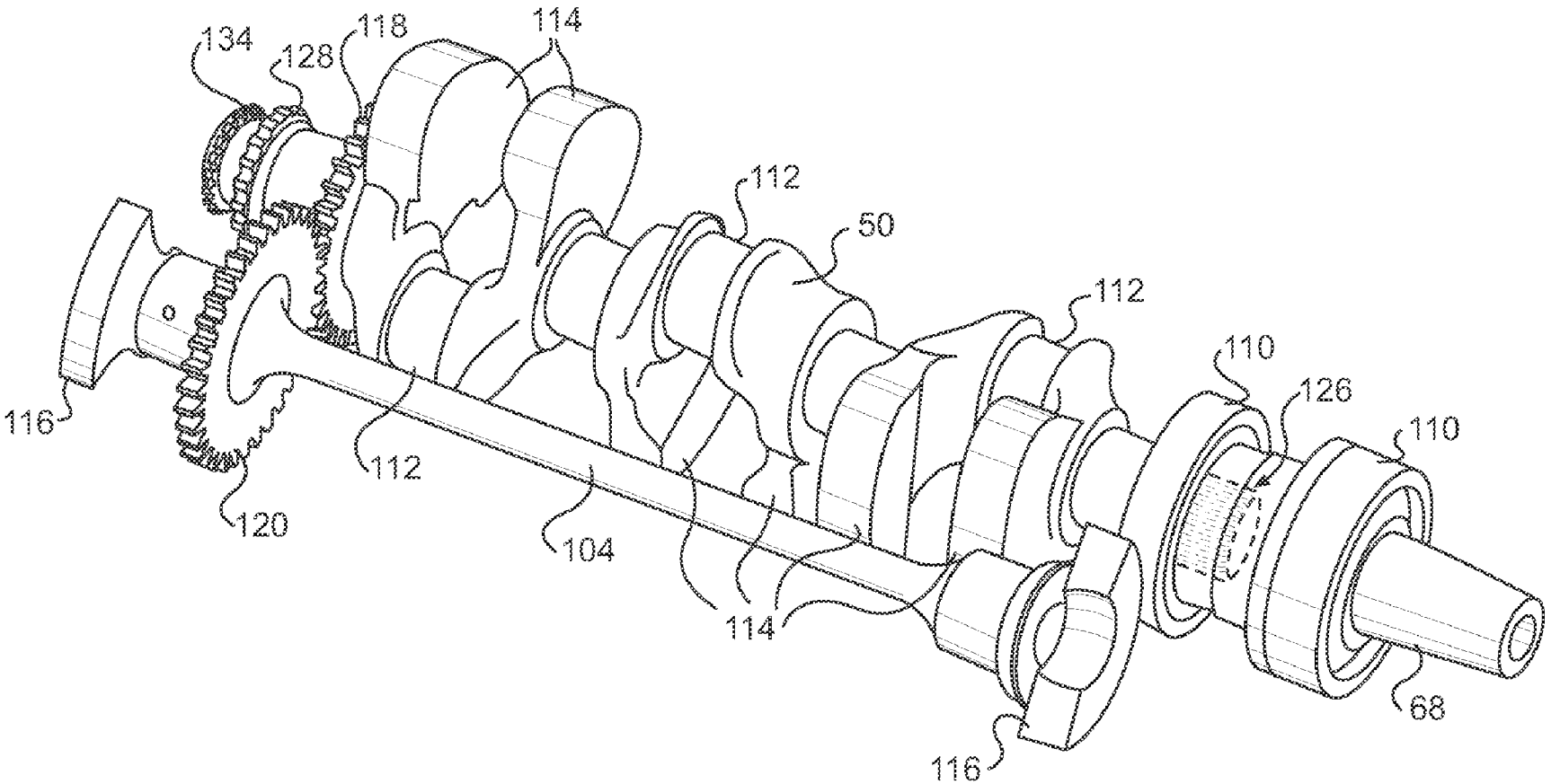
FIG. 16 is a perspective view of an alternative drive assembly.

FIG. 16 illustrates an alternative embodiment of the drive assembly shown in FIG. 15A. Elements shown in FIG. 16 which are similar to those shown in FIG. 15A have been labelled with the same reference numeral and will not be described again for simplicity. As in the previous embodiment, the crankshaft 50 drives the counterbalance shaft 104 via a crankshaft driving gear 118 which engages a counterbalance shaft driven gear 120. However, in the embodiment shown in FIG. 16, the output shaft 68 is driven directly by the crankshaft 50 via a spline coupling 126.

Figure 17:
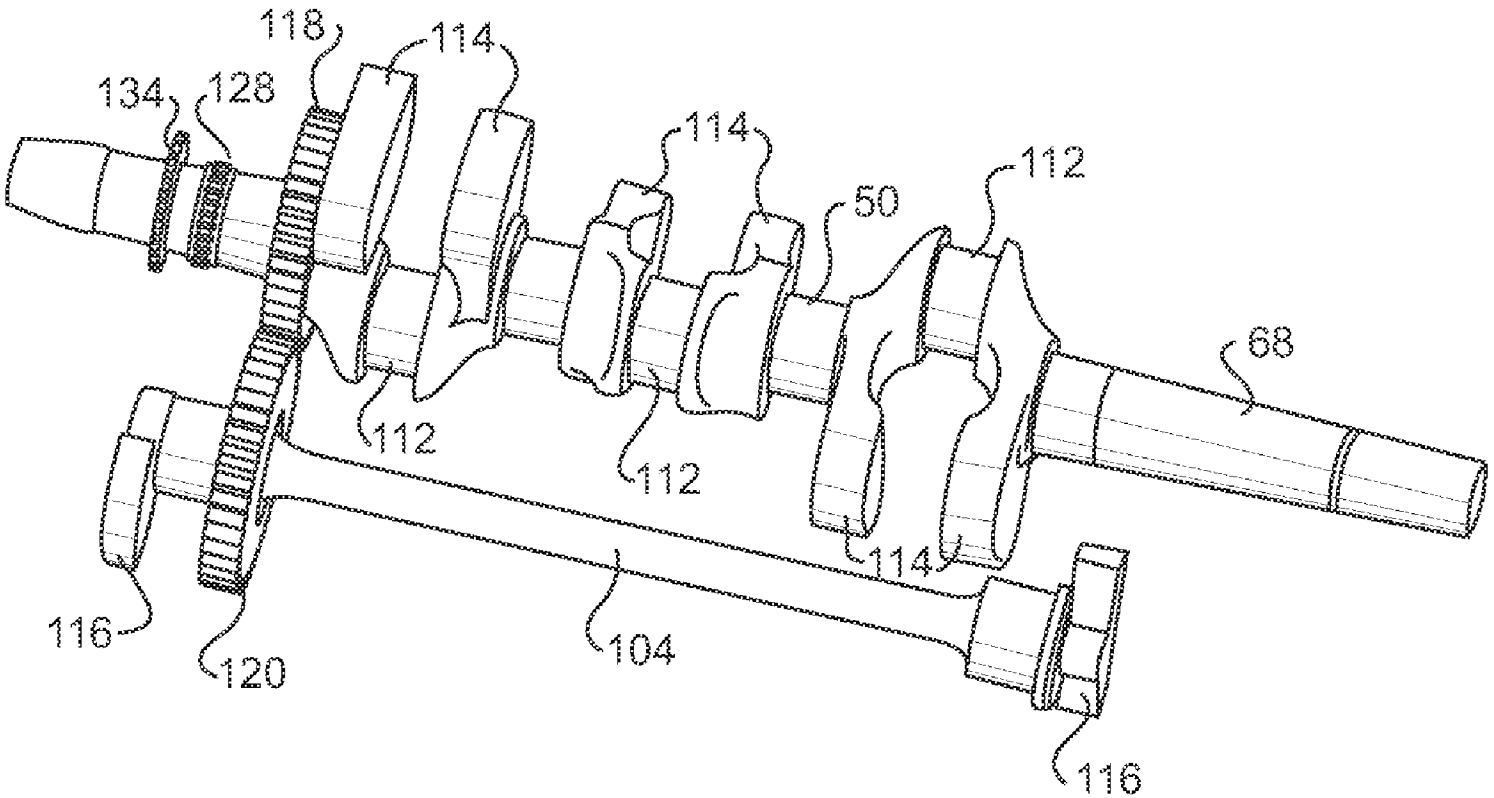
FIG. 17 is a perspective view of another alternative drive assembly.

FIG. 17 illustrates another alternative embodiment of the drive assembly shown in FIG. 15A. Elements shown in FIG. 17 which are similar to those shown in FIG. 15A have been labelled with the same reference numeral and will not be described again for simplicity. As in the previous embodiment, the crankshaft 50 drives the counterbalance shaft 104 via a crankshaft driving gear 118 which engages a counterbalance shaft driven gear 120. However, in the embodiment shown in FIG. 17, the output shaft 68 and the crankshaft 50 are a single shaft.

As seen in FIGS. 13 to 15B, a sprocket 128 is disposed on the crankshaft 50. The sprocket 128 engages the timing chain 130, as best seen in FIG. 18, so as to drive the first camshaft 132, as described in greater detail below with respect to the cylinder head assembly 26. A gear (or sprocket) 134 is disposed on the crankshaft 50 next to the sprocket 128. The gear 134 is used to drive the oil suction pump 144, the oil suction pump 146, and the oil pressure pump 148, as described in greater detail below with respect to the lubrication system.

A starter gear 136 is disposed on the crankshaft 50 next to the magneto 32. The starter gear 136 is operatively connected via intermediate gears 138 (FIG. 15B) to the starter motor 40. The intermediate gears 138 reduce the rotational speed, and thus increase the torque, being transmitted from the starter motor 40 to the crankshaft 50 which permits the starter motor 40 to initiate the rotation of the crankshaft 50 to allow for the initial ignition(s) to occur, which then allows the engine 10 to run.

The magneto 32 is disposed at the end of the crankshaft 50 which is the furthest away from the output shaft 68. The magneto 32 produces electrical power while the engine 10 is running to power some engine systems (for example the ignition and fuel injection systems) and vehicle systems (for example lights and display gauges). The magneto 32 is made of two parts: a rotor 140 and a stator 142. The stator 142 has a plurality of permanent magnets which generate a magnetic field. The stator is fixedly attached to the magneto cover 30. The rotor 140 is mounted to the starter gear 136 and therefore turns with the crankshaft 50. The rotor 140 has a plurality of wire coils thereon, which generate electrical current by moving in the magnetic field generated by the stator 142. The rotor 140 and the starter gear 136 together form the flywheel of the engine 10, which means that their combined rotating masses help maintain the angular momentum of the crankshaft 50 between each ignition. The magneto cover 30 is attached to the crankcase 24 and covers the magneto 32, the starter gear 136, intermediate gears 138, the gear 134 and its associated gears, and the sprocket 128.

Figure 25:
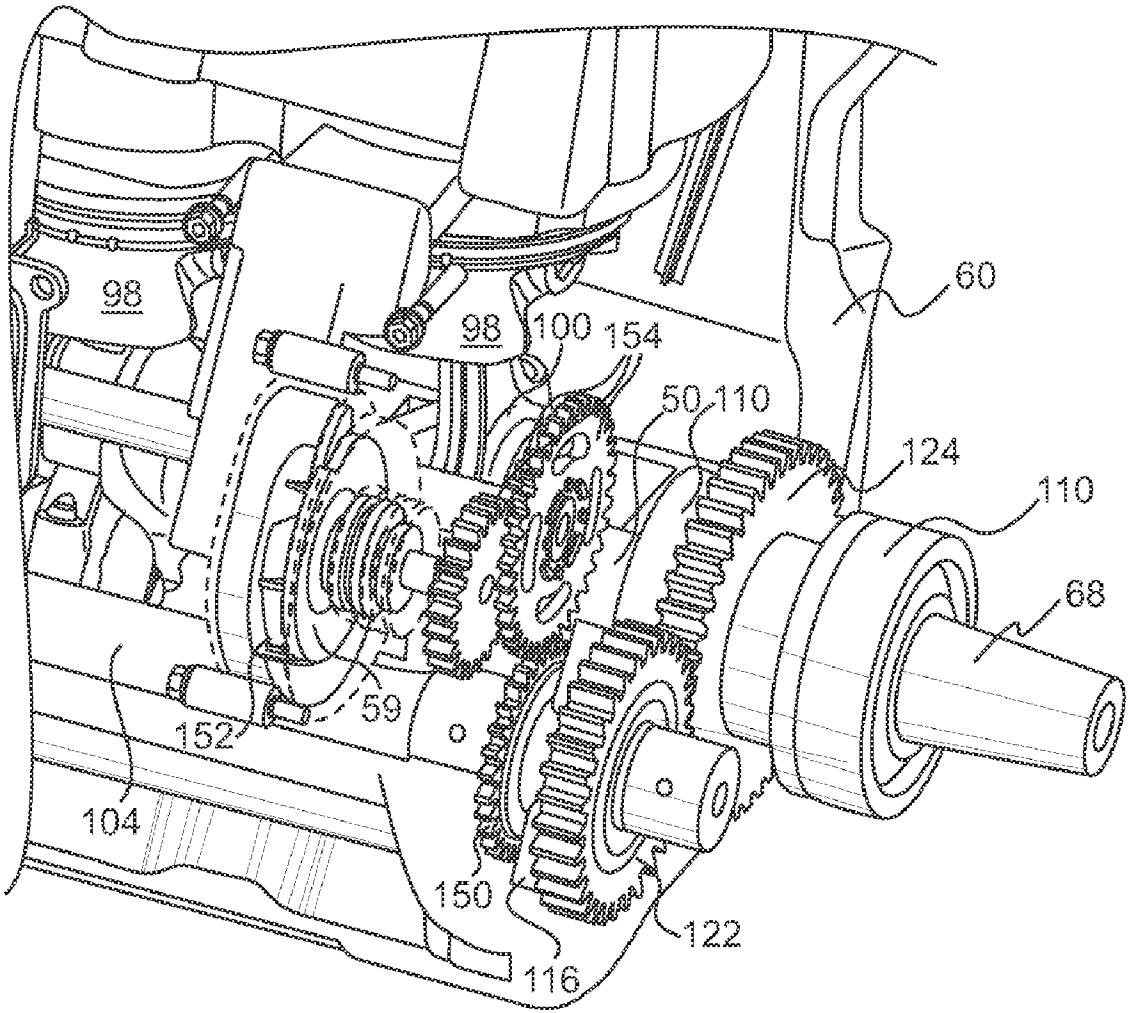
FIG. 25 is a close-up view of the end of the crankcase with the PTO cover removed.

As best seen in FIG. 25, the counterbalance shaft 104 also has a gear 150 disposed thereon. The gear 150 is disposed adjacent to the counterbalance weight 116 which is adjacent to the counterbalance shaft driving gear 122, such that the counterbalance weight 116 is between the counterbalance shaft driving gear 122 and the gear 150. As shown in FIG. 14, it is contemplated that the gear 150 could also be disposed between the counterbalance shaft driving gear 122 and the counterbalance weight 116. The gear 150 drives the impeller 152 of the coolant pump 59 via intermediate gears 154.

Turning now to FIGS. 18 to 24 details of the cylinder head assembly 26 will be described. The cylinder head assembly 26 has two camshafts 132, 156. The first camshaft 132 defines a first camshaft axis 133 which is generally horizontal and parallel to the crankshaft 50. The second camshaft 156 defines a second camshaft axis 157 which is generally horizontal and parallel to the first camshaft axis 133. A sprocket 158 disposed at one end of the first camshaft 132 engages the timing chain 130 such that the first camshaft 132 is driven by the sprocket 128 of the crankshaft 50, as previously mentioned. The dimensions of the sprockets 128 and 158 are selected such that for every two rotations of the crankshaft 50, the first camshaft 132 makes one rotation. A first camshaft gear 160, disposed next to the sprocket 158 on the first camshaft 132, engages a second camshaft gear 162, disposed at an end of the second camshaft 156. The first and second camshaft gears 160, 162 have the same dimensions and the same number of teeth such that the first and second camshafts 132, 156 rotate at same speed but in opposite directions. The first camshaft 132 also has a blow-by gas separator 163 (FIG. 13) disposed at the end thereof next to the sprocket 158, the details of which are discussed in greater detail below with respect to the lubrication system.

As best seen on FIG. 18, on one side of the sprockets 128 and 158, the timing chain 130 slides against a fixed slide rail 164. On the other side of the sprockets 128 and 158, the timing chain 130 slides against a pivoting slide rail 166. The pivoting slide rail 166 pivots about pivot 168 located near a bottom of the pivoting slide rail 166. A chain tensioner 170, which includes a spring 172, pushes on the pivoting slide rail 166 towards the timing chain 130 such that tension in the timing chain 130 is maintained. The timing chain 130, slide rails 164, 166, and the chain tensioner 170 are disposed (at least in part in the case of the timing chain 130) inside the timing chain case 174 located at the same end of the engine 10 as the magneto cover 30.

Figure 19:
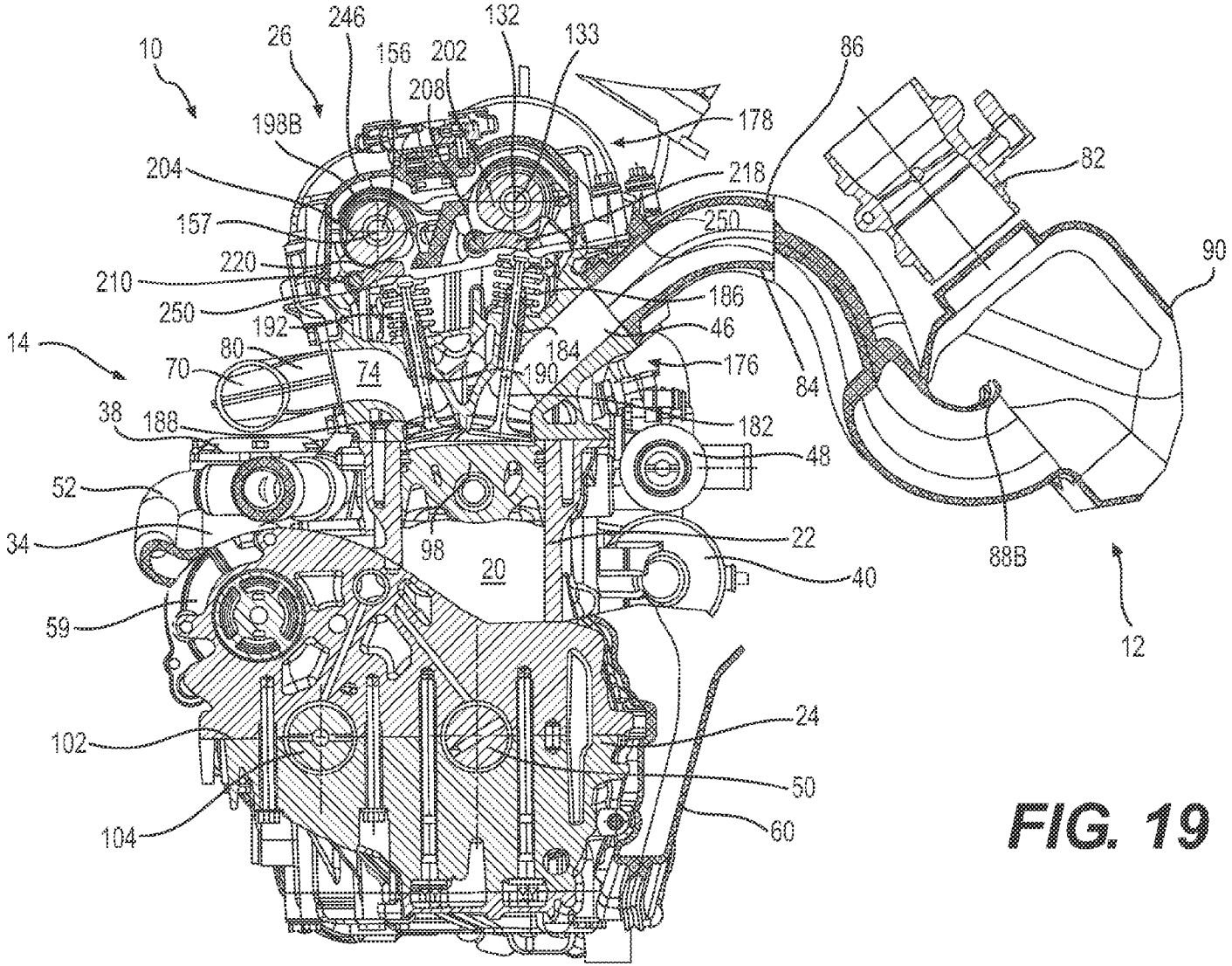
FIG. 19 is a vertical cross-section, taken through a cylinder perpendicularly to the crankshaft, of the engine of FIG. 5.
Figure 20:
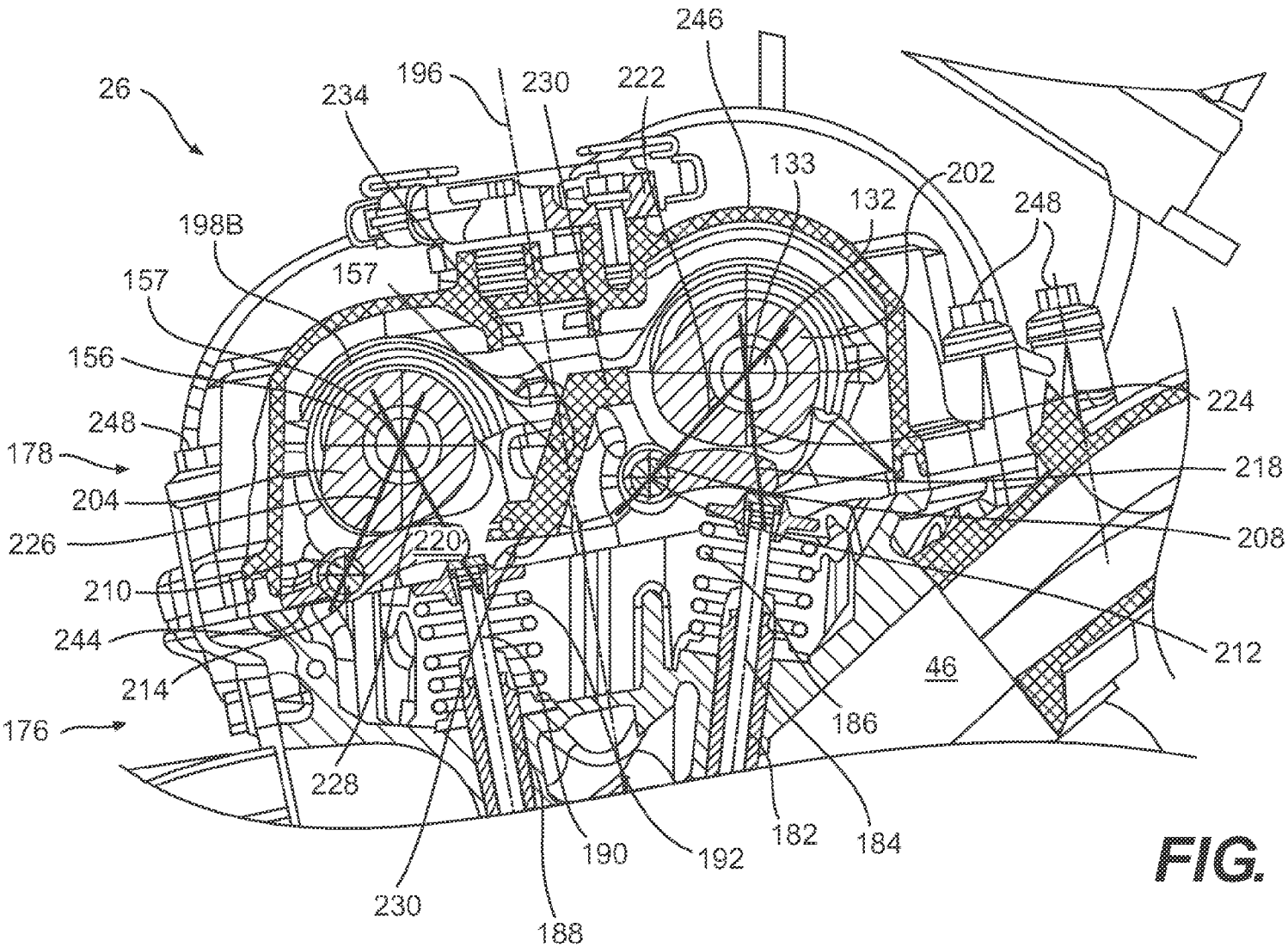
FIG. 20 is a close-up view of the cylinder head assembly area of FIG. 19.
Figure 21:
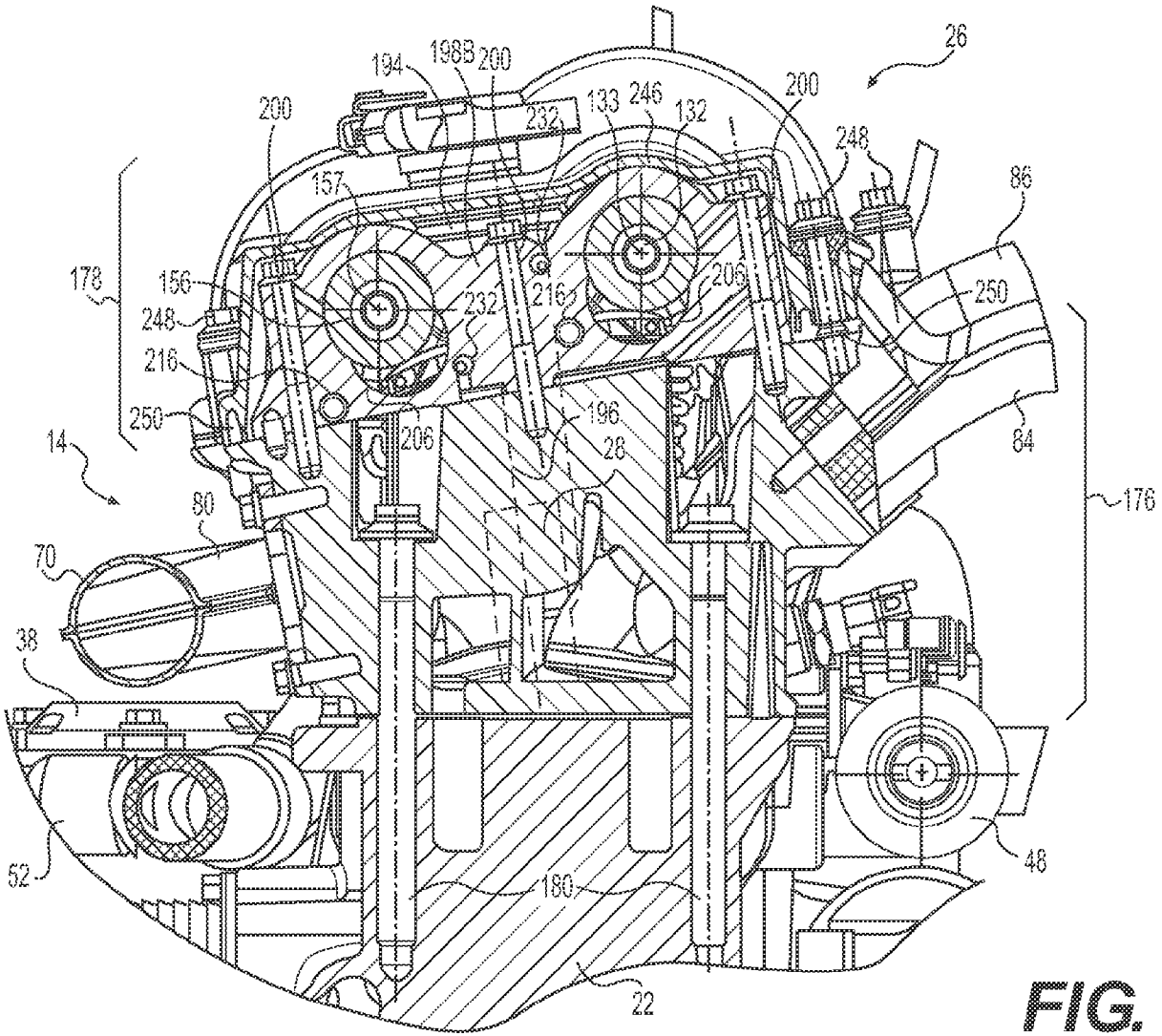
FIG. 21 is a vertical cross-section, taken through a camshaft support perpendicularly to the crankshaft, of the cylinder head assembly of the engine of FIG. 5.

As seen in FIGS. 19 to 21, the cylinder head assembly 26 is made of two main portions: the valve assembly portion 176 and the cam assembly portion 178. The valve assembly portion 176 is fastened to the upper end of the cylinder block 22 by bolts 180 (FIG. 21). The upper portion of the valve assembly portion 176 is slanted. The cam assembly portion 178 is disposed on the slanted portion of the valve assembly portion 176.

The intake passages 46 and the exhaust passages 74 are defined in the valve assembly portion 176. For each cylinder 20, the intake passage 46 consists of a single conduit, which fluidly communicates with its corresponding swing pipe 84, which then separates into two conduits which fluidly communicate with the combustion chamber of the cylinder 20. An intake valve 182 is disposed in each of the conduits of the intake passages 46 which fluidly communicate with the combustion chambers. Therefore, there are six intake valves 182 (two per cylinder 20). Each intake valve 182 defines an intake valve axis 184 which is generally normal to the first camshaft axis 133. Each intake valve 182 is used to selectively open and close its corresponding conduit of the intake passages 46. A spring 186 is disposed at an upper end of each intake valve 182 for biasing the intake valve 182 towards a position where it closes its corresponding conduit.

Similarly, for each cylinder 20, the exhaust passage 74 consists of a single conduit, which fluidly communicates with the exhaust manifold 70, which then separates into two conduits which fluidly communicate with the combustion chamber of the cylinder 20. An exhaust valve 188 is disposed in each of the conduits of the exhaust passages 74 which fluidly communicate with the combustion chambers. Therefore, there are six exhaust valves 188 (two per cylinder 20). Each exhaust valve 182 defines an exhaust valve axis 190 which is generally normal to the second camshaft axis 157. Each exhaust valve 188 is used to selectively open and close its corresponding conduit of the exhaust passages 74. A spring 192 is disposed at an upper end of each exhaust valve 188 for biasing the exhaust valve 188 towards a position where it closes its corresponding conduit.

Also located in the valve assembly portion 176 are the spark plugs 28. One spark plug 28 is provided for each cylinder 20. A tip of each spark plug 28 extends in its corresponding combustion chamber such that a spark created by the spark plug 28 can ignite the fuel/air mixture present in the combustion chamber. As seen in FIG. 21, each spark plug 28 can be inserted and removed from the valve assembly portion 176 through a spark plug holder 194 which extends to the upper portion of the cylinder head assembly 26 through the valve assembly portion 176 and the cam assembly portion 178. Each spark plug 28 is disposed longitudinally (i.e. along the length of the crankshaft 50) between its two corresponding intake valves 182 and laterally (i.e. in a horizontal direction perpendicular to the crankshaft 50) between the first and the second camshafts 132, 156. As is schematically illustrated in dotted lines in FIG. 21, each spark plug 28 defines a spark plug axis 196 which is generally normal to the first and second camshaft axes 133, 157.

Figure 22:
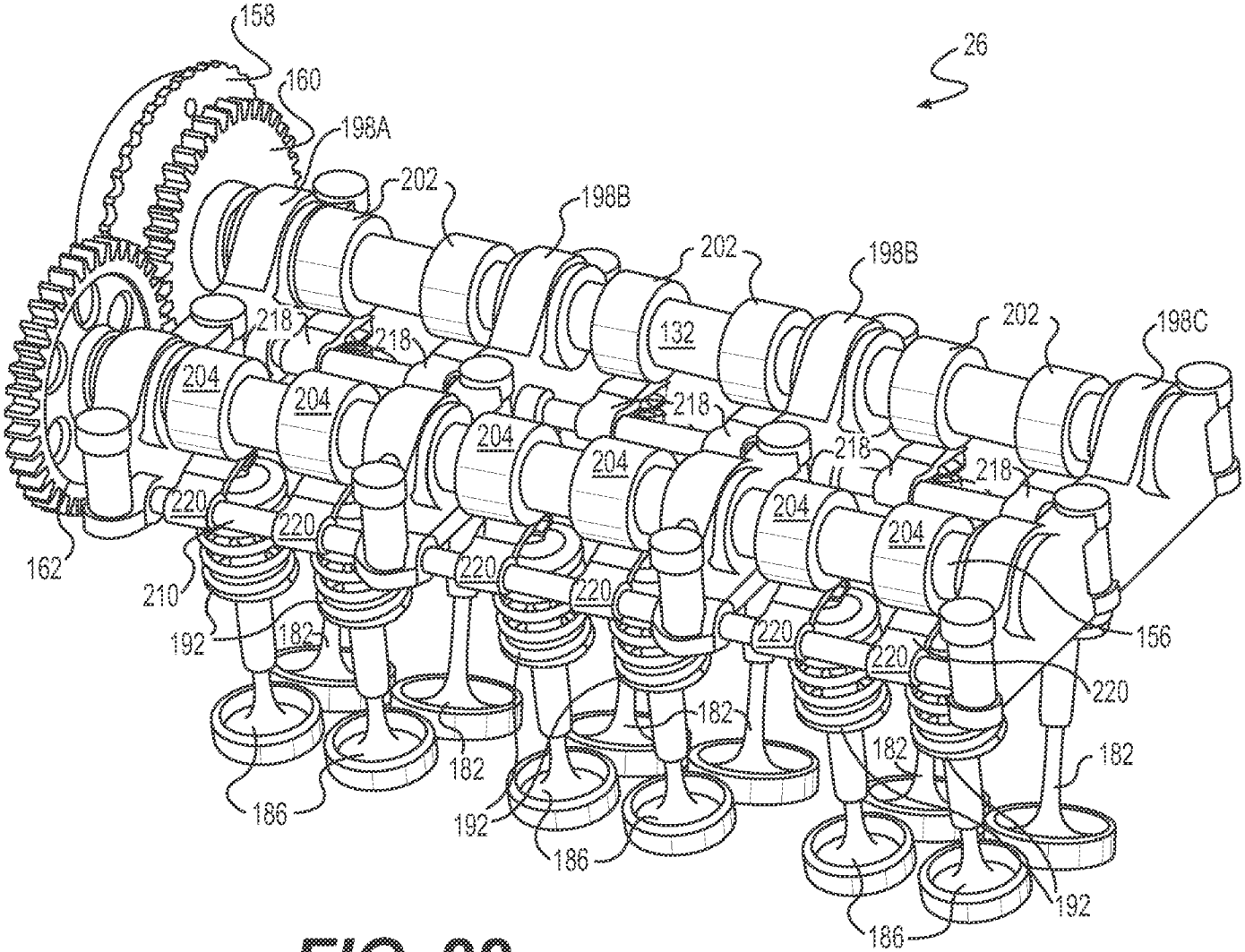
FIG. 22 is a perspective view of components of the cylinder head assembly of the engine of FIG. 5.

The cam assembly portion 178 contains the first and second camshafts 132, 156 which are journaled in four camshaft supports 198, as seen in FIG. 22. Each camshaft support 198 is preferably of a unitary construction (i.e. one piece). One camshaft support 198A, 198C is disposed near each end of the cylinder head assembly 26 and the other two camshaft supports 198B are disposed to either side of the central cylinder 20. The camshaft supports 198 are fastened to the valve assembly portion 176 by bolts 200, as seen in FIG. 21. Six cams 202 (one per intake valve 182) are disposed on the first camshaft 132 and rotate therewith. Similarly, six cams 204 (one per exhaust valve 188) are disposed on the second camshaft 156 and rotate therewith. The cams 202, 204 are preferably integrally formed with their respective camshafts 132, 156. To facilitate assembly of the cam assembly portion 178, the openings 206 in the camshaft supports 198B which receive the first and second camshafts 132, 156 are obround in shape with slightly concave sides. This permits first and second camshafts 132, 156 to be inserted through the camshaft supports 198B with their respective cams 202, 204 already disposed thereon. The openings 206 in the camshaft supports 198A and 198C are circular.

The cam assembly portion 178 also contains a first cam follower shaft 208 and a second cam follower shaft 210, which respectively define a first cam follower shaft axis 212 and a second cam follower shaft axis 214, as seen in FIG. 20. The first cam follower shaft axis 212 is generally parallel to the first camshaft axis 133. The second cam follower shaft axis 214 is generally parallel to the second camshaft axis 157. The first and second cam follower shafts 208, 210 are inserted in openings 216 (FIG. 21) in the camshaft supports 198 and are therefore supported by the camshaft supports 198. Six cam followers 218 (one per intake valve 182) have one end journaled on the first cam follower shaft 208 and the other end abutting the end of their corresponding intake valve 182. Six cam followers 220 (one per exhaust valve 188) have one end journaled on the second cam follower shaft 210 and the other end abutting the end of their corresponding exhaust valve 188.

During operation of the engine 10, the rotation of the first camshaft 132 causes the cams 202 to engage the cam followers 218 such that the cam followers 218 rotate about the first cam follower shaft 208 and move the intake valves 182 to an open position where the intake passages 46 fluidly communicate with the combustion chambers. With the continued rotation of the first camshaft 132, the cams 202 no longer press down on the cam followers 218 and the springs 186 move the intake valves 182 back to a closed position preventing fluid communication between the intake passages 46 and the combustion chambers. Similarly, the rotation of the second camshaft 156 causes the cams 204 to engage the cam followers 220 such that the cam followers 220 rotate about the second cam follower shaft 210 and move the exhaust valves 188 to an open position where the exhaust passages 74 fluidly communicate with the combustion chambers. With the continued rotation of the second camshaft 156, the cams 204 no longer press down on the cam followers 220 and the springs 192 move the exhaust valves 188 back to a closed position preventing fluid communication between the exhaust passages 74 and the combustion chambers.

As best seen in FIG. 20, the first cam follower shaft axis 212 is located laterally between the intake valve axis 184 and the spark plug axis 196. The first cam follower shaft axis 212 is also located laterally between the first camshaft axis 133 and the spark plug axis 196. The exhaust valve axis 190 is located laterally between the second cam follower shaft axis 214 and the spark plug axis 196. The second camshaft axis 157 is located laterally between the second cam follower shaft axis 214 and the spark plug axis 196. The first camshaft axis 133 is located laterally between the first cam follower shaft axis 212 and the intake valve axis 184. The second camshaft axis 157 is located laterally between the second cam follower axis 214 and the exhaust valve axis 190. The first camshaft axis 133 is located laterally between the first cam follower shaft axis 212 and the intake valve axis 184.

As also seen in FIG. 20, a first line 222 passing through a radial center of the first camshaft 132 and a radial center of the first cam follower shaft 208 has a positive slope. A second line 224 passing through the radial center of the first camshaft 132 and the end of the intake valve 182 has a negative slope. A third line 226 passing through a radial center of the second camshaft 156 and a radial center of the second cam follower shaft 210 has a positive slope. A fourth line 228 passing through the radial center of the second camshaft 156 and the end of the exhaust valve 188 has a negative slope.

Also disposed in the cam assembly portion 178 are oil supply lines 230. The oil supply lines 230 are disposed to either sides of the spark plug holder 194. Each oil supply line 230 extends from one camshaft support 198 to the following camshaft support 198. Each oil supply line 230 fluidly communicates with and is supported by openings 232 in the camshaft support 198. Also, each pair of oil supply lines 230 disposed between two camshaft supports 198 has two connecting members 234 which connects one oil supply line 230 to the other. The connecting members 234 are disposed to either sides of the spark plug holders 194. Details regarding the lubrication of the cylinder head assembly are provided further below.

Figure 23:
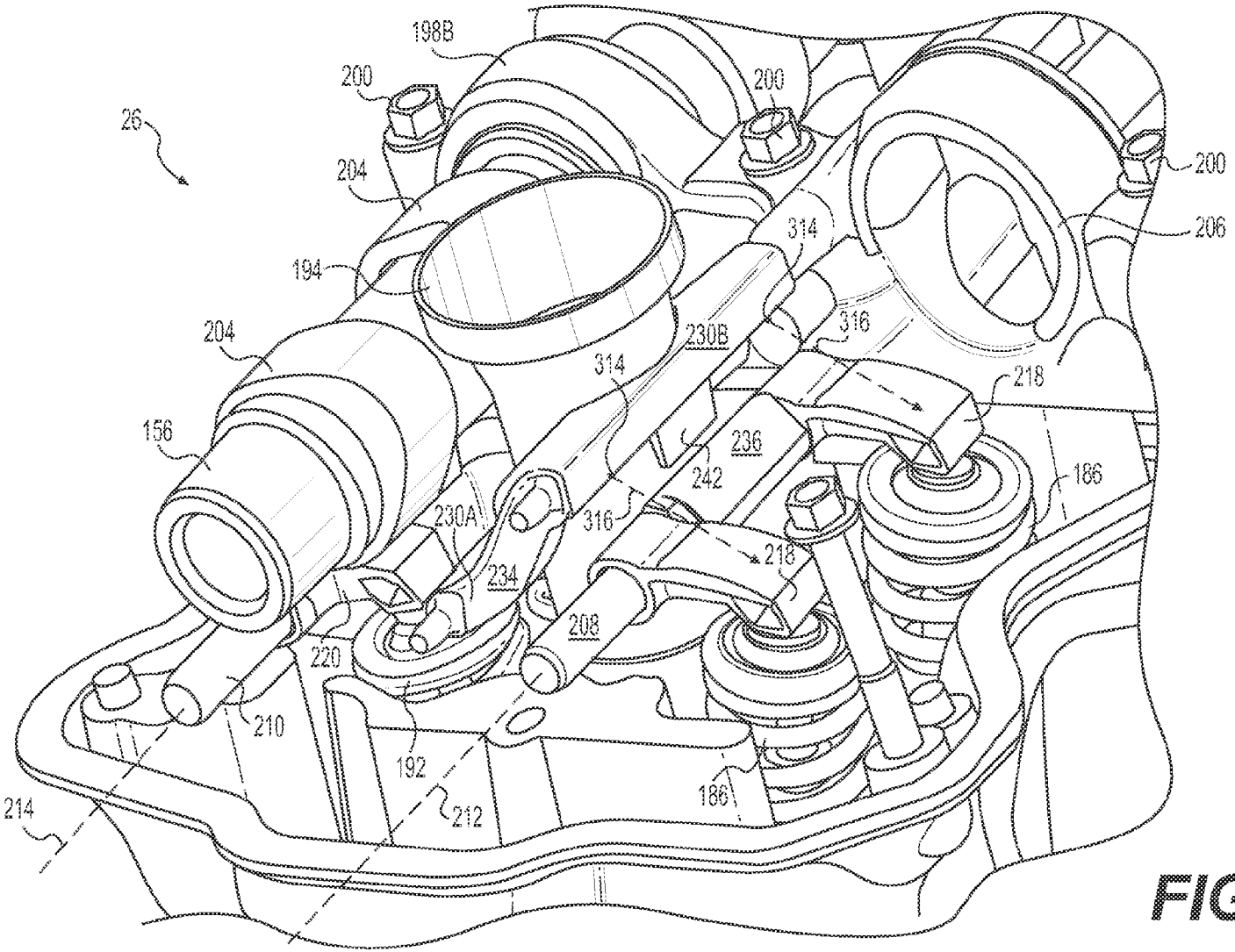
FIG. 23 is a close-up perspective view of components located at an end of the cylinder head assembly of the engine of FIG. 5.
Figure 24:
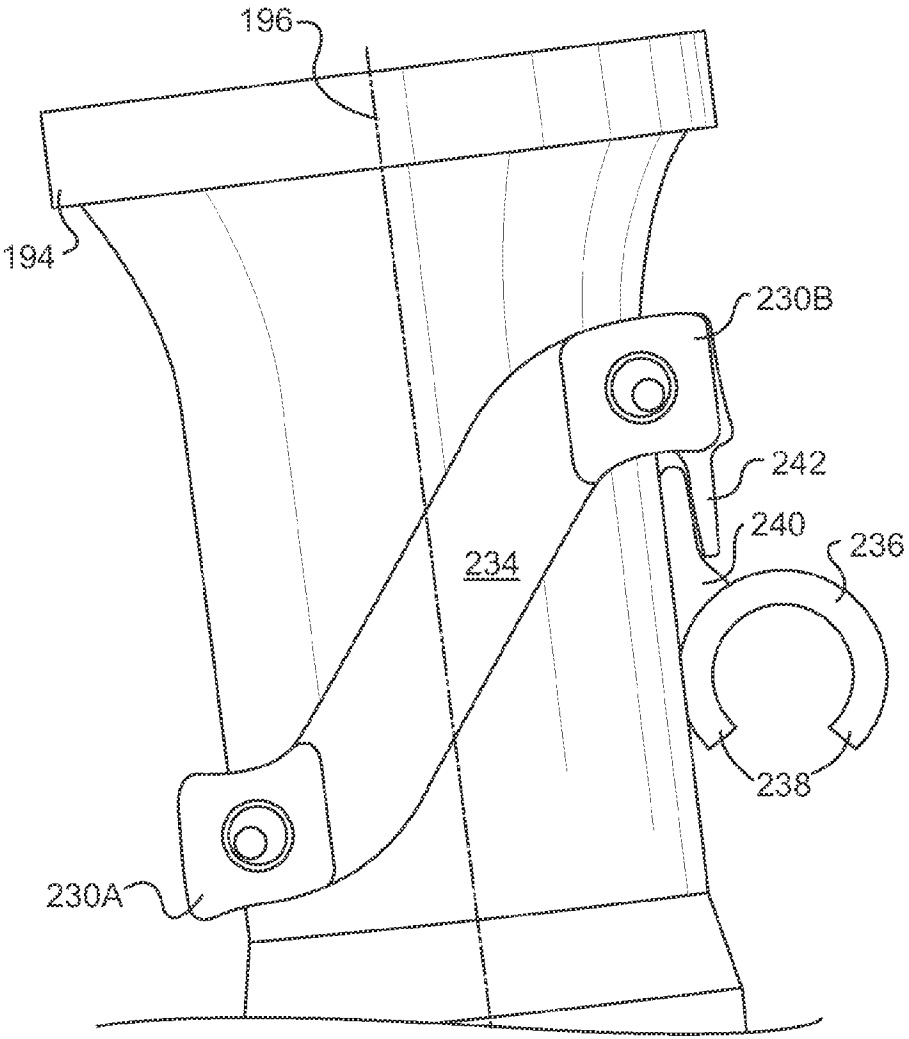
FIG. 24 is a close-up view of a spark plug holder, an oil supply line, and a cam follower spacer of the engine of FIG. 5.

As seen in FIGS. 23 and 24, spacers 236 are provided on the cam follower shafts 208, 210 between each pair of cam followers 218 or 220 to prevent them for sliding along their respective cam follower shafts 208, 210. Each spacer 236, which is preferably made of plastic, has a slot 238 along its length which permits it to be clipped to and unclipped from the cam follower shafts 208, 210. Looking specifically at a spacer 236 disposed on the first cam follower shaft 208, it can be seen that the length of the spacer 236 is selected such that each cam follower 218 is abutted against a camshaft support 198 on one side and against the spacer 236 on the other. The spacer 236 has a tab 240 extending therefrom. The spacer 236 is installed on the first cam follower shaft 208 such that the tab 240 is disposed between the spark plug holder 194 and a tab 242 extending downwardly from the oil supply line 230B, as seen in FIG. 24. This prevents the rotation of the spacer 236 about the cam follower shaft 208. Spacers 236 disposed on the second cam follower shaft 210 have a similar tab 244 (in dotted lines in FIG. 20), however the tab 244 is inserted in a notch between the cam assembly portion 178 and the valve assembly portion 176.

Using the spacers 236 facilitates access to the intake and exhaust valves 182, 188 for maintenance or replacement. To access the intake valves 182 of a particular cylinder 20 for example, the spacer 236 is first removed from between the two cam followers 218 by unclipping it from the cam follower shaft 208. The two cam followers 218 are then slid towards each other on the cam follower shaft 208 such that they no longer abut against the ends of the intake valves 182, thus providing access to the intake valves 182. The same method would be used to access the exhaust valves 188.

The components of the cam assembly portion 178 described above are covered by a cam assembly cover 246 which is fastened to the valve assembly portion 176 by bolts 248. A seal 250 (FIG. 21) is provided between the cam assembly cover 246 and the valve assembly portion to prevent gases and lubricant present in the cylinder head assembly 26 to escape therefrom.

Figure 27:
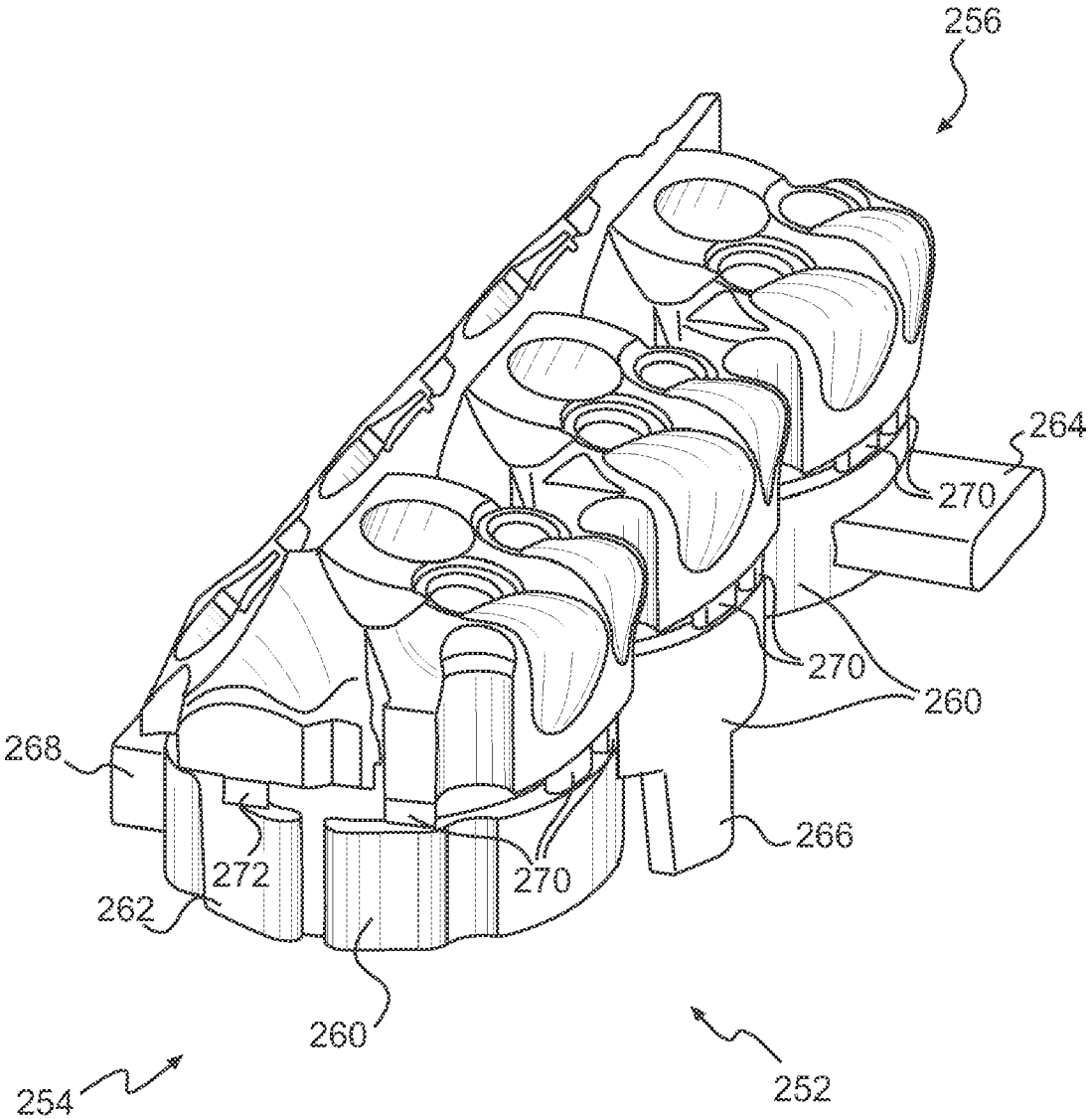
FIG. 27 is a perspective view of the cylinder block cooling jackets and the cylinder head cooling jacket of the cooling system of FIG. 26.
Figure 28:
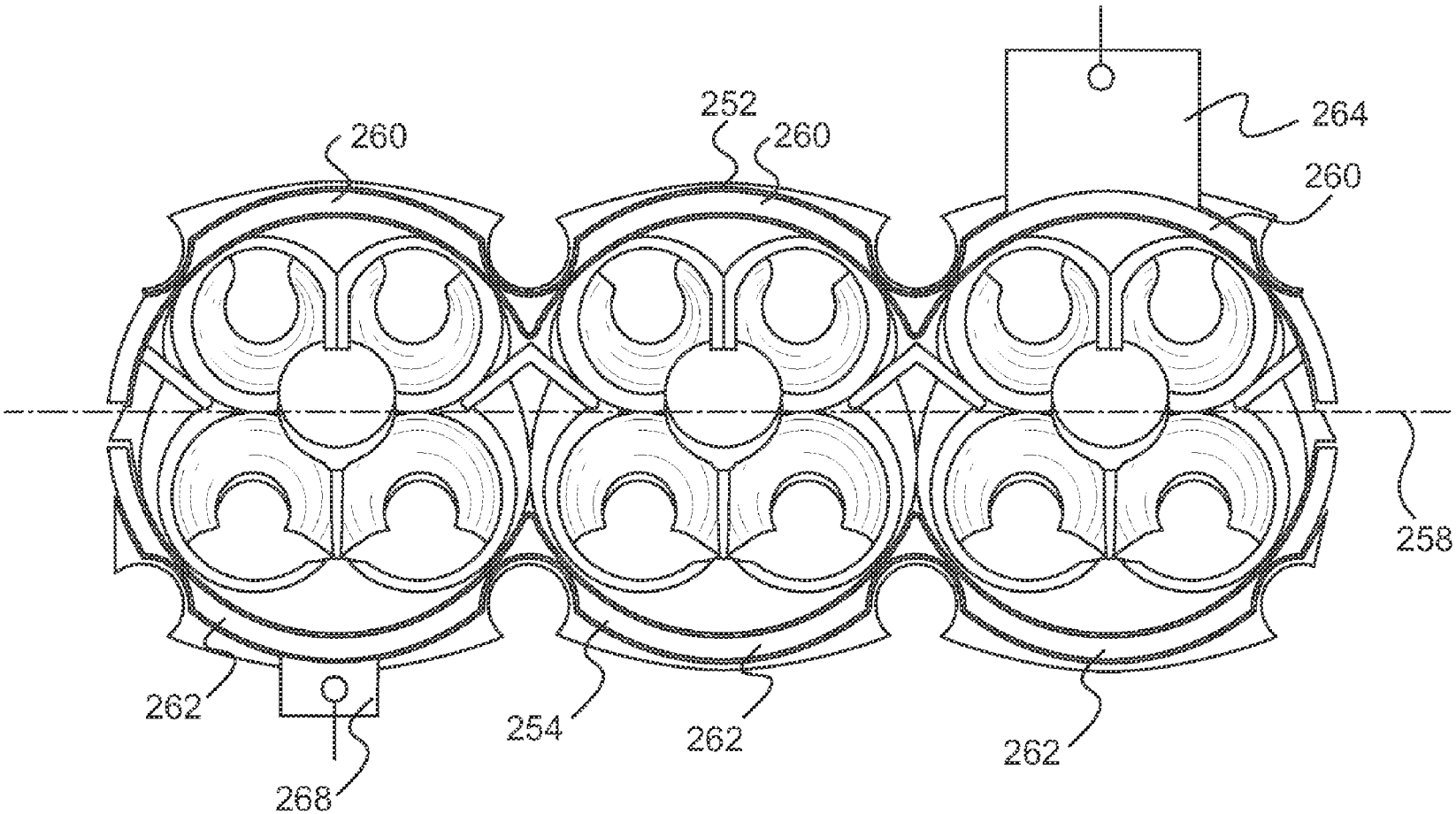
FIG. 28 is a bottom view of the cylinder block cooling jackets of FIG. 27.

Turning now to FIGS. 26 to 28, the engine cooling system will be described. The engine 10 is cooled by coolant, such as water or glycol, flowing in three main cooling jackets. Two of these cooling jackets (first cooling jacket 252 and second cooling jacket 254) are located in the cylinder block 22. The third cooling jacket is the cylinder head cooling jacket 256 located in the cylinder head assembly 26.

As seen in FIG. 28, the first cooling jacket 252 is disposed completely on the exhaust side of a longitudinal axis 258 passing through the center of the cylinder block 22. The first cooling jacket 252 forms three arcs 260 which are disposed about the exhaust side portions of the three cylinders 20. The coolant inlet 264 to the cylinder block 22 is disposed on the exhaust side of the cylinder block 22 near the end of the engine 10 where the output shaft 68 is located and is formed with the first cooling jacket 252, as seen in FIG. 27. A coolant outlet 266 extends from the central arc 260 of the first cooling jacket 252 to deliver coolant to the oil cooler 58, as described below.

The second cooling jacket 254 is disposed completely on the intake side of the longitudinal axis 258. The second cooling jacket 254 forms three arcs 262 which are disposed about the intake side portions of the three cylinders 20. The coolant outlet 268 from the cylinder block 22 is disposed on the intake side of the cylinder block 22 near the end of the engine 10 where the magneto 32 is located and is formed with the second cooling jacket 254, as seen in FIG. 27. The coolant outlet 268 is smaller than the coolant inlet 264 since some of the coolant which enters the cylinder block 22 exits the cylinder block 22 via the coolant outlet 266, therefore leaving less coolant to exit the coolant outlet 268. The second cooling jacket 254 is fluidly separate from the first cooling jacket 252 in the cylinder block 22, which means that there are no passages in the cylinder block 22 which communicate the first cooling jacket 252 with the second cooling jacket 254. As explained below, the first cooling jacket 252 does fluidly communicate with the second cooling jacket 254, but does so via the cylinder head cooling jacket 256. The first and second cooling jackets 252, 254 are preferably integrally formed with the cylinder block 22 during the casting of the cylinder block 22.

The cylinder head cooling jacket 256 surrounds the areas where the intake and exhaust valves 182, 188 are disposed in the valve assembly portion 176 of the cylinder head assembly 26. The cylinder head cooling jacket 256 fluidly communicates with the first cooling jacket 252 via passages 270 (FIG. 27) which extend from the upper portion of each arc 260 of the first cooling jacket 252 to the lower portion of the cylinder head cooling jacket 256. Similarly, the cylinder head cooling jacket 256 fluidly communicates with the second cooling jacket 254 via passages 272 which extend from the upper portion of each arc 262 of the second cooling jacket 252 to the lower portion of the cylinder head cooling jacket 256. The cylinder head cooling jacket 256 is preferably integrally formed with the valve assembly portion 176 of the cylinder head assembly 26 during the casting of the valve assembly portion 176.

The engine cooling system also includes other components which were previously mentioned. These are the oil cooler 58, the coolant pump 59, the thermostat 48, and the heat exchanger 56.

The oil cooler 58 removes at least a portion of the heat that has been accumulated inside the oil from a previous passage through the lubrication system, thus maintaining the lubricating properties of the oil. The oil cooler 58 is preferably a plate-type cooler.

The coolant pump 59 pumps the coolant through the engine cooling system. As previously mentioned, the impeller 152 of the coolant pump 59 is driven by the counterbalance shaft 104. The thermostat 48 controls the flow path of the coolant in the engine cooling system based on the temperature of the coolant as described further below. In a preferred embodiment, the thermostat 48 makes all of the coolant flowing to the thermostat 48 pass by one path or another. However, it is contemplated that the thermostat 48 could separate the coolant flowing to the thermostat 48 such that some coolant passes by one path while some coolant passes by another path. The thermostat 48 has a first thermostat inlet 276, a second thermostat inlet 278, a first thermostat outlet 280, and a second thermostat outlet 282 (FIG. 26).

The heat exchanger 56 removes at least a portion of the heat that has been accumulated inside the coolant from a previous passage through the engine cooling system. Many types of heat exchangers 56 are contemplated depending on the type of application of the engine 10, such as intercoolers or radiators. In the personal watercraft 16, the heat exchanger 56 is a plate, such as the ride plate, having at least one side in contact with the water in which the personal watercraft 16 is floating and the coolant is made to run through the plate. In the snowmobile 18, the heat exchanger 56 is a plate located under the tunnel in a position where it will receive snow flung by the snowmobile track while it is moving and the coolant is made to run through the plate. It is contemplated that for marine application, the heat exchanger 56 could be omitted by pumping the water from the body of water in which the marine vehicle is located, using the water as the coolant in the cooling system, and returning the water to the body of water after it has been through the cooling system. Such a system is known as an open-loop cooling system.

It is contemplated that the engine cooling system could also include a coolant reservoir 274 to fill the engine cooling system with coolant and to account for variations in the level of coolant in the engine cooling system. It should be understood that the position of the coolant reservoir 274 shown in FIG. 26 is only one of many possible positions. In a preferred embodiment, the coolant reservoir 274 is located vertically higher than any other portion of the engine cooling system. It is contemplated that the heat exchanger 56 could also be used as the coolant reservoir 274.

As seen in FIG. 26, during engine operation, coolant flows in the coolant intake pipe 52 to the coolant pump 59. From the coolant pump 59, coolant flows to the coolant inlet 264 and enters the first cooling jacket 252. A portion of the coolant present in the first cooling jacket 252 exits the first cooling jacket 252 via the coolant outlet 266 and flows to the oil cooler 58. From the oil cooler 58, the portion of coolant flows back to the coolant pump 59. The remainder of the coolant in the first cooling jacket 252 flows to the cylinder head cooling jacket 256 via the passages 270 (FIG. 27). From the cylinder head cooling jacket 256, the coolant flows to the second cooling jacket 254 via the passages 272 (FIG. 27). The coolant exits the second cooling jacket 254 by the coolant outlet 268. The coolant then flows in the coolant exhaust pipe 54 and enters the thermostat 48 by the first thermostat inlet 276. If the coolant temperature is above a predetermined temperature, the thermostat 48 makes the coolant exit the thermostat 48 by the first thermostat outlet 280. From the first thermostat outlet 280, the coolant flows to the heat exchanger 56. From the heat exchanger 56, the coolant enter the thermostat 48 via the second thermostat inlet 278, and returns to the coolant intake pipe 52 via the second thermostat outlet 282 to be circulated through the engine cooling system once again. If the temperature of the coolant that enters the thermostat 48 is below the predetermined temperature, then the thermostat 48 makes the coolant exit the thermostat 48 directly by the second thermostat outlet 282. The coolant then returns to the coolant intake pipe 52 to be circulated through the engine cooling system once again.

It is contemplated that the coolant intake and exhaust pipes 52, 54 could be integrally formed with the cylinder block 22 during the casting of the cylinder block 22.

Figure 29:
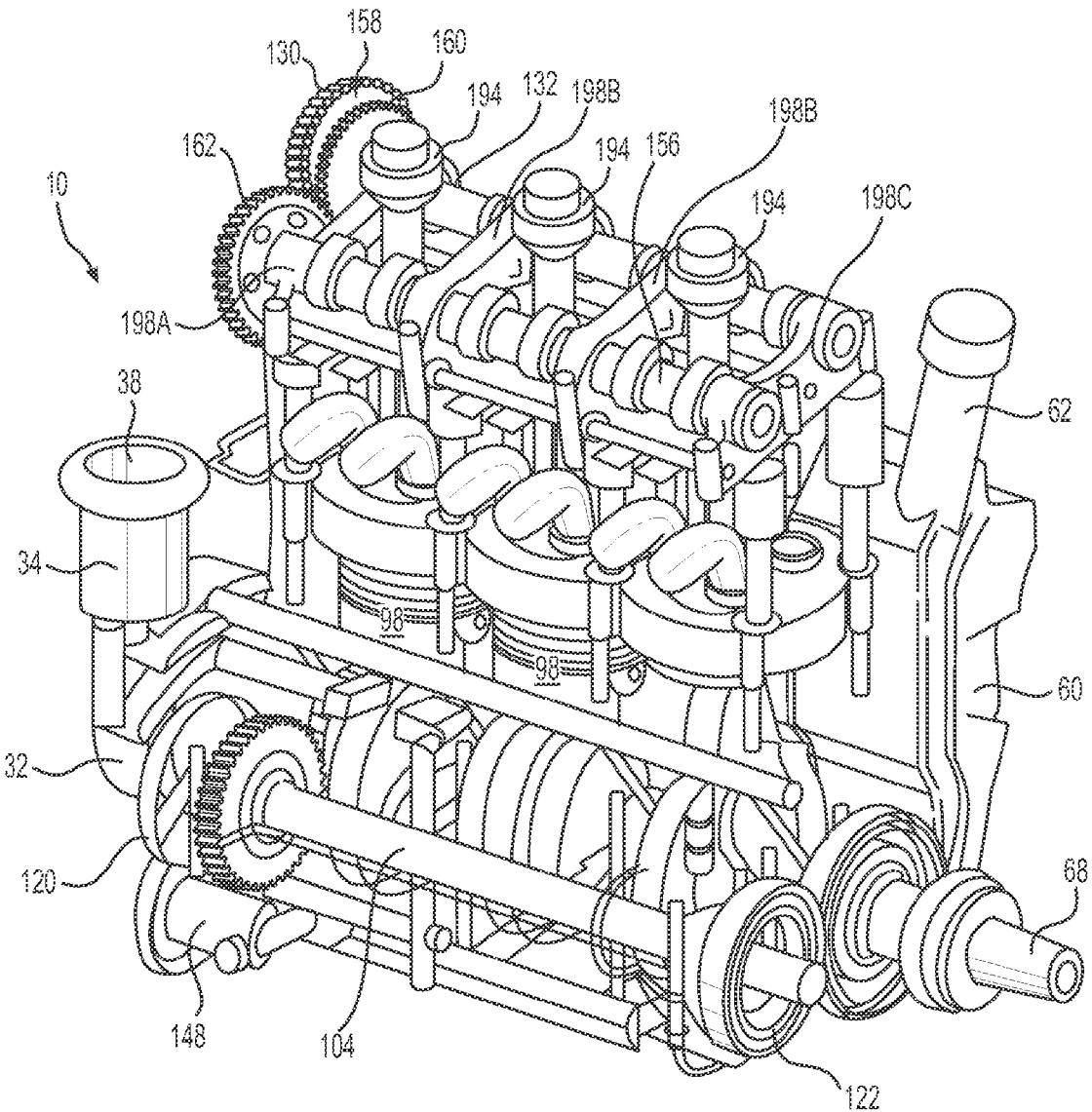
FIG. 29 is a perspective view, from the second end, exhaust side, of the engine of FIG. 5 with the crankcase, cylinder block, and cam assembly cover removed in order to see the internal components of the engine.
Figure 30:
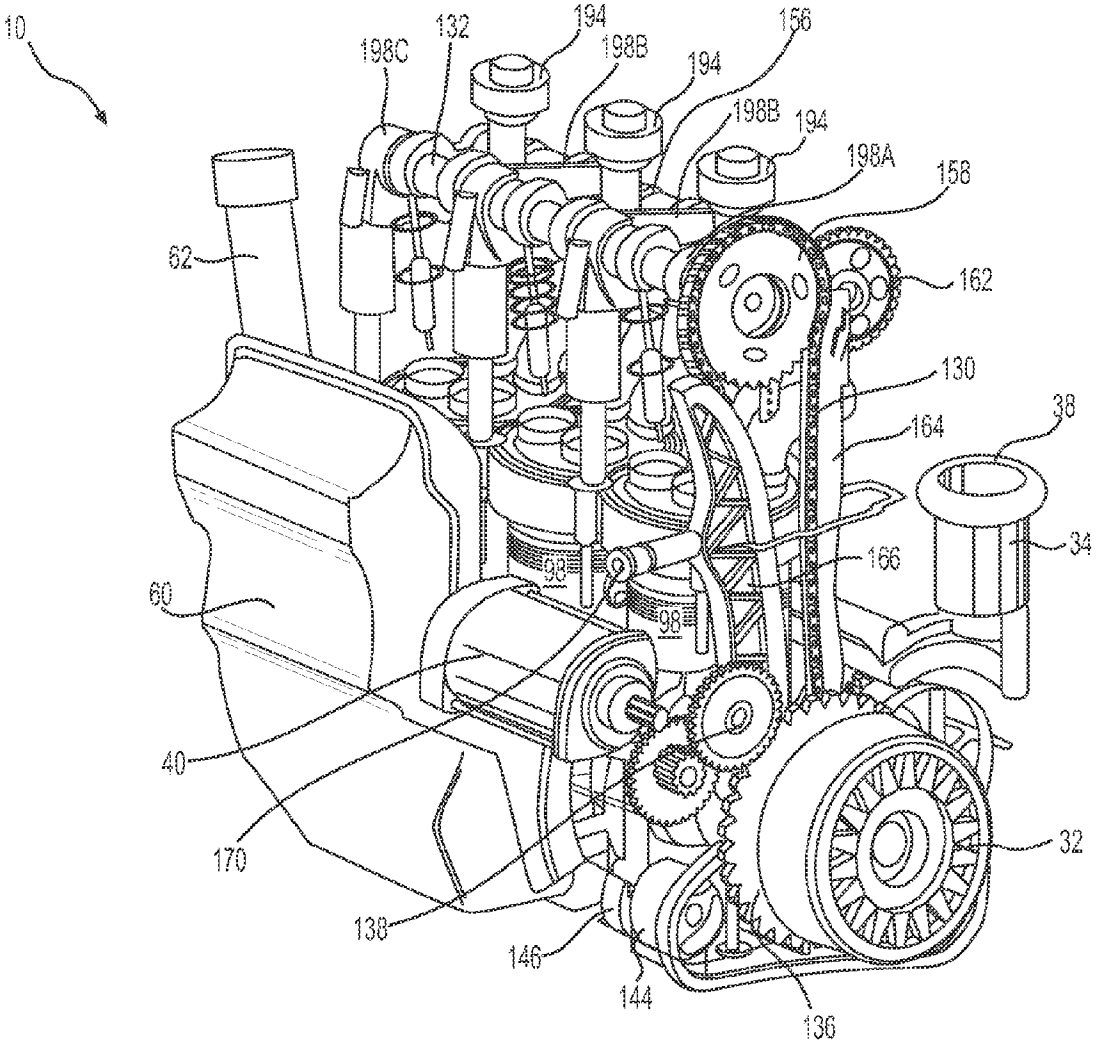
FIG. 30 is a perspective view, from the first end, air intake side, of the engine of FIG. 5 with the crankcase, cylinder block, and cam assembly cover removed in order to see the internal components of the engine.

As previously mentioned, the engine 10 has three oil pumps. They are the oil suction pump 144, the oil suction pump 146, and the oil pressure pump 148. The oil pumps 144, 146, and 148 are preferably of the type known as internal gear pumps. An internal gear pump is a type of positive-displacement pump which uses an external spur gear disposed inside an internal spur gear, with the external spur gear acting as the drive gear. As can be seen in FIG. 29, the oil pressure pump 148 is disposed in the crankcase 24 near the bottom of the engine 10 on the exhaust side. As can be seen in FIG. 30, the oil suction pump 144 and the oil suction pump 146 are disposed in the crankcase 24 near the bottom of the engine 10 on the intake side. The oil suction pump 144 and the oil suction pump 146 are coaxial, with the oil suction pump 144 being closer to the end of the engine 10 than the oil suction pump 146. The drive gears (not shown) of the oil suction pump 144 and the oil suction pump 146 are disposed on a common pump shaft (not shown) which is driven as described below.

Figure 31A:
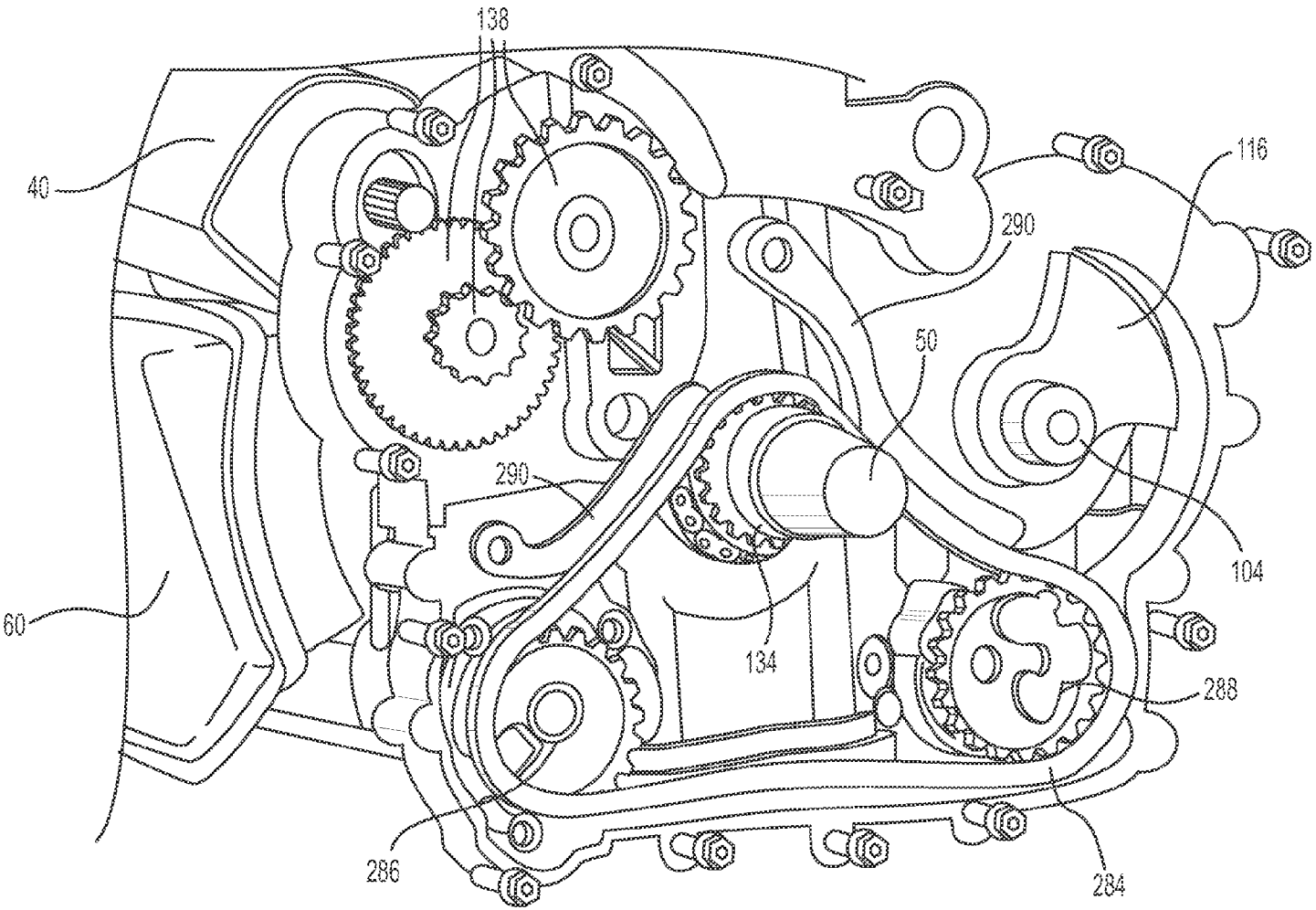
FIG. 31A illustrates a first embodiment of an oil pump drive system.
Figure 31B:
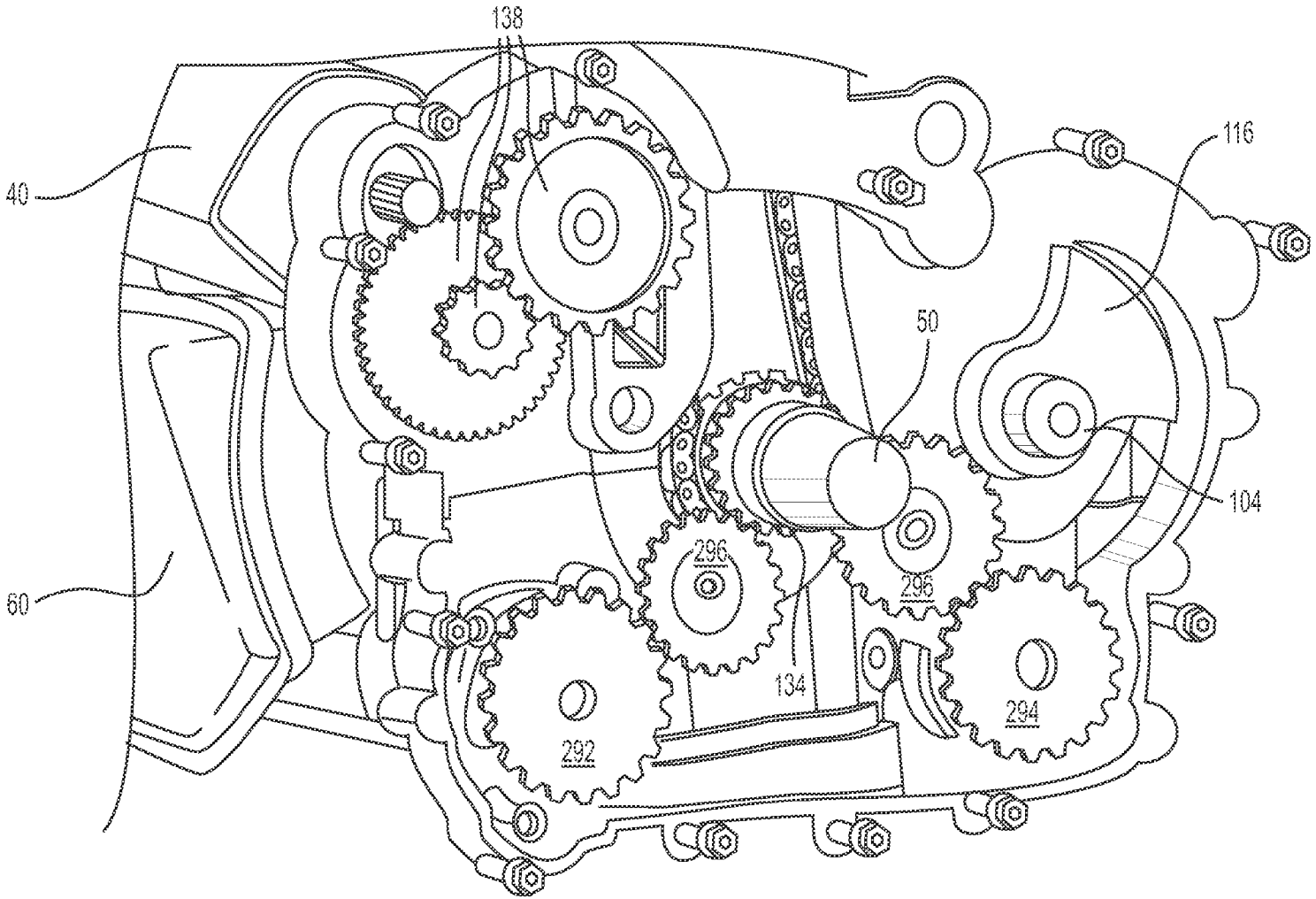
FIG. 31B illustrates a second embodiment of the oil pump drive system.
Figure 31C:
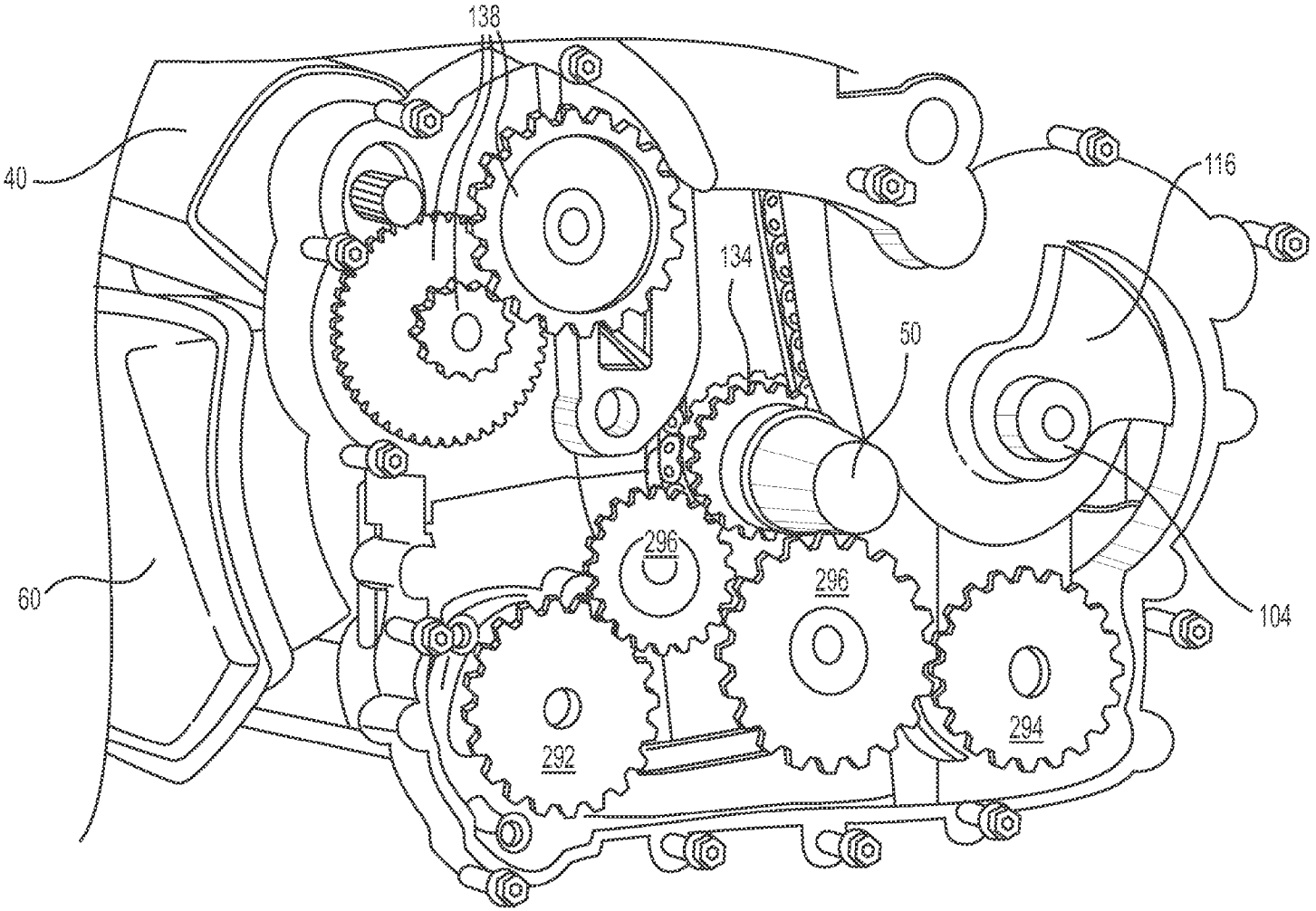
FIG. 31C illustrates a third embodiment of the oil pump drive system.

As can be seen in FIGS. 31A to 31C various oil pump drive systems are contemplated. The oil drive systems shown in these figures are all covered by the magneto cover 30. In the embodiment shown in FIG. 31A, the sprocket 134 disposed on the crankshaft 50 drives a belt or chain 284 which in turn drives a first oil pump sprocket 286 and a second oil pump sprocket 288. The first oil pump sprocket 286 is disposed on the pump shaft of the oil suction pump 144 and the oil suction pump 146, and therefore drives these two pumps 144, 146. The second oil pump sprocket 288 is disposed on the pump shaft (not shown) of the oil pressure pump 148, and therefore drives this pump 148. Belt or chain tensioners 290 are used to maintain the tension in the belt or chain 284. In the embodiments shown in FIGS. 31B and 31C, the gear 134 disposed on the crankshaft 50 drives a first oil pump gear 292 and a second oil pump gear 294 via intermediate gears 296. The first oil pump gear 294 is disposed on the pump shaft of the oil suction pump 144 and the oil suction pump 146, and therefore drives these two pumps 144, 146. The second oil pump gear 294 is disposed on the pump shaft of the oil pressure pump 148, and therefore drives this pump 148. As can be seen, the size of the intermediate gears 296, and therefore the gear ratio, is different between FIGS. 31B and 31C. This is because gear pumps pump a constant amount of fluid per revolution, but the relationship between an engine's horsepower and it's oil requirements is not linear. The gear ratio illustrated in FIG. 31B is for an engine 10 having a greater horsepower than the one in FIG. 31C.

Figure 32:
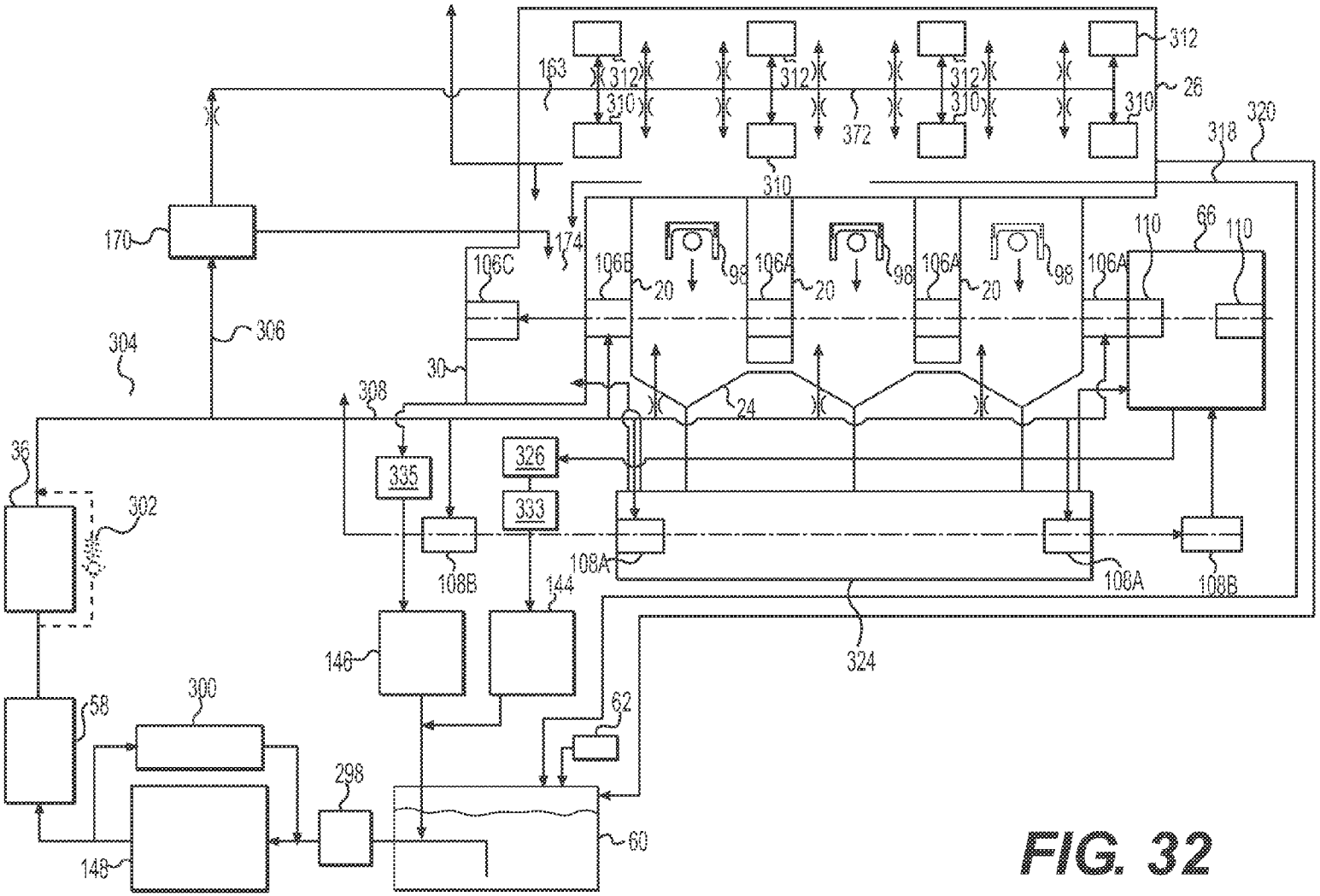
FIG. 32 is a schematic representation of the lubrication system of the engine of FIG. 5.

Turning now to FIG. 32, the engine's lubrication system will be described. The oil is stored in the oil tank 60. The oil is pumped out of the oil tank 60 through an oil sieve 298 by oil pressure pump 148. A pressure regulating valve 300 is provided downstream of the oil pressure pump 148. The pressure regulating valve 300 will open to return the oil upstream of the oil pressure pump 148 should the pressure inside the lubrication system become too high.

From the oil pressure pump 148, the oil flows to the oil cooler 58. As mentioned above, it is contemplated that it may not be necessary to include the oil cooler 58. The oil then flows through the oil filter 36. The oil filter 36 filters out debris and impurities from the oil. An oil filter bypass valve 302 may be provided. The oil filter bypass valve 302 would open if oil pressure builds up at the inlet of the oil filter 36, such as if the oil filter 36 becomes clogged, thus permitting oil to continue to flow inside the lubrication system. It is contemplated that the oil filter bypass valve 302 could be integrated with the oil filter 36.

From the oil filter 36, the oil flows to the main oil gallery 304, and from there it gets separated into two main paths 306, 308. The oil flowing through the first main path 306 first lubricates the chain tensioner 170. From the chain tensioner 170, some of the oil flows down the timing chain case 174, lubricating the timing chain 130 in the process, and the remainder of the oil flows to the cylinder head assembly 26.

The lubrication of the cylinder head assembly 26 will be described in detail further below, but basically the oil flowing inside the cylinder head assembly 26 from the first main path 306 lubricates the plain bearings 310 of the first camshaft 132 and the plain bearings 312 of the second camshaft 156. It is contemplated that other types of bearings could be used. Some of the oil flowing inside the cylinder head assembly 26 is also sprayed on the cam followers 218, 220. As seen in FIG. 23, spray nozzles 314, in the form of openings in the oil supply lines 230 spray oil onto the upper surfaces of the cam followers 218, 220 to lubricate the contact surfaces between the cam followers 218, 220 and their corresponding cams 202, 204. As illustrated by lines 316 in FIG. 23, the oil is sprayed onto the upper surfaces of the cam followers 218, 220 in a direction generally perpendicular to the cam follower shafts 208, 210. Returning to FIG. 32, from the cylinder head assembly 26 some of the oil flows back to the oil tank 60 via passages 318, 320. The remainder of the oil flows down inside the timing chain case 174 to the bottom of the magneto cover 30, lubricating the components found, at least partially, therein in the process. These components are the timing chain 130 and the oil pump drive system, various embodiments of which are shown in FIGS. 31A to 31C.

A portion of the oil flowing through the second main path 308 is used to lubricate the plain bearings 106A, 106B of the crankshaft 50. The plain bearing 106C of the crankshaft 50 is lubricated by oil flowing from the plain bearing 106B to the plain bearing 106C via an oil passage 322 (FIG. 13) in the crankshaft 50. The oil lubricating the plain bearing 106C then flows down to the bottom of the magneto cover 30. The oil lubricating the plain bearings 106A, 106B then flows to the bottom of the crankcase 24. The oil then flows from the bottom of the crankcase 24 to the oil chamber 326, which is disposed below the crankcase 24, via openings 328 in the bottom of the crankcase 24, as seen in FIG. 33.

Another portion of the oil flowing through the second main path 308 is sprayed inside the crankcase 24 so as to spray the bottom of the pistons 98. By doing this, the oil both cools the pistons 60 and lubricates the piston pins (not shown). The oil then falls down to the bottom of the crankcase 24 and then to the oil chamber 326.

Yet another portion of the oil flowing through the second main path 308 flows to the counterbalance shaft chamber 324 where the counterbalance shaft 104 is located. That oil is used to lubricate the plain bearings 108A of the counterbalance shaft 104. The oil then flows from each plain bearing 108A to a corresponding plain bearing 108B via passages 327 (FIG. 14) in the counterbalance shaft 104. From the counterbalance shaft chamber 324, a portion of the oil flows inside the magneto cover 30 and another portion flows inside the PTO cover 66. The oil inside the PTO cover 66 lubricates the ball bearings 110 of the output shaft 68 and the gears 122, 150, and 154. From the PTO cover 66, the oil flows to the oil chamber 326.

Figure 33:
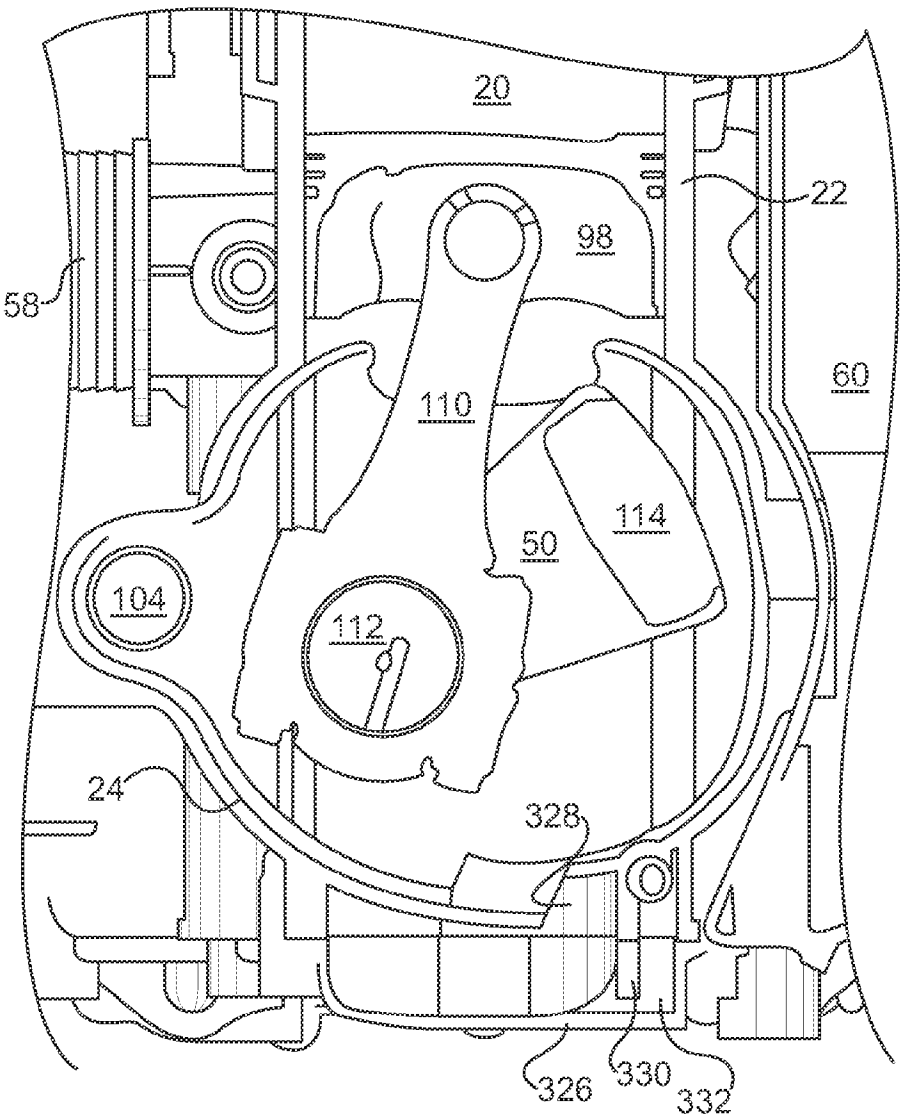
FIG. 33 is a vertical cross-section, taken through a cylinder perpendicularly to the crankshaft of the engine of FIG. 5 illustrating the cylinder block, crankcase, and oil chamber arrangement.

As seen in FIG. 33, the crankcase 24 and oil chamber 326 form a wall 330 spanning almost the entire length of the oil chamber 326. This separates the volume formed between the crankcase 24 and the oil chamber 326 into two portions. The smaller of these portions is referred to herein as the oil suction chamber 332. The oil in the oil chamber 326 flows inside the oil suction chamber 332, flows through oil sieve 333, and is pumped back to the oil tank 60 by the oil suction pump 144 The smaller volume of the oil suction chamber 332 facilitates the pumping of the oil found therein.

The oil which flows inside the magneto cover 30 from various sources as described above, flows through oil sieve 335 and is pumped back to the oil tank 60 by the oil suction pump 146.

Figure 34:
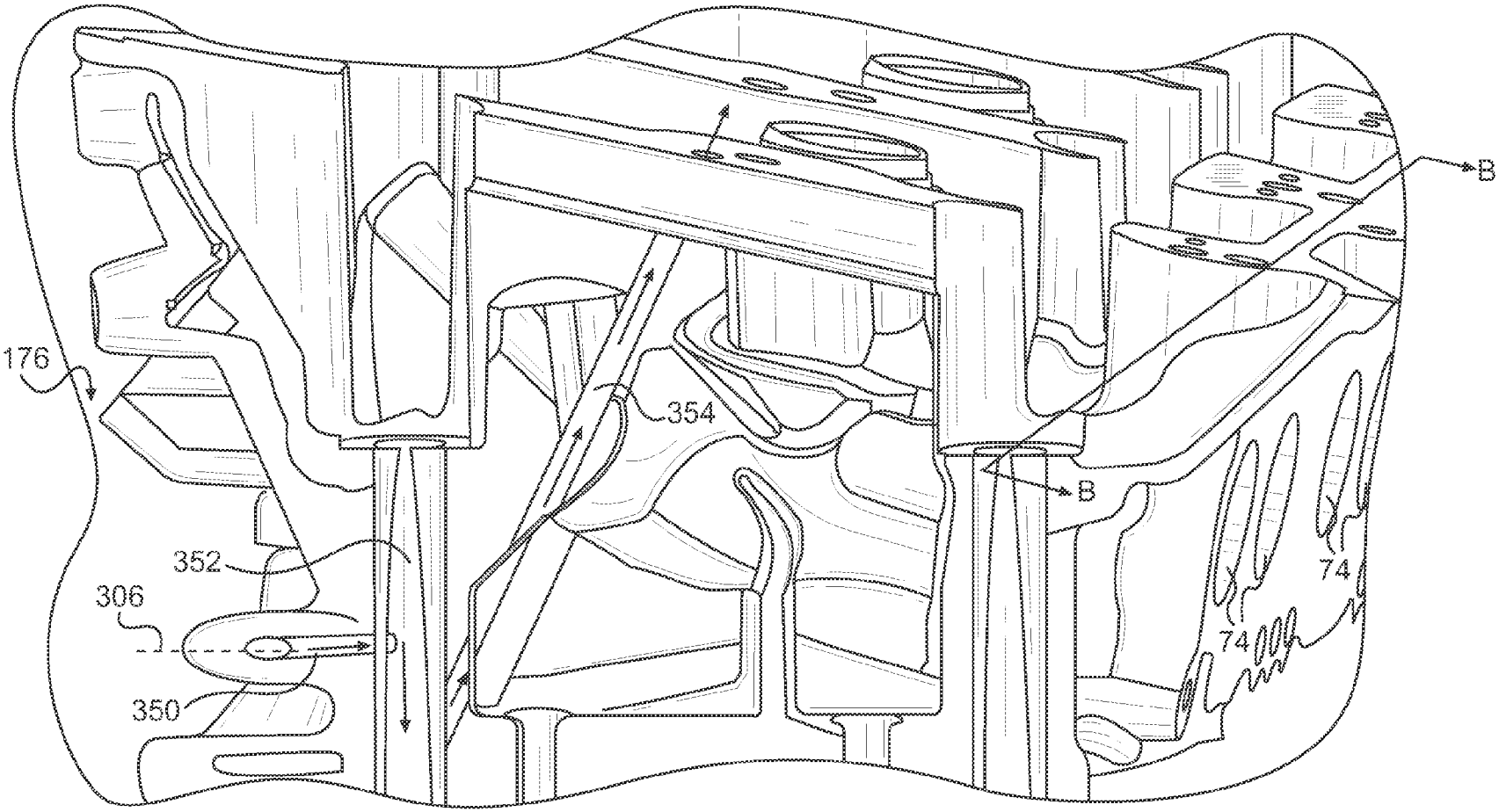
FIG. 34 is a perspective view of a cross-section of the valve assembly portion of the cylinder head assembly taken through line A-A of FIG. 13.

Turning now to FIGS. 34 to 38 the lubrication of the cylinder head assembly 26 will be described in more details. As seen in FIG. 34, from the first main path 306, oil enters the valve assembly portion 176 through passage 350. Oil flows in the passage 350 and then flows down bolt hole 352. Bolt hole 352 is one of the holes used to insert bolts 180 to fasten the valve assembly portion 176 to the cylinder block 22. From the bolt hole 352, the oil flow diagonally upwardly and towards the center of the valve assembly portion 176 via passage 354. From the passage 354, the oil enters the first camshaft support 198A.

Figure 35:
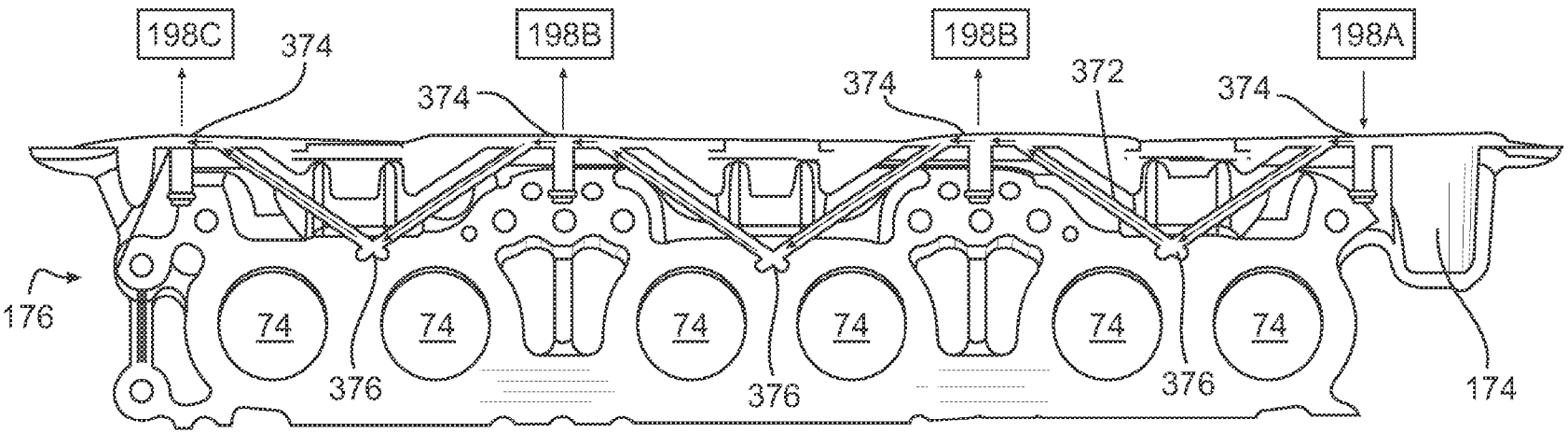
FIG. 35 is a cross-section of the valve assembly portion taken through line B-B of FIG. 34.
Figure 36:
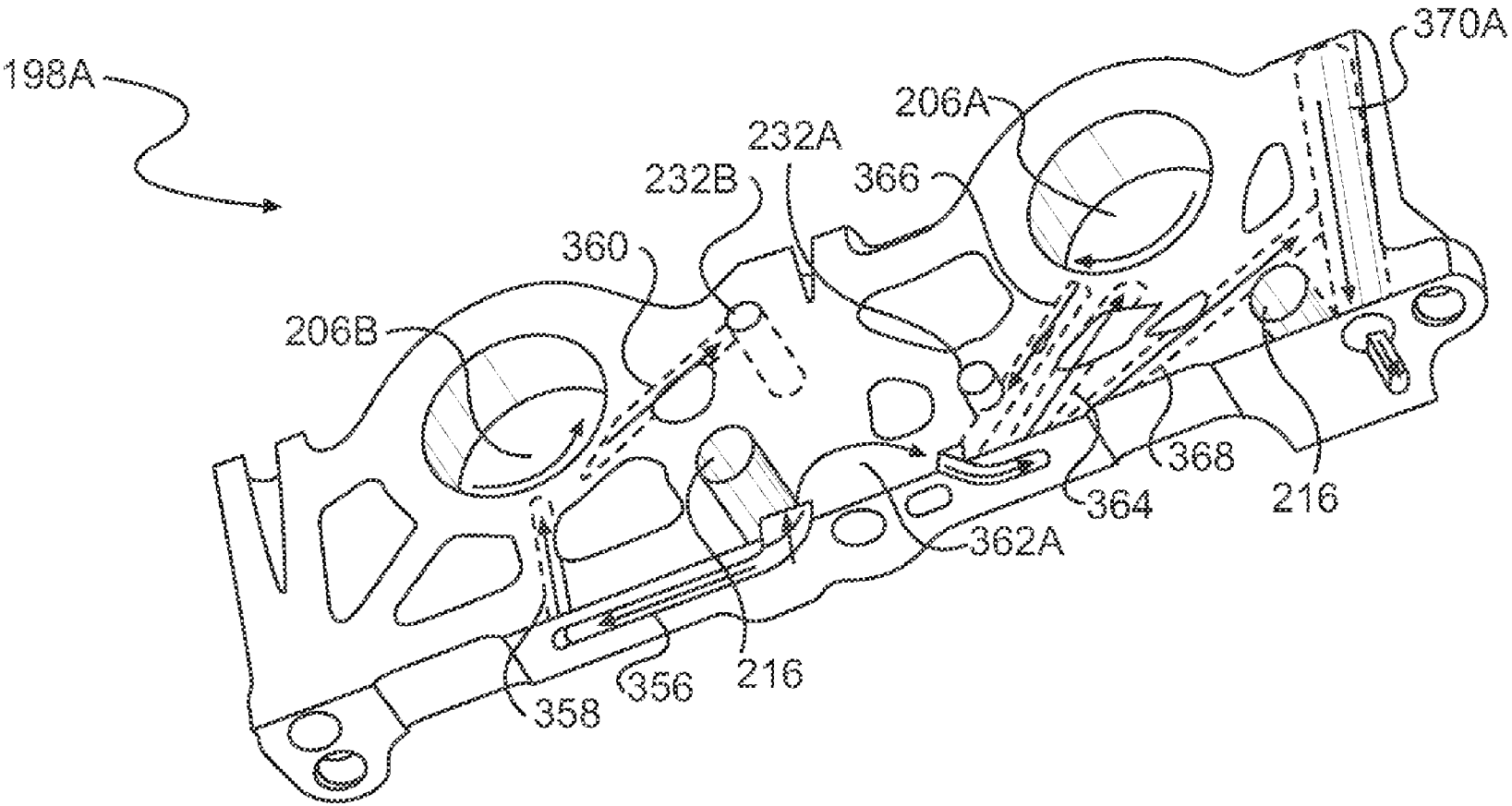
FIG. 36 is a perspective view, from a bottom, exhaust side, of a section of a first camshaft support.

As seen in FIG. 36, the oil enter the first camshaft 198A in a passage 356 formed between the bottom thereof and the upper surface of the valve assembly portion 176. A portion of the oil in passage 356 flows towards and up the passage 358 to enter the bottom of the opening 206B. Once there, the oil lubricates the plain bearing 310 formed between the opening 206B and the first camshaft 132. A portion of the oil supplied to the plain bearing 310 flows through a passage 360 which communicates with the opening 232B to supply oil to the upper oil supply line 230B (FIG. 23) which, as mentioned above, is used to lubricate the cam followers 218. The remainder of the oil supplied to the plain bearing 310 flows out of the opening 206B, down to the valve assembly portion 176 and is eventually returned to the oil tank 60 as described above. Another portion of the oil in the passage 356 flows around the bolt hole 362A, which is used to insert one of the bolts 200 which connects the camshaft support 198A to the valve assembly portion 176, and flows up passage 364 to enter the bottom of the opening 206A. Once there, the oil lubricates the plain bearing 312 formed between the opening 206A and the second camshaft 156. A portion of the oil supplied to the plain bearing 312 flows through a passage 366 which communicates with the opening 232A to supply oil to the lower oil supply line 230A (FIG. 23) which, as mentioned above, is used to lubricate the cam followers 220 and also supplies oil to the two center camshaft supports 198B as described below. The remainder of the oil supplied to the plain bearing 312 flows out of the opening 206A, down to the valve assembly portion 176 and is eventually returned to the oil tank 60 as described above. Yet another portion of the oil in the passage 356 flows up passage 368 to bolt hole 370A, which is used to insert another one of the bolts 200 which connects the camshaft support 198A to the valve assembly portion 176. This oil then flows down bolt hole 370A and enters the cylinder head lubrication passage 372 (FIG. 35).

As seen in FIG. 35, the cylinder head lubrication passage 372 is disposed in the valve assembly portion 176 vertically below the camshaft supports 198 and vertically above the exhaust passages 74. The cylinder head lubrication passage 372 has a generally dentate profile. The dentate profile has four upper vertices 374 each in alignment with one of the camshaft supports 198 and three lower vertices 376 each disposed between two of the camshaft supports 198. Each of the upper vertex 374 fluidly communicates the bolt hole 370 of it corresponding camshaft support 198 with the cylinder head lubrication passage 372. As can be seen, the cylinder head lubrication passage 372 supplies oil from the bolt hole 370A of camshaft support 198A to the bolt holes 370B of camshaft supports 198B and the bolt hole 370C of camshaft support 198C in series (i.e. oil flows in the cylinder head lubrication passage 372 from camshaft support 198A to the first camshaft support 198B, from there to the second camshaft support 198B, and finally from there to the camshaft support 198C).

Figure 37:
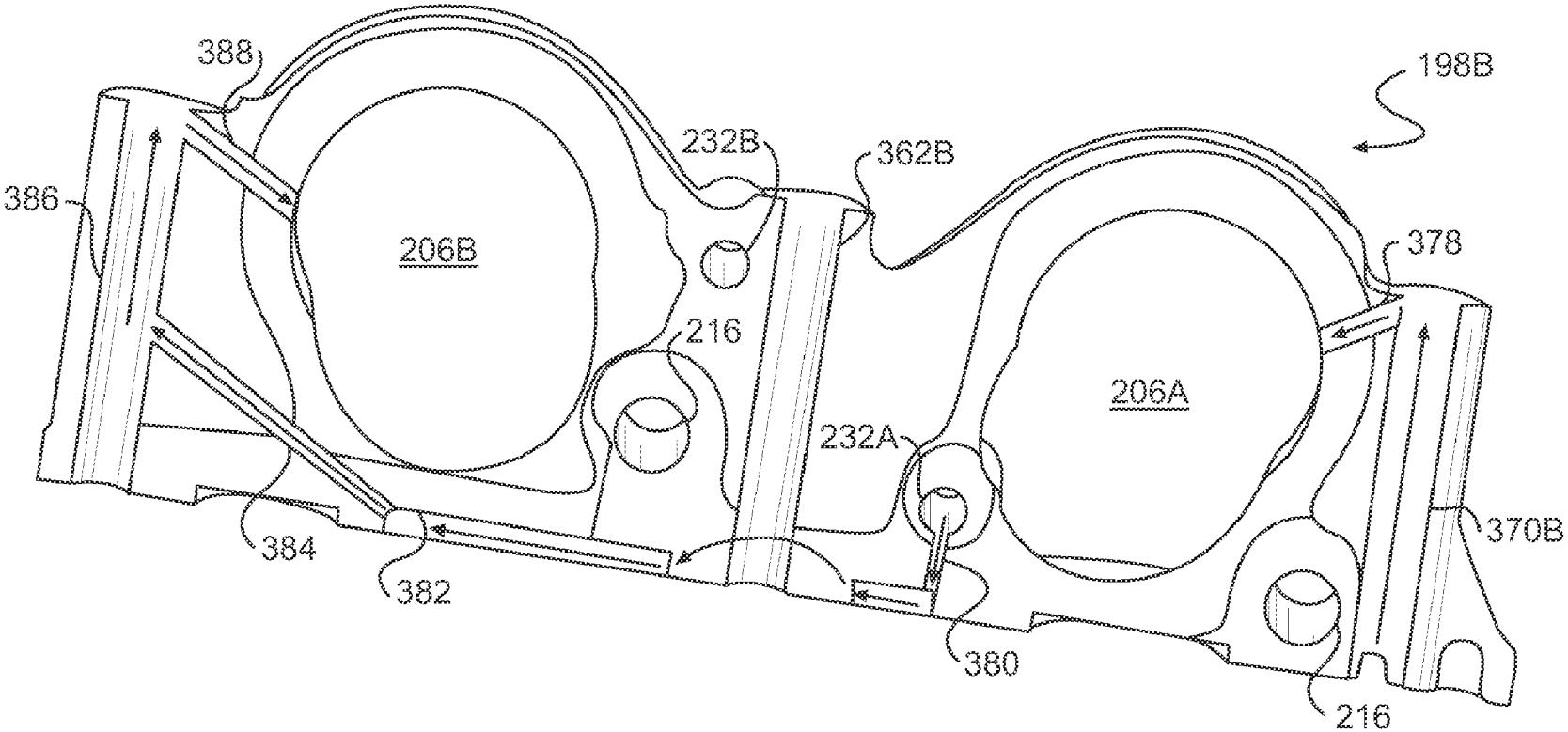
FIG. 37 is an elevation view of a section of a second camshaft support.

As seen in FIG. 37, for both center camshaft supports 198B, oil flows up bolt hole 370B from the cylinder head lubrication passage 372. From the bolt hole 370B, oil flows in passage 378 to enter the side of the opening 206A. Once there, the oil lubricates the plain bearing 312 formed between the opening 206A and the second camshaft 156. The oil supplied to the plain bearing 312 flows out of the opening 206A, down to the valve assembly portion 176 and is eventually returned to the oil tank 60 as described above. Oil is also supplied to the center camshaft supports 198B via the lower oil supply lines 230A which extend between the openings 232A in the camshaft supports 198. From the opening 232A, the oil flows down passage 380 to passage 382 formed between the bottom of camshaft support 198B and the upper surface of the valve assembly portion 176. Oil the in the passage 382 flows around the bolt hole 362B and up passage 384. From passage 384, oil flows up bolt hole 386 and then down passage 388. From passage 388 oil enters the side of the opening 206B. Once there, the oil lubricates the plain bearing 310 formed between the opening 206B and the first camshaft 132. The oil supplied to the plain bearing 310 flows out of the opening 206B, down to the valve assembly portion 176 and is eventually returned to the oil tank 60 as described above.

Figure 38:
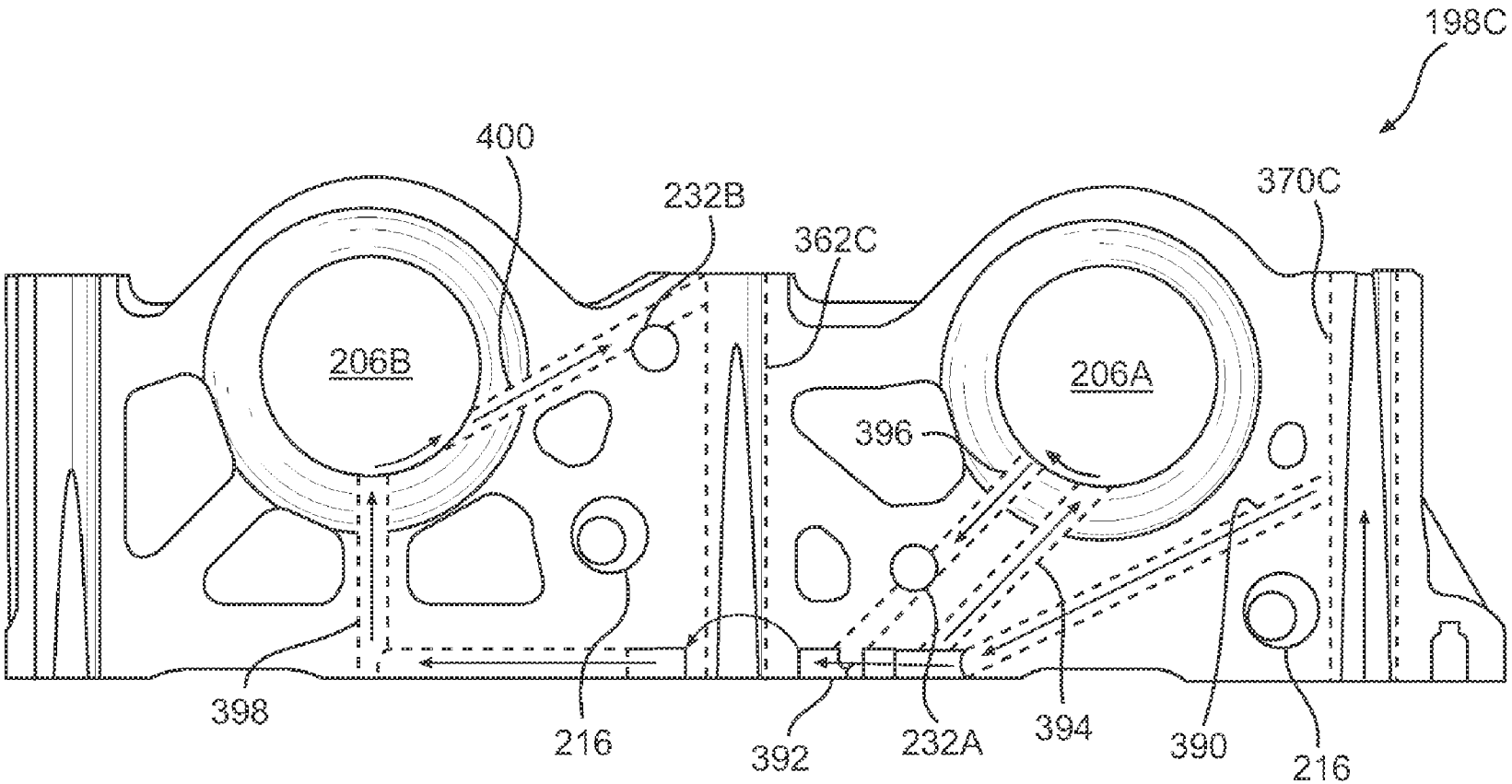
FIG. 38 is an elevation view of a section of a third camshaft support.

As seen in FIG. 38, for the camshaft supports 198C, oil flows up bolt hole 370C from the cylinder head lubrication passage 372. From the bolt hole 370C, oil flows in passage 390 to passage 392 formed between the bottom of camshaft support 198C and the upper surface of the valve assembly portion 176. From the passage 392, a portion of the oil flows up passage 394 to enter the bottom of the opening 206A. Once there, the oil lubricates the plain bearing 312 formed between the opening 206A and the second camshaft 156. A portion of the oil supplied to the plain bearing 312 flows through a passage 396 which communicates with the opening 232A to supply oil to the lower oil supply line 230A which, as mentioned above, is used to lubricate the cam followers 220 and also supplies oil to the two center camshaft supports 198B as described above. The remainder of the oil supplied to the plain bearing 312 flows out of the opening 206A, down to the valve assembly portion 176 and is eventually returned to the oil tank 60 as described above. Another portion of the oil in the passage 392 flows around the bolt hole 362C, then towards and up the passage 398 to enter the bottom of the opening 206B. Once there, the oil lubricates the plain bearing 310 formed between the opening 206B and the first camshaft 132. A portion of the oil supplied to the plain bearing 310 flows through a passage 400 which communicates with the opening 232B to supply oil to the upper oil supply line 230B which, as mentioned above, is used to lubricate the cam followers 218. The remainder of the oil supplied to the plain bearing 310 flows out of the opening 206B, down to the valve assembly portion 176 and is eventually returned to the oil tank 60 as described above.

Figure 39A:
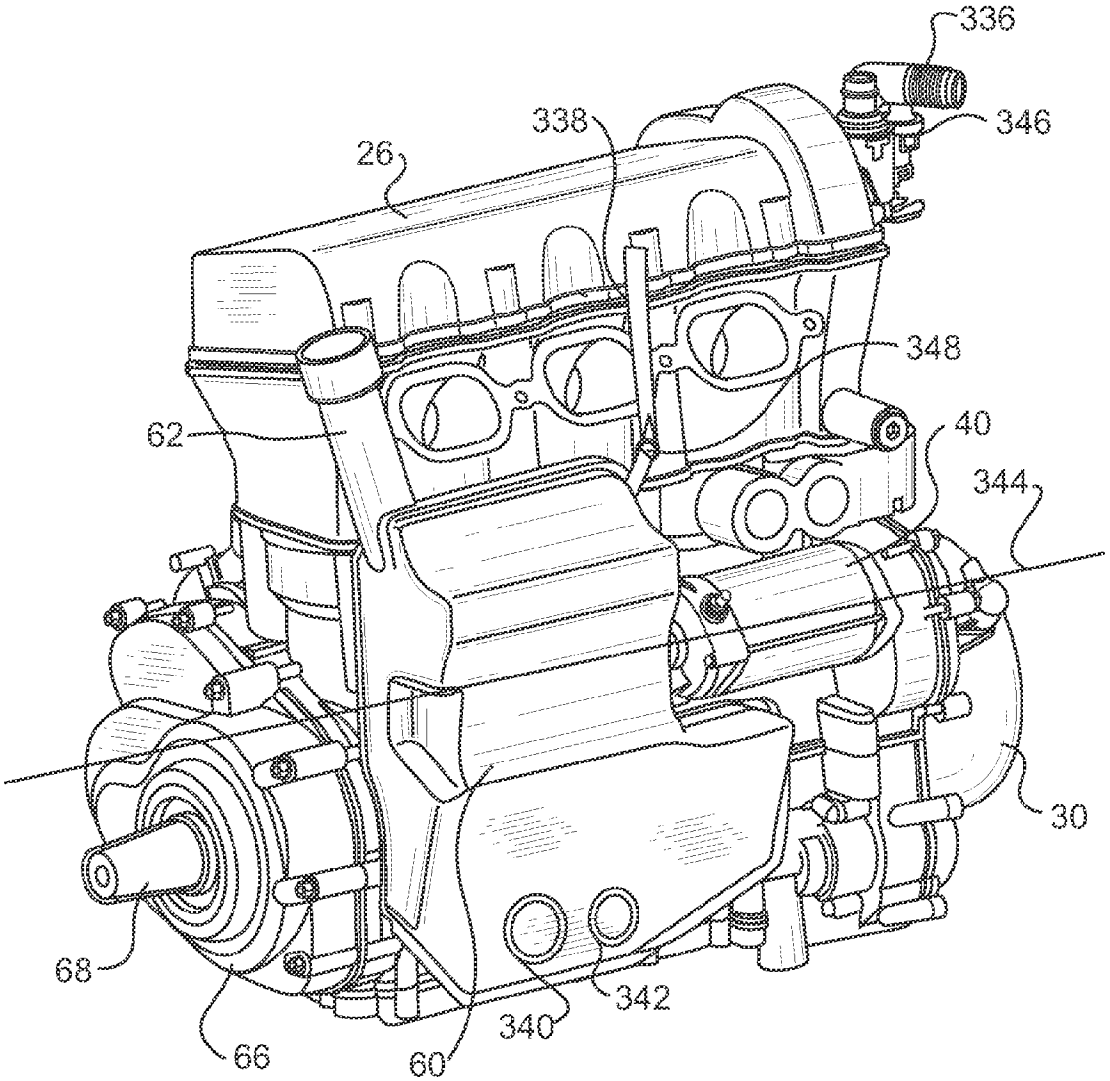
FIG. 39A is a perspective view of the engine of FIG. 5 in a level orientation to illustrate the operation of the blow by ventilation system.

A portion of the oil present in the crankcase 24 and the oil chamber 326 of the engine 10 is in the form of droplets suspended in the air. During the operation of the engine 10, some of the gases present in the combustion chamber pass through a gap between the pistons 98 and the walls of the cylinders 20 and enter the crankcase 24 and oil chamber 326. These gases are known as blow-by gases. In the crankcase 24 and oil chamber 326, the blow-by gases mix with the oil droplets. The mixture of blow-by gases and oil droplets present in the crankcase 24 and oil chamber 326 are pumped along with the oil by the suction pump 144 back to the oil tank 60. Once there, the mixture moves up the timing chain case 174 to the cylinder head assembly 26. Once in the cylinder head assembly 26, the blow-by gas separator 163, which is actuated by the first camshaft 132, acts as a centrifuge which causes the oil droplets to separate from the mixture and to fall down the timing chain case 174 to the bottom of the magneto cover 30 where they are returned to the oil tank 60 by the oil suction pump 146. The remaining blow-by gases enter a suction tube 334 (FIG. 13) which extends from the blow-by gas separator 163 to a blow-by tube 336 (FIG. 39A). The blow-by tube 336 fluidly communicates with the air intake manifold 90 where the blow-by gases are mixed with fresh air and are then returned to the combustion chambers.

Figure 39B:
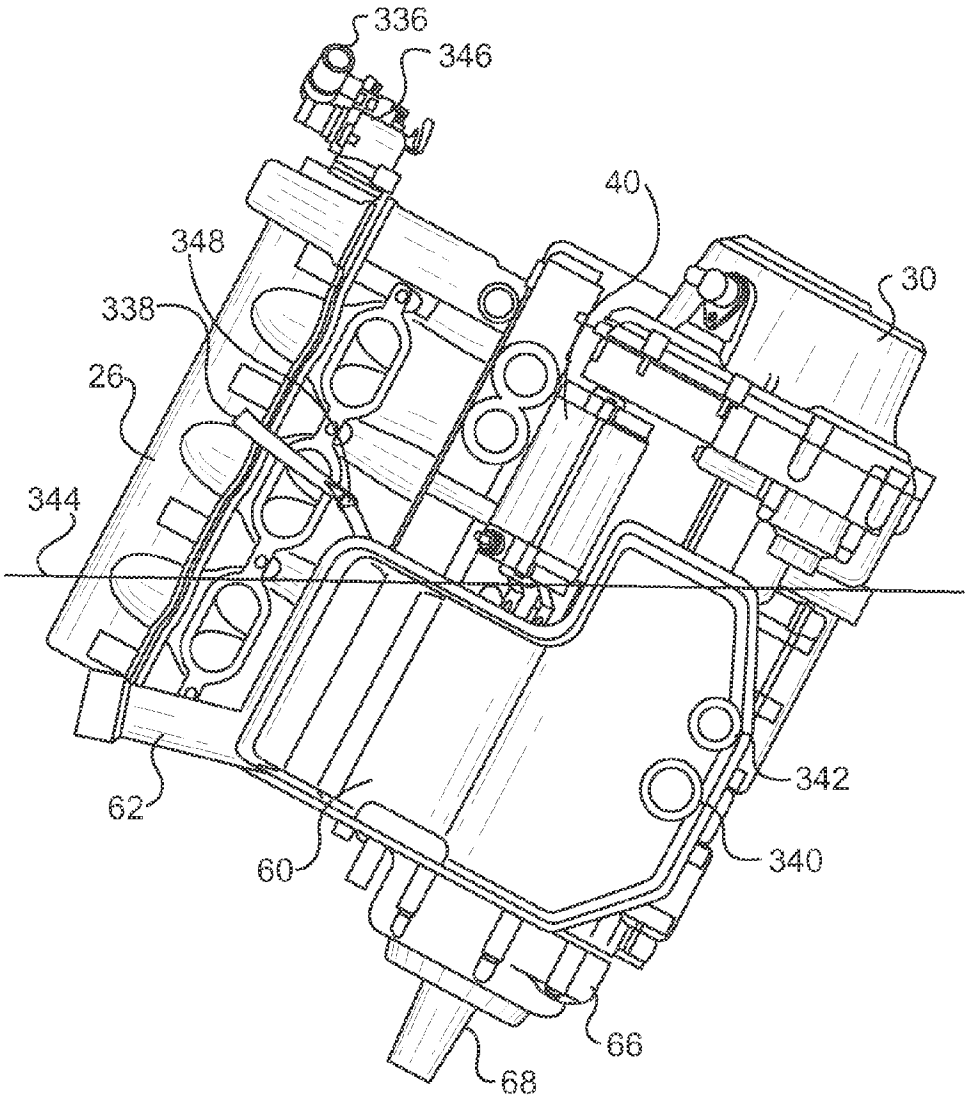
FIG. 39B is a side view of the engine of FIG. 39A with the engine tilted at 70 degrees from the horizontal.
Figure 39C:
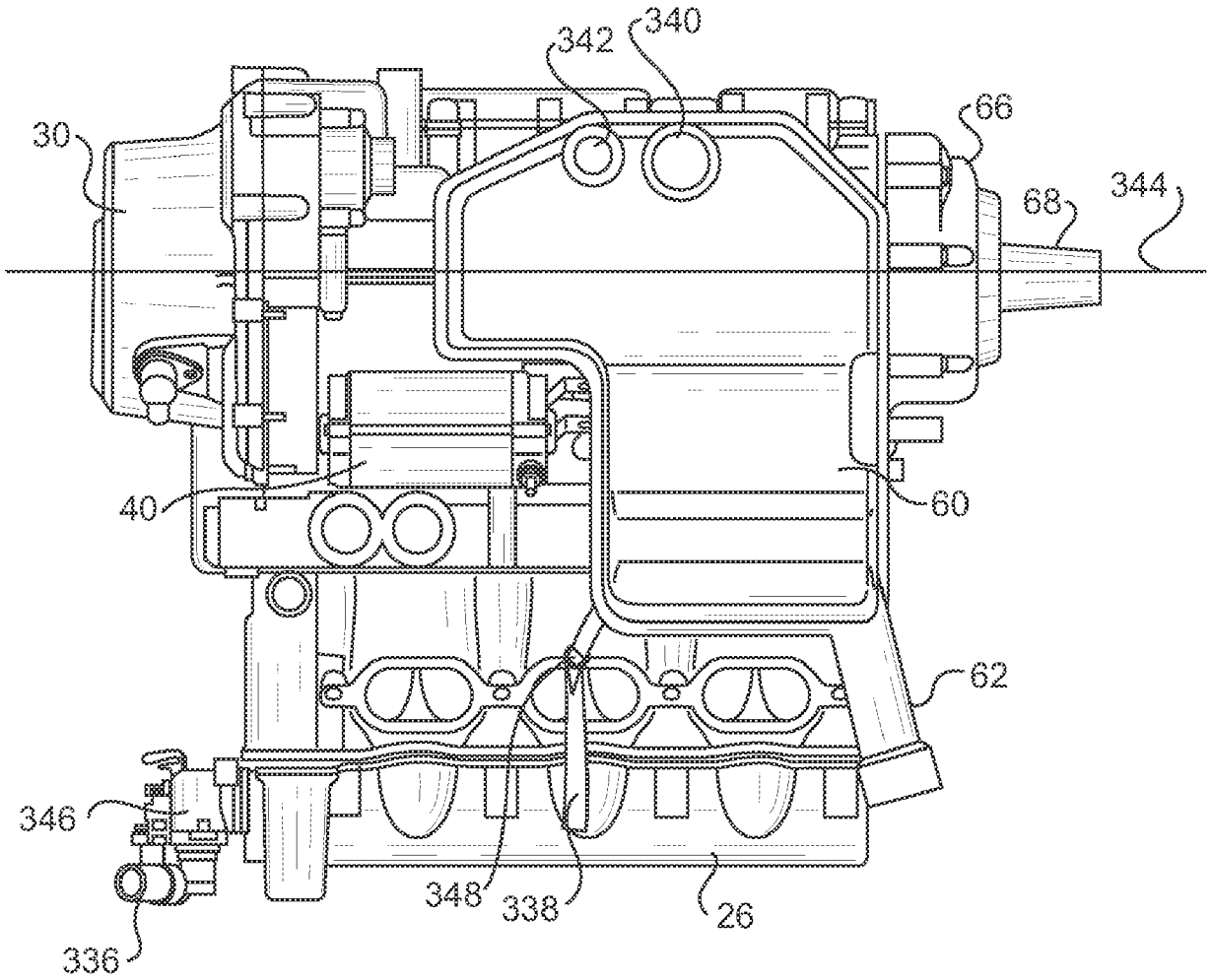
FIG. 39C is a side view of the engine of FIG. 39A with the engine turned upside down.

The engine 10 also has a ventilation hose 338, schematically illustrated in FIGS. 39A to 39C, which connects the oil tank 60 to the cylinder head assembly 26. This allows oil vapours in the oil tank 60 to be evacuated. Once in the cylinder head assembly 26, the oil is separated from the air by the blow-by gas separator 163 as described above.

The engine lubrication and blow-by systems are provided with features to prevent the oil from flowing to the air intake components 12 via the blow-by hose 336 in case the vehicle in which the engine 10 is installed (and therefore the engine 10) were to tip over and to permit the engine 10 to continue to operate when tilted. As shown in FIG. 39A, the inlet 340 to the oil tank 60 from the oil suction pump 146, and the outlet 342 from the oil tank 60 to the oil pressure pump 148 are located near the bottom of the oil tank 60 below the oil level in the tank, indicated by line 344, when the engine 10 is right side up. Similarly, the inlets (not shown) to the oil tank 60 of passages 318, 320 which extend from the cylinder head assembly 26 to the oil tank 60 are located near the bottom of the oil tank 60. Also, a first shut-off valve 346 is provided in the blow-by tube 336 and a second shut-off valve 348 is provided in the ventilation tube 338. It is contemplated that the first and second shut-off valves 346, 348 could be in the form of ball valves which are open when the engine 10 is right side up (FIG. 39A) and closed when the engine 10 is upside down (FIG. 39C). It is also contemplated that the first and second shut-off valves 346, 348 could be in the form of electrically actuated valves connected to a gravity switch, such as a mercury switch, which sends a signal to close the valves 346, 348 when the engine is upside down (FIG. 39C).

When the engine 10 is right side up and level as shown in FIG. 39A, the shut-off valves 346, 348 are opened and the lubrication and blow-by ventilation systems operate normally as described above.

When the engine 10 is tilted as in FIG. 39B (which shows a tilting of 70 degrees), the inlet 340, the outlet 342, and the inlets from the passages 318, 320 are still below the oil level 344 and therefore the flow of oil to and from the oil tank 60 continues normally. The shut-off valves 346, 348 remain opened since they are disposed above the oil level 344. However, since the engine 10 is tilted, the oil in the cylinder head assembly 26 can no longer drain through the timing chain case 174. Therefore, all the oil in the cylinder head assembly 26 drains through the passages 318, 320. Even though the timing chain case 174 no longer receives oil from the cylinder head assembly 26, it continues to receive oil from the chain tensioner 170.

When the engine 10 is upside down as shown in FIG. 39C, the second shut-off valve 348 closes, thus preventing the oil in the oil tank 60 to flood the cylinder head assembly 26 via ventilation hose 338. The first shut-off valve 346 also closes, thus preventing the oil present in the cylinder head assembly 26 to enter the air intake manifold 90. Also, in this position the inlet 340, the outlet 342, and the inlets from the passages 318, 320 are above the oil level 344 in the oil tank 60, which also prevents flooding of the cylinder head assembly 26.

The engine 10 is provided with various components which form part of the engine's electrical system. Some of these have been described above, such as the magneto 32, the starter motor 40, and the spark plugs 28, but others which are not specifically illustrated in the enclosed figures will now be described. An electronic control (ECU) controls the actuation and/or operation of the various electrically operated components of the engine 10, such as the spark plugs 28 and the fuel injectors 45. An electronic box contains multiple fuses and relays to insure proper current distribution to the components of the electrical system. A plurality of sensors are disposed around the engine 10 to provide information to the ECU. An RPM sensor is provided near the starter gear 136 to send signals to the ECU upon sensing teeth disposed on a periphery of the starter gear 136. The ECU can then determined the engine speed based on the frequency of the signals from the RPM sensor. A throttle position sensor senses the position of the throttle valve of the throttle body 82. An air temperature and pressure sensor is provided in the air intake manifold 90. At least one oxygen sensor is provided on the exhaust manifold 70 to provide signals indicative of the air/fuel mixture, to help the ECU determine whether the mixture is too lean or too rich. Based on the signals from the RPM sensor, throttle position sensor, air temperature and pressure sensors, and oxygen sensor, the ECU sends control signals to the spark plugs 28 and fuel injectors 45 to control the operation of the engine 10. An oil level sensor is provided in the oil tank 60 to provide a signal to the ECU indicative of a low oil condition, which will cause the ECU to send a signal to display a low oil warning on a control panel of the vehicle in which the engine 10 is being used.

The ECU also receives signals from other sources disposed on the vehicle in which the engine 10 is being used. For example, the ECU receives an ignition signal when a vehicle user desires to start then engine 10. Upon receipt of the ignition signal, the ECU sends a signal to activate the starter motor 40. A vehicle speed sensor could also be provided to inform the ECU of the speed of the vehicle.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine comprising:

a crankcase;

a crankshaft disposed in the crankcase;

a cylinder block connected to the crankcase, the cylinder block having a first side, a second side, and at least one cylinder;

at least one piston disposed in the at least one cylinder, the at least one piston being operatively connected to the crankshaft;

a cylinder head assembly connected to the cylinder block; and a cooling system for cooling at least a portion of the engine, the cooling system having:

a first cooling jacket for cooling the first side of the cylinder block;

a second cooling jacket for cooling the second side of the cylinder block;

a cylinder head cooling jacket for cooling the cylinder head assembly;

a coolant inlet fluidly communicating with the first cooling jacket;

a coolant outlet fluidly communicating with the second cooling jacket;

a coolant pump fluidly communicating with the coolant inlet for pumping coolant through the cooling system; and an oil cooler fluidly communicating with the first cooling jacket and the coolant pump, the first cooling jacket fluidly communicating with the cylinder head cooling jacket, the cylinder head cooling jacket fluidly communicating with the second cooling jacket;

coolant flowing in the cooling system flows from the coolant inlet to the first cooling jacket, from the first cooling jacket to the cylinder head cooling jacket, from the cylinder head cooling jacket to the second cooling jacket, and from the second cooling jacket to the coolant outlet, and a portion of the coolant flowing in the first cooling jacket flows to the oil cooler, and from the oil cooler to the coolant pump.

2. The engine of claim 1, wherein the coolant inlet is on the first side of the engine and the coolant outlet is on the second side of the engine.

3. The engine of claim 1, wherein the cooling system also has a heat exchanger for cooling coolant flowing in the cooling system; and wherein coolant flowing in the cooling system flows from the coolant outlet to the heat exchanger, from the heat exchanger to the coolant pump, and from the coolant pump to the coolant inlet.

4. The engine of claim 3, wherein the cooling system also has a thermostat, the thermostat has a thermostat inlet fluidly communicating with the coolant outlet, a first thermostat outlet fluidly communicating with the heat exchanger, and a second thermostat outlet fluidly communicating with the coolant pump; and wherein coolant flowing in the cooling system flows from the coolant outlet to the thermostat inlet, from the thermostat inlet to the first thermostat outlet when the coolant is above a predetermined temperature, and from the thermostat inlet to the second thermostat outlet when the coolant is below the predetermined temperature.

5. The engine of claim 1, wherein the first and second cooling jackets are integrally formed in the cylinder block; and the cylinder head cooling jacket is integrally formed in the cylinder head assembly.

6. The engine of claim 1, further comprising:

at least one intake valve disposed in the cylinder head assembly above the at least one cylinder on an intake side of the engine; and at least one exhaust valve disposed in the cylinder head assembly above the at least one cylinder on an exhaust side of the engine.

7. The engine of claim 6, wherein the first side of the cylinder block is on the exhaust side of the engine and the second side of the cylinder block is on the intake side of the engine.

8. A cooling system for an internal combustion engine comprising:

a first cooling jacket for cooling a first side of an engine cylinder block;

a second cooling jacket for cooling a second side of the engine cylinder block;

a cylinder head cooling jacket for cooling a cylinder head assembly of the engine;

a coolant inlet fluidly communicating with the first cooling jacket;

a coolant outlet fluidly communicating with the second cooling jacket;

a coolant pump fluidly communicating with the coolant inlet for pumping coolant through the cooling system; and an oil cooler fluidly communicating with the first cooling jacket and the coolant pump, the first cooling jacket fluidly communicating with the cylinder head cooling jacket, the cylinder head cooling jacket fluidly communicating with the second cooling jacket;

coolant flowing in the cooling system flows from the coolant pump to the coolant inlet, from the coolant inlet to the first cooling jacket, from the first cooling jacket to the cylinder head cooling jacket, from the cylinder head cooling jacket to the second cooling jacket, and from the second cooling jacket to the coolant outlet, and a portion of the coolant flowing in the first cooling jacket flows to the oil cooler, and from the oil cooler to the coolant pump.

9. The cooling system of claim 8, further comprising a heat exchanger for cooling coolant flowing in the cooling system; and wherein coolant flowing in the cooling system flows from the coolant outlet to the heat exchanger, and from the heat exchanger to the coolant pump.

10. The cooling system of claim 9, further comprising a thermostat, the thermostat has a thermostat inlet fluidly communicating with the coolant outlet, a first thermostat outlet fluidly communicating with the heat exchanger, and a second thermostat outlet fluidly communicating with the coolant pump; and wherein coolant flowing in the cooling system flows from the coolant outlet to the thermostat inlet, from the thermostat inlet to the first thermostat outlet when the coolant is above a predetermined temperature, and from the thermostat inlet to the second thermostat outlet when the coolant is below the predetermined temperature.

11. A method of cooling an internal combustion engine, the engine having a crankcase; a crankshaft disposed in the crankcase; a cylinder block connected to the crankcase, the cylinder block having a first side, a second side, and at least one cylinder; at least one piston disposed in the at least one cylinder, the at least one piston being operatively connected to the crankshaft; a cylinder head assembly connected to the cylinder block; a coolant pump; and an oil cooler; the method comprising:

pumping coolant to a first cooling jacket using the coolant pump for cooling the first side of the cylinder block;

delivering coolant from the first cooling jacket to a cylinder head cooling jacket for cooling the cylinder head assembly;

delivering coolant from the cylinder head cooling jacket to a second cooling jacket for cooling the second side of the cylinder block;

delivering coolant from the first cooling jacket to the oil cooler; and delivering coolant from the oil cooler to the coolant pump.

12. The method of claim 11, wherein the engine also has a heat exchanger for cooling the coolant, the method further comprising:

delivering coolant from the second cooling jacket to the heat exchanger; and delivering coolant from the heat exchanger to the coolant pump.

13. The method of claim 12, wherein the engine also has a thermostat, the method further comprising:

delivering coolant from the second cooling jacket to the thermostat;

delivering coolant from the thermostat to the heat exchanger when the coolant is above a predetermined temperature; and delivering coolant from the thermostat to the coolant pump when the coolant is below the predetermined temperature.

* * * * *